US008763184B2

(12) United States Patent
Cho et al.

(10) Patent No.: US 8,763,184 B2
(45) Date of Patent: Jul. 1, 2014

(54) CONTROL METHOD OF A LAUNDRY MACHINE

(75) Inventors: In Ho Cho, Changwon-si (KR); Hyung Yong Kim, Changwon-si (KR); Eun Jin Park, Changwon-si (KR); Ig Geun Kwon, Changwon-si (KR); Sang Il Hwang, Changwon-si (KR); Han Su Jung, Changwon-si (KR); Kyung Chul Woo, Seoul (KR); Byung Keol Choi, Seoul (KR); Myong Hun Im, Seoul (KR); Soo Young Oh, Seoul (KR); Moon Hee Hong, Seoul (KR); Woo Young Kim, Seoul (KR); Sang Heon Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 898 days.

(21) Appl. No.: 12/854,346

(22) Filed: Aug. 11, 2010

(65) Prior Publication Data

US 2011/0047717 A1 Mar. 3, 2011

Related U.S. Application Data

(63) Continuation-in-part of application No. 12/509,682, filed on Jul. 27, 2009, and a continuation-in-part of application No. 12/509,693, filed on Jul. 27, 2009, and a continuation-in-part of application No. 12/749,760, filed on Mar. 30, 2010.

(30) Foreign Application Priority Data

| | | |
|---|---|---|
| Aug. 1, 2008 | (KR) | 10-2008-0075673 |
| Sep. 5, 2008 | (KR) | 10-2008-0087871 |
| Sep. 12, 2008 | (KR) | 10-2008-0090212 |
| Mar. 31, 2009 | (KR) | 10-2009-0027664 |
| Aug. 11, 2009 | (KR) | 10-2009-0073826 |
| Aug. 11, 2009 | (KR) | 10-2009-0073827 |
| Aug. 11, 2009 | (KR) | 10-2009-0073828 |
| Aug. 11, 2009 | (KR) | 10-2009-0073959 |
| Aug. 11, 2009 | (KR) | 10-2009-0073960 |
| Aug. 11, 2009 | (KR) | 10-2009-0073976 |
| Aug. 11, 2009 | (KR) | 10-2009-0073977 |
| Aug. 11, 2009 | (KR) | 10-2009-0073978 |
| Aug. 11, 2009 | (KR) | 10-2009-0073979 |
| Aug. 11, 2009 | (KR) | 10-2009-0073980 |
| Aug. 11, 2009 | (KR) | 10-2009-0073981 |
| Aug. 27, 2009 | (KR) | 10-2009-0079827 |
| Aug. 27, 2009 | (KR) | 10-2009-0079915 |
| Aug. 27, 2009 | (KR) | 10-2009-0080128 |
| Sep. 15, 2009 | (KR) | 10-2009-0087141 |
| Nov. 2, 2009 | (KR) | 10-2009-0105116 |

(51) Int. Cl.

| | |
|---|---|
| ***D06F 33/02*** | (2006.01) |
| ***D06F 21/04*** | (2006.01) |
| ***D06F 35/00*** | (2006.01) |

(52) U.S. Cl.
USPC ..... 8/159

(58) Field of Classification Search
USPC ..... 8/158, 159
See application file for complete search history.

(56) References Cited

U.S. PATENT DOCUMENTS

| | | | | |
|---|---|---|---|---|
| 2,432,766 | A | 12/1947 | Kirby | 68/19 |
| 2,540,717 | A | 2/1951 | Diether | |
| 2,556,490 | A | 6/1951 | Chamberlin | |
| 2,942,447 | A | 6/1960 | Rickel et al. | |
| 3,387,310 | A | 6/1968 | Marshall | |
| 3,388,410 | A | 6/1968 | Marshall | |
| 3,811,300 | A | 5/1974 | Barton et al. | |
| 4,489,574 | A | 12/1984 | Spendel | 68/16 |
| 4,916,768 | A | 4/1990 | Broadbent | |
| 5,191,668 | A | 3/1993 | Euler et al. | 8/158 |
| 5,335,524 | A | 8/1994 | Sakane | |
| 5,560,061 | A | 10/1996 | Wentzlaff et al. | |
| 5,758,377 | A | 6/1998 | Cimetta et al. | |
| 5,768,730 | A | 6/1998 | Matsumoto et al. | |
| 5,813,069 | A | 9/1998 | Kim | 8/159 |
| 5,870,905 | A | 2/1999 | Imamura et al. | 68/12.04 |
| 6,023,854 | A | 2/2000 | Tsunomoto et al. | |
| 6,029,299 | A | 2/2000 | Baek et al. | |

| | | | | |
|---|---|---|---|---|
| 6,158,072 | A | 12/2000 | Baek et al. | |
| 6,401,284 | B1 | 6/2002 | Jeon et al. | |
| 6,460,382 | B1 | 10/2002 | Kim et al. | |
| 7,127,767 | B2 * | 10/2006 | McAllister et al. | 8/159 |
| 7,146,669 | B2 | 12/2006 | Orszulik | |
| 7,331,075 | B2 | 2/2008 | Lee et al. | |
| 7,478,547 | B2 | 1/2009 | Okazaki et al. | |
| 7,490,490 | B2 | 2/2009 | Hirasawa et al. | 68/12.04 |
| 7,530,133 | B2 | 5/2009 | Mitts | |
| RE40,732 | E | 6/2009 | Jeon et al. | |
| 7,739,765 | B2 | 6/2010 | Ashrafzadeh et al. | |
| 2001/0054203 | A1 | 12/2001 | Bringewatt et al. | |
| 2003/0020431 | A1 | 1/2003 | Kiuchi et al. | 318/779 |
| 2003/0208852 | A1 | 11/2003 | Hardaway et al. | |
| 2003/0208855 | A1 | 11/2003 | McAllister et al. | |
| 2004/0148710 | A1 | 8/2004 | Kim | |
| 2004/0158933 | A1 | 8/2004 | Seo et al. | |
| 2005/0050646 | A1 | 3/2005 | Lee et al. | |
| 2005/0066999 | A1 | 3/2005 | Dietz et al. | 134/18 |
| 2005/0160536 | A1 | 7/2005 | McAllister et al. | |
| 2005/0223504 | A1 | 10/2005 | Lee et al. | |
| 2005/0268669 | A1 | 12/2005 | Ko et al. | |
| 2005/0268670 | A1 | 12/2005 | Hirasawa et al. | |
| 2006/0021392 | A1 | 2/2006 | Hosoito et al. | |
| 2006/0112496 | A1 | 6/2006 | Kim | |
| 2006/0185095 | A1 | 8/2006 | Mitts | |
| 2007/0006394 | A1 | 1/2007 | Chang et al. | |
| 2007/0017262 | A1 | 1/2007 | McAllister et al. | |
| 2007/0124871 | A1 | 6/2007 | Kwon et al. | |
| 2007/0130700 | A1 | 6/2007 | Cho et al. | |
| 2008/0083132 | A1 | 4/2008 | Schaub et al. | 34/318 |
| 2008/0172804 | A1 | 7/2008 | Vanhazebrouck et al. | |
| 2008/0196172 | A1 | 8/2008 | Jeong | |
| 2008/0201867 | A1 | 8/2008 | Bang et al. | |
| 2008/0201868 | A1 | 8/2008 | Bang et al. | |
| 2008/0222818 | A1 | 9/2008 | Yun et al. | |
| 2008/0250824 | A1 | 10/2008 | Oh et al. | 68/5 |
| 2008/0276382 | A1 | 11/2008 | Benne et al. | |
| 2008/0289118 | A1 | 11/2008 | Park et al. | |
| 2008/0297098 | A1 | 12/2008 | Hollenbeck et al. | |
| 2009/0126222 | A1 | 5/2009 | Bae et al. | |
| 2009/0183319 | A1 | 7/2009 | Chai et al. | |
| 2009/0249838 | A1 | 10/2009 | Kim et al. | |
| 2009/0249840 | A1 | 10/2009 | Jo et al. | |
| 2010/0005680 | A1 | 1/2010 | Kim et al. | |
| 2010/0162586 | A1 | 7/2010 | Lee | |
| 2010/0205753 | A1 | 8/2010 | Kim et al. | |

FOREIGN PATENT DOCUMENTS

| | | | |
|---|---|---|---|
| CN | 1300892 | A | 6/2001 |
| CN | 1070953 | C | 9/2001 |
| CN | 1521305 | | 8/2004 |
| CN | 1521311 | A | 8/2004 |
| CN | 1609331 | A | 4/2005 |
| CN | 1637197 | A | 7/2005 |
| CN | 1680648 | A | 10/2005 |
| CN | 1782191 | A | 6/2006 |
| CN | 101046046 | A | 10/2007 |
| CN | 101168894 | A | 4/2008 |
| CN | 101397745 | A | 4/2009 |
| DE | 198 32 292 | A1 | 1/2000 |
| DE | 102 34 473 | | 2/2004 |
| DE | 103 26 551 | | 1/2005 |
| EP | 0 247 421 | | 2/1987 |
| EP | 0 247 421 | | 12/1987 |
| EP | 0 399 406 | A2 | 11/1990 |
| EP | 0 465 885 | A1 | 1/1992 |
| EP | 0 542 137 | | 5/1993 |
| EP | 0 618 323 | A1 | 10/1994 |
| EP | 0742307 | | 11/1996 |
| EP | 0 781 881 | | 7/1997 |
| EP | 1 116 812 | A1 | 7/2001 |
| EP | 1 164 217 | A1 | 12/2001 |
| EP | 1 380 682 | A2 | 1/2004 |
| EP | 1447468 | | 8/2004 |
| EP | 1 524 357 | A2 | 4/2005 |
| EP | 1 555 338 | A2 | 7/2005 |
| EP | 1 612 316 | A1 | 1/2006 |
| EP | 1 619 286 | | 1/2006 |
| EP | 1 634 985 | A1 | 3/2006 |
| EP | 2 042 638 | | 4/2009 |
| EP | 2 080 832 | | 7/2009 |
| EP | 2 090 686 | A1 | 8/2009 |
| GB | 2253215 | | 9/1992 |
| JP | 58-130089 | | 8/1983 |
| JP | 64-020897 | | 1/1989 |
| JP | 01-288596 | | 11/1989 |
| JP | 5-212189 | | 8/1993 |
| JP | 08-266776 | | 10/1996 |
| JP | 09-239189 | A | 9/1997 |
| JP | 09-276582 | A | 10/1997 |
| JP | 10-216390 | A | 8/1998 |
| JP | 2000-254385 | A | 9/2000 |
| JP | 2001-009188 | A | 1/2001 |
| JP | 2001-046779 | A | 2/2001 |
| JP | 2001-095935 | A | 4/2001 |
| JP | 2001-232091 | | 8/2001 |
| JP | 2002-119796 | | 4/2002 |
| JP | 2002-153696 | A | 5/2002 |
| JP | 2002-282587 | A | 10/2002 |
| JP | 2004-057821 | | 2/2004 |
| JP | 2004-081652 | | 3/2004 |
| JP | 2005-152309 | A | 6/2005 |
| JP | 2005-296631 | A | 10/2005 |
| JP | 2006-068193 | | 3/2006 |
| JP | 2006-239142 | A | 9/2006 |
| JP | 2006-247367 | A | 9/2006 |
| JP | 2007-054416 | A | 3/2007 |
| JP | 2007-068804 | A | 3/2007 |
| JP | 2007-117140 | A | 5/2007 |
| JP | 2007-117377 | A | 5/2007 |
| JP | 2007417140 | A | 5/2007 |
| JP | 2007-175528 | A | 7/2007 |
| JP | 2008-049270 | A | 3/2008 |
| JP | 2008-054826 | A | 3/2008 |
| JP | 2008-073128 | | 4/2008 |
| JP | 4100576 | | 6/2008 |
| JP | 2008-194256 | A | 8/2008 |
| JP | 2008-194258 | A | 8/2008 |
| JP | 2008-220620 | A | 9/2008 |
| JP | 2009-077747 | | 4/2009 |
| JP | 2009-160327 | A | 7/2009 |
| JP | 2009-213800 | A | 9/2009 |
| KR | 10-1996-0034548 | A | 10/1996 |
| KR | 10-1998-0060338 | | 10/1998 |
| KR | 10-0219267 | | 6/1999 |
| KR | 10-0220275 | B1 | 9/1999 |
| KR | 10-2001-0004704 | | 1/2001 |
| KR | 10-2004-0110973 | A | 12/2004 |
| KR | 10-2005-0039624 | | 4/2005 |
| KR | 10-2005-0061701 | A | 6/2005 |
| KR | 10-2005-0121052 | A | 12/2005 |
| KR | 10-2006-0023067 | A | 3/2006 |
| KR | 10-2006-0064119 | | 6/2006 |
| KR | 10-2006-0120934 | A | 11/2006 |
| KR | 10-0651977 | B1 | 11/2006 |
| KR | 10-2007-0001611 | A | 1/2007 |
| KR | 10-2007-0034901 | A | 3/2007 |
| KR | 10-2007-0038729 | A | 4/2007 |
| KR | 10-2007-0063658 | A | 6/2007 |
| KR | 10-0751780 | B1 | 8/2007 |
| KR | 10-2008-0010593 | | 1/2008 |
| KR | 10-2009-0037860 | A | 4/2009 |
| KR | 10-2010-0014052 | A | 2/2010 |
| KR | 10-2010-0028920 | A | 3/2010 |
| KR | 10-2010-0091721 | A | 8/2010 |
| KR | 10-0984583 | B1 | 9/2010 |
| KR | 10-2011-0016314 | A | 2/2011 |
| KR | 10-2011-0016330 | A | 2/2011 |
| KR | 10-1012594 | B1 | 2/2011 |
| RU | 2 089 691 | | 9/1997 |
| RU | 2 096 546 | | 11/1997 |
| RU | 2123550 | | 12/1998 |
| RU | 2006145871 | | 2/2006 |
| RU | 2005122725 | | 1/2007 |
| RU | 2 293 806 | | 2/2007 |
| RU | 2339751 | | 11/2008 |

| | | | |
|---|---|---|---|
| RU | 2 398 059 | C1 | 8/2010 |
| SU | 242774 | | 4/1969 |
| SU | 1043207 | A | 9/1983 |
| SU | 1694744 | | 11/1991 |
| TW | 200840905 | | 10/2008 |
| TW | 200840906 | | 10/2008 |
| WO | WO 2008/030066 | | 3/2008 |
| WO | WO 2008/069607 | | 6/2008 |
| WO | WO 2008/075987 | A2 | 6/2008 |
| WO | WO 2008/099547 | | 8/2008 |
| WO | WO 2008/099548 | A1 | 8/2008 |
| WO | WO 2008/099549 | | 8/2008 |
| WO | WO 2008/123695 | | 10/2008 |
| WO | WO 2009/017361 | A2 | 2/2009 |
| WO | WO 2011/053097 | A2 | 5/2011 |

OTHER PUBLICATIONS

U.S. Office Action issued in U.S. Appl. No. 13/420,819 dated Feb. 1, 2013.
U.S. Office Action issued in U.S. Appl. No. 12/749,760 dated Feb. 4, 2013.
Chinese Office Action issued in CN Application No. 201080019656.8 dated Jan. 6, 2013 (with English translation).
International Search Report dated Dec. 7, 2011 issued in Application No. PCT/KR2010/007672.
International Search Report dated Dec. 22, 2011 issued in Application No. PCT/KR2010/007673.
Korean Office Action issued in Application No. 10-2009-0087141 dated May 13, 2011 (full Korean text and full English translation).
Korean Office Action issued in Application No. 10-2009-0073978 dated Jun. 24, 2011 (full Korean text and English translation).
Korean Notice of Allowance issued in Application No. 10-2009-0087141 dated Sep. 21, 2011 (full Korean text and full English translation).
Korean Notice of Allowance issued in Application No. 10-2009-0073978 dated Sep. 27, 2011 (full Korean text and English translation).
Australian Office Action issued in AU Application No. 2010287154 dated Jan. 29, 2013.
Taiwan Office Action issued in Tw Application No. 99126789 dated Jan. 23, 2013 (full Chinese text and full English translation).
Non-Final Office Action issued in U.S. Appl. No. 12/902,396 dated Mar. 7, 2013.
Final Office Action issued in U.S. Appl. No. 12/509,693 dated Apr. 2, 2013.
Front Loading Automatic Washer, Use and Care Guide [online] Maytag Aug. 18, 2006; [retrieved on Sep. 2, 2011]; Retrieved from the Internet: <URL: http://dl.owneriq.net/1/11ea371b-d431-44f5-8002-03a5d6ab459.pdf; pp. 1-72.
PCT International Search Report and Written Opinion issued in PCT Application No. PCT/KR2010/005255 dated Feb. 25, 2011.
PCT International Search Report and Written Opinion issued in PCT Application No. PCT/KR2010/005807 dated Feb. 25, 2011.
Chinese Office Action issued in CN Application No. 200910171046.9 dated Mar. 2, 2011 (full Chinese text and English translation).
International Search Report and Written Opinion issued in PCT Application No. PCT/KR2010/0069999 dated Apr. 8, 2011.
International Search Report and Written Opinion issued in PCT Application No. PCT/KR2010/007664 dated Apr. 26, 2011.
Korean Office Action issued in KR Application No. 10-2009-0087141 dated May 13, 2011.
Korean Office Action issued in KR Application No. 10-2009-0073976 dated May 31, 2011.
Korean Office Action issued in KR Application No. 10-2008-0087871 dated May 31, 2011.
Russian Office Action issued in RU Appln. No. 2012111656 dated May 22, 2013 (with English translation).
Russian Notice of Allowance issued in RU Appln. No. 2011147906 dated Jun. 3, 2013 (with English translation).
U.S. Office Action issued in U.S. Appl. No. 12/902,396 dated Jun. 14, 2013.
Russian Notice of Allowance issued in Appln. No. 2011146523 dated Jul. 1, 2013 (with English translation).
Russian Office Action issued in RU Appin. No. 2011147901 dated Jul. 9, 2013 (with English translation).
U.S. Office Action issued in U.S. Appl. No. 12/509,693 dated Jul. 17, 2013.
U.S. Office Action issued in U.S. Appl. No. 12/749,760 dated Jul. 29, 2013.
Chinese Office Action issued in CN Application No. 201080019658.7 dated Jul. 19, 2013.
International Search Report issued in PCT/KR2009/005094 dated May 7, 2010.
International Search Report issued in PCT/KR2010/000884 dated Sep. 28, 2010.
European Search Report issued in EP Application No. 09010403.5 dated Dec. 4, 2009.
Russian Office Action issued in RU Application No. 2011132395 dated Jul. 3, 2012.
Chinese Office Action issued in CN Application No. 2010-80019657 dated Dec. 5, 2012.
U.S. Office Action issued in U.S. Appl. No. 12/509,682 dated Dec. 13, 2012.
PCT International Search Report dated Jul. 4, 2011 issued in Application No. PCT/KR2010/006991.
Mexican Office Action issued in Application No. MX/a/2011/010211 dated Aug. 21, 2012 (full Mexican text and full English Translation).
Chinese Office Action issued in Application No. 201080005759.9 dated Sep. 5, 2012 (full Chinese text and full English Translation).
European Search Report dated Sep. 21, 2012 issued in Application No. 09 009 792.4.
Office Action issued in U.S. Appl. No. 12/509,693 dated Oct. 24, 2012.
International Search Report and Written Opinion issued PCT Application No. PCT/KR2010/007670 dated Aug. 16, 2011.
International Search Report and Written Opinion issued in PCT Application No. PCT/KR2011/000904 dated Sep. 21, 2011.
Korean Notice of Allowance issued in KR Application No. 10-2009-0087141 dated Sep. 21, 2011 (full Korean text and full English translation).
Office Action issued in U.S. Appl. No. 13/420,839 dated Jul. 25, 2012.
Office Action issued in U.S. Appl. No. 12/509,682 dated Sep. 7, 2012.
Office Action issued in U.S. Appl. No. 13/420,819 dated Sep. 7, 2012.
Office Action issued in U.S. Appl. No. 12/749,760 dated Sep. 25, 2012.
International Search Report and Written Opinion issued in PCT Application No. PCT/KR2010/006999 dated Apr. 8, 2011.
Japanese Office Action dated Jul. 26, 2013 issued in Application No. 2012-534107.
Taiwanese Office Action dated Aug. 8, 2013 issued in Application No. 099126789 (with English translation).
U.S. Office Action issued in U.S. Appl. No. 12/902,396 dated Sep. 24, 2013.
U.S. Office Action issued in U.S. Appl. No. 12/509,682 dated Sep. 27, 2013.
Taiwanese Office Action dated Sep. 11, 2013 issued in Application No. 099126791 (with English translation).
Russian Decision to Grant a Patent dated Jul. 19, 2013 issued in Application No. 2012111656 (with English translation).
Russian Decision to Grant a Patent dated Oct. 9, 2013 issued in Application No. 2011146527 (with English translation).
United States Office Action dated Oct. 2, 2013 issued in U.S. Appl. No. 12/854,372.
United States Office Action dated Oct. 23, 2013 issued in U.S. Appl. No. 12/854,263.
United States Office Action dated Oct. 23, 2013 issued in U.S. Appl. No. 12/854,330.
United States Final Office Action dated Oct. 28, 2013 issued in U.S. Appl. No. 12/509,693.
U.S. Notice of Allowance issued in U.S. Appl. No. 13/420,839 dated Dec. 23, 2013.
U.S. Office Action issued in U.S. Appl. No. 12/938,110 dated Dec. 30, 2013.

U.S. Final Office Action issued in U.S. Appl. No. 12/509,682 dated Jan. 13, 2014.
U.S. Notice of Allowance issued in U.S. Appl. No. 12/854,372 dated Jan. 27, 2014.
U.S. Final Office Action issued in U.S. Appl. No. 12/854,263 dated Feb. 20, 2014.
U.S. Office Action issued in U.S. Appl. No. 12/509,693 dated Feb. 21, 2014.
U.S. Office Action issued in U.S. Appl. No. 12/854,330 dated Feb. 21, 2014.
U.S. Office Action issued in U.S. Appl. No. 12/938,078 dated Feb. 28, 2014.
U.S. Notice of Allowance issued in U.S. Appl. No. 12/902,396 dated Mar. 7, 2014.
Chinese Office Action issued in Appln. No. 201080042220.0 dated Feb. 20, 2014.
PCT International Search Report and Written Opinion dated Nov. 30, 2010 issued in Application No. PCT/KR2010/001992.
PCT International Search Report and Written Opinion dated Jan. 24, 2011 issued in Application No. PCT/KR2010/05266.
PCT International Search Report and Written Opinion dated Jan. 24, 2011 issued in Application No. PCT/KR2010/05258.
PCT International Search Report and Written Opinion dated Jan. 31, 2011 issued in Application No. PCT/KR2010/05257.
PCT International Search Report and Written Opinion dated Jan. 31, 2011 issued in Application No. PCT/KR2010/05260.
Chinese Office Action issued in Appln No. 201080046534.8 dated Mar. 19, 2014.
U.S. Office Action issued in U.S. Appl. No. 12/938,135 dated Mar. 31, 2014.
U.S. Office Aciton issued in U.S. Appl. No. 12/902,300 dated Apr. 11, 2014.
U.S. Final Office Action issued in U.S. Appl. No. 12/938,110 dated Apr. 21, 2014.

* cited by examiner

*Primary Examiner* — Joseph L Perrin
(74) *Attorney, Agent, or Firm* — Ked & Associates, LLP

(57) ABSTRACT

A laundry machine and a control method thereof are provided in which laundering ability may be improved while also improving efficiency and noise/vibration. The laundry machine employs a plurality of drum motions by varying drum rotational speed, drum rotational direction, and drum starting and stopping point, to provide different motion of laundry items in the drum.

14 Claims, 26 Drawing Sheets

FIG. 22

| Cycle | Main Step | Sub Step | Effect | Condition | Motion of Drum |
|---|---|---|---|---|---|
| | Weight Sensing | | | | Tumble |
| Washing cycle | Water Supply | | | Weight / Type of laundry | |
| | | Detergent Dissolution Promotion | Increasing of washing cycle effciency & Time saving<br>Supplying of strong mechanical power in water & laundry, Occurring of turbulence in water | If, weight is smaller than reference / weight is equal to reference | Step<br>Scrub |
| | | | Increasing of contact with water<br>Decreasing of Main washing time | If, weight is more than reference | Skip sub-step |
| | | | Grip and release<br>Increasing friction between laundry and drum<br>Scrub effect on beginning of Cycle | If, type is cotton | Scrub |
| | | | Most falling effect<br>Occurring of Strike washing effect on beginning of Cycle, Detergent dissolution within short time | If, type is synthetic fiber | Step |
| | | Laundry wetting promotion | Fully wetting, Increasing contacting surface of laundry, Continuos upsetting of laundry<br>Increasing contact time with water | If, weight is smaller than reference / weight is equal to reference | Rolling<br>Filtration<br>Step |
| | | | Fully wetting<br>Prevention to twist (entangle) | If, weight is more than reference | Filtration<br>Tumble |
| | Heating | | | Weight / Degree of dirt | |
| | | | | Normal & Heavy weight | Tumble |
| | | | Repeat laundry upsetting in bottom of drum<br>Increasing a contact time with water | Small weight | Rolling |
| | | | Increasing damage of laundry, if dirt is low | Selected degree of dirt | Changing moving rate |
| | Main Washing | | | Weight / Degree of dirt / Type | |
| | | | Strong mechanical power and moving | Small weight | Step<br>Tumble<br>Rolling |
| | | | Continuous supplying water in laundry<br>Increasing contact surface with water<br>Distributed supplying of water | Normal & Heavy weight | Filtration<br>Tumble |
| | | | Increasing damage of laundry, if dirt is low | Selected dgree of dirt | Changing moving rate |
| | | | Increasing washing efficiency through strong mechanical power | Cotton course selection | Rolling<br>Tumble |

FIG. 22 (Continued)

| | | | | | |
|---|---|---|---|---|---|
| | | | Continuous supplying detergent and water | Cotton course selection | Filtration<br>Tumble |
| | | | Minimizing damage of laundry<br>Increasing contact time with water<br>Increasing washing effect | Synthetic fiber course selection | Swing<br>Tumble |
| Mid Spin | | | | | |
| Rinsing cycle | 1st Rinsing | | Deep rinsing and moving<br>Continuous friction between laundry and water | | Scrub<br>Swing |
| | | | Preventing overload and overheating of motor | | Tumble |
| | 1st Drain & Mid Spin | | Increasing efficiency and Decreasing suds due to laundry drop<br>Maximize to separate contaminant through strong mechanical power | Small weight | Step |
| | | | | Heavy weight | Tumble |
| | 2nd Rinsing | | | If detergent is liquid | Skip sub-step |
| | 2nd Drain & Mid Spin | | | If detergent is liquid | Skip sub-step |
| | Final Rinsing | | | | Scrub<br>Swing |
| | 3rd Drain & Mid Spin | | Laundry dispersion effect | | Step<br>Scrub |
| | Additional Rinsing | | | If suds detect in final rinsing | |
| Spin cycle | Unbalance Sensing | | | | |
| | 1st Laundry Untwisting Step | | | Unbalance | |
| | | | Increasing effect of untwisting | If Unbalace is higher than reference | Step |
| | Acceleration Step | | | | |
| | Main Spin Step | | | | |
| | 2nd Laundry Untwisting Step | | Easy unloading | | Step |

FIG. 23

| Main Step | Sub Step | Effect | Condition | Motion of Drum |
|---|---|---|---|---|
| Course selection Step | | | | |
| Weight Sensing Step | | | | |
| Time setting Step | | | | |
| Supplying Step | | Preventing of Unbalance | | Tumble |
| | | Remove Insoluble dirt through laundry dropping<br>Increasing of washing efficiency & Time saving | | Step<br>Scrub |
| | | Laundry wetting and Water supplying at same time | | Filtration |
| | | Activation of detergent dissolution<br>Minimizing of remained detergent | | Rolling |
| Water temp. Sensing | | | | |
| Cycle time correction | | | | |
| Washing cycle | | | Weight / Temperature | |
| | | Remove dirt through dropping impact<br>Preventing Unbalance<br>Laundry dispersion effect | If, weight is smaller than reference / weight is equal to reference | Step<br>Tumble<br>Rolling |
| | | Securing of Washing performance<br>Laundry dispersion effect | If, weight is more than reference | Filtration<br>Tumble |
| | Heating Step | Securing safety of machine<br>Preveting of deteriorating washing performance | If, temperature is lower than reference | Tumble<br>Rolling<br>* |
| | | | If, weight is smaller than reference / weight is equal to reference | |
| | Soaking Step | Securing of Washing performance Time saving<br>Heavy duty seperation | Cold water supplying | Step<br>Tumble<br>Rolling |
| | Remove dirt step | Minimizing of motor overload<br>High washing performance<br>Time saving | Heating middle temperature | Tumble<br>Rolling |
| | Remove remained dirt step | | Heating high temperature | Step<br>Tumble<br>Rolling |
| | | | If, weight is more than reference | |
| | Soaking Step | | Cold watr supplying | Tumble<br>Rolling |
| | Remove dirt step | | Heating middle temperature | Tumble |
| | Remove remained dirt step | | Heating high temperature | Filtration<br>Tumble |
| Rinsing Cycle | | | | |
| Spin Cycle | | | | |

* Don't perform Step motion during Heating step

FIG. 24

| Main Step | Sub Step | Effect | Condition | Motion of Drum |
|---|---|---|---|---|
| Course selection Step | | | | |
| Weight Sensing Step | | | | |
| Supplying Step | | | Water temperature, Type, Operating time, Weight | |
| | | Minimizing laundry friction to each other<br>Increasing laundry wetting<br>Promotion detergent dissolution | | Swing<br>Filtration |
| | 1st Water supplying Step | Promotion detergent dissolution<br>Minimizing of laundry damage<br>Minimizing of noise | | Swing<br>Rolling |
| | 2nd Water supplying Step | Laundry wetting, Occurring of turbulence in water<br>Laundry untwist<br>Minimizing of laundry damage<br>Minimizing friction and noise | | Filtration<br>Swing<br>Rolling |
| Water temp. Sensing step | | | | |
| | Heating step | | Temp. is lower than setting point | Don't perform step motion |
| Washing Step | | Mininizing friction to laundary<br>Washing performance supplementation | | Swing<br>Step*<br>Swing |
| | 1st Washing Step | Dirt Soaking and impact<br>Water stir effect<br>Friction and Noise Minimize | Small weight | Step<br>Rolling |
| | | | Heavy weight | Tunble |
| | 2nd Washing Step | Uniform heating<br>Minimizing laundry damage<br>Minimizing friction and noise | Small weight | Swing<br>Rolling |
| | | | Heavy weight | Tunble |
| | 3rd Washing Step | High performance of washing | | Swing<br>Step |
| Rinsing Step | | Minimizing friction and noise<br>Remained detergent drain | | Rolling<br>Swing<br>** |
| Spin Step | | | | |

* Step motion is shorter than swing motion
** Don't perform filtration motion

CONTROL METHOD OF A LAUNDRY MACHINE

CROSS-REFERENCE TO RELATED APPLICATION(S)

This application claims priority under 35 U.S.C. §119 to Korean Application Nos. 10-2009-0073826 filed on Aug. 11, 2009; 10-2009-0073827 filed on Aug. 11, 2009; 10-2009-0073828 filed on Aug. 11, 2009; 10-2009-0079827 filed on Aug. 27, 2009; 10-2009-0080128 filed on Aug. 27, 2009; 10-2009-0073976 filed on Aug. 11, 2009; 10-2009-0073977 filed on Aug. 11, 2009; 10-2009-0073959 filed on Aug. 11, 2009; 10-2009-0073960 filed on Aug. 11, 2009; 10-2009-0073979 filed on Aug. 11, 2009; 10-2009-0073980 filed on Aug. 11, 2009; 10-2009-0073981 filed on Aug. 11, 2009; 10-2009-0079915 filed on Aug. 27, 2009; and 10-2009-0073978 filed on Aug. 11, 2009 and 10-2009-0105116 filed on Nov. 2, 2009; and this application is a continuation-in-part application of U.S. application Ser. No. 12/509,682 filed in the U.S. on Jul. 27, 2009, claiming priority to 10-2008-0075673 filed in Korea on Aug. 1, 2008 and 10-2008-0090212 filed in Korea on Sep. 12, 2008; Ser. No. 12/509,693 filed in the U.S. on Jul. 27, 2009, claiming priority to 10-2008-0087871 filed in Korea on Sep. 5, 2008; and Ser. No. 12/749,760 filed in the U.S. on Mar. 30, 2010, claiming priority to 10-2009-0027664 filed in Korea on Mar. 31, 2009 and 10-2009-0087141 filed in Korea on Sep. 15, 2009, whose entire disclosure(s) are hereby incorporated by reference.

BACKGROUND

1. Field

This relates to a laundry machine and a control method thereof.

2. Background

Laundry machines are machines which are typically used to wash and/or dry fabric articles. Laundry machines may include a drum rotatably installed in a cabinet, with the drum being configured to receive laundry items therein for treatment. In a top loading laundry machine, the drum may be oriented substantially vertically, with an opening at a top end thereof through which the laundry items may be received. In a front loading laundry machine, the drum may be oriented substantially horizontally, or at a slight incline, with an opening at a front end thereof through which the laundry items may be received. Movement of the drum and friction between the laundry items, wash water and wash agents, and the interior of the drum, may facilitate contaminant removal from the laundry items.

BRIEF DESCRIPTION OF THE DRAWINGS

The embodiments will be described in detail with reference to the following drawings in which like reference numerals refer to like elements wherein:

FIGS. 22-24 illustrate effects and conditions to determine the motions.

DETAILED DESCRIPTION

I. Laundry Machine

Figure 1:
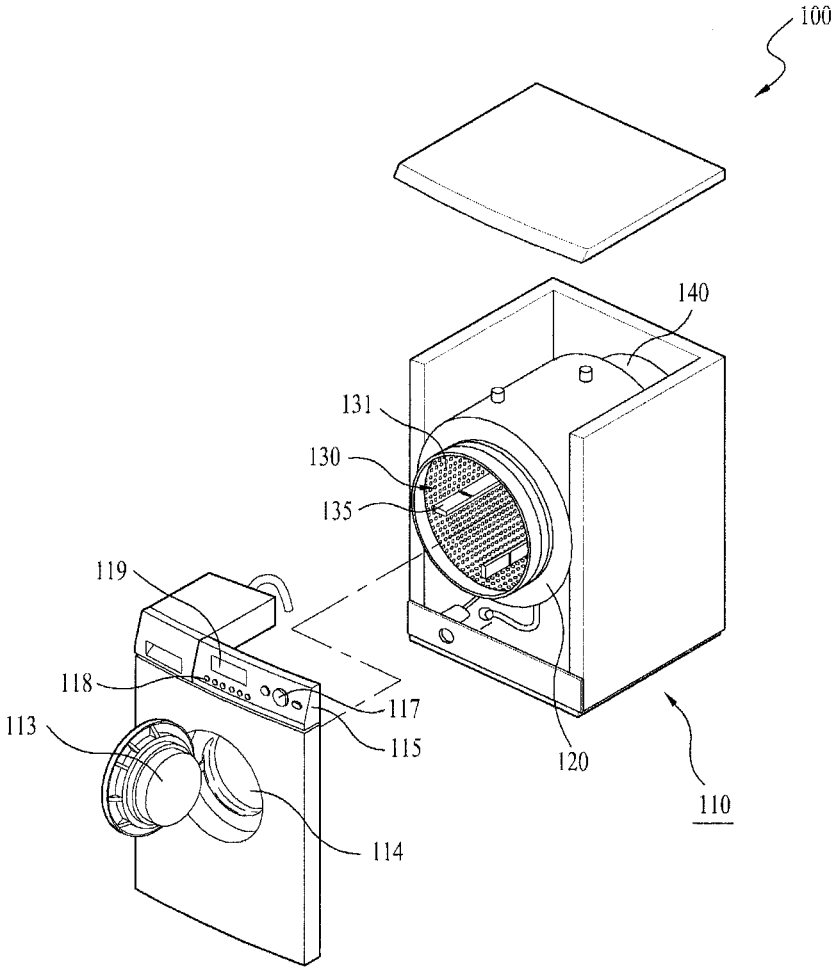
FIG. 1 is an exploded perspective view of an exemplary laundry machine as embodied and broadly described herein.

A laundry machine and a control method thereof, as embodied and broadly described herein, will be described in reference to the accompanying drawings. FIG. 1 is an exploded perspective view of a laundry machine according to a first embodiment as broadly described herein, to which control methods according to various embodiments may be applied.

In reference to FIG. 1, a laundry machine 100 according to a first embodiment includes a cabinet 110 configured to define an exterior appearance thereof, a tub 120 provided in the cabinet 110 to hold wash water therein and a rotatable drum 130 provided in the tub 120. The cabinet 110 defines the exterior appearance of the laundry machine 100. A door 113 is provided at an opening 114 of the cabinet 110 and a user opens the door 113 to load laundry into the cabinet 110.

The tub 120 is provided in the cabinet 110 to hold wash water therein. The drum 130 may be rotatable in the tub 120 and may accommodate laundry therein. In this case, a plurality of lifters 135 may be provided in the drum 130 to lift and drop the laundry during washing. The drum 130 includes a plurality of through-holes 131 to allow the wash water held in the tub 120 to pass therethrough. The tub 120 may be supported by one or more springs provided at an outer side of the tub 120. A motor 140 is mounted to a rear surface of the tub 120 and the motor 140 rotates the drum 130. When vibration is generated by the drum 130 rotated by the motor 140, the tub 120 is vibrated in communication with the drum 130. When the drum 130 is rotated, the vibration generated in the drum 130*b* and the tub 120 may be absorbed by a damper located under the tub 120.

As shown in FIG. 1, the tub 120 and the drum 130 may be provided substantially in parallel to a base plate of the cabinet 110. Alternatively, rear portions of the tub 120 and the drum 130 may be positioned at an oblique orientation, with the open end of the drum 130 oriented slightly upward to facilitate loading laundry into the drum 130.

A control panel 115 may be provided in a predetermined portion of a front of the cabinet 110. The user may select a course of the washing machine via the control panel 115 or recognize information relating to the washing machine. For example, a course selecting part 117 configured for the user to select a particular washing course may be provided in the control panel 115. Furthermore, an option selecting part 118 may be provided to allow the user to adjust operational conditions of each cycle or step provided in the selected course and a display part 119 may be provided in the control panel 115 to display current operation information of the washing machine. More details of the washing machine is described in U.S. Pat. No. 6,460,382 B1 issued Oct. 8, 2002 and U.S. application Ser. No. 12/704,923 filed Feb. 12, 2010, whose entire disclosures are incorporated herein by reference.

Figure 2:
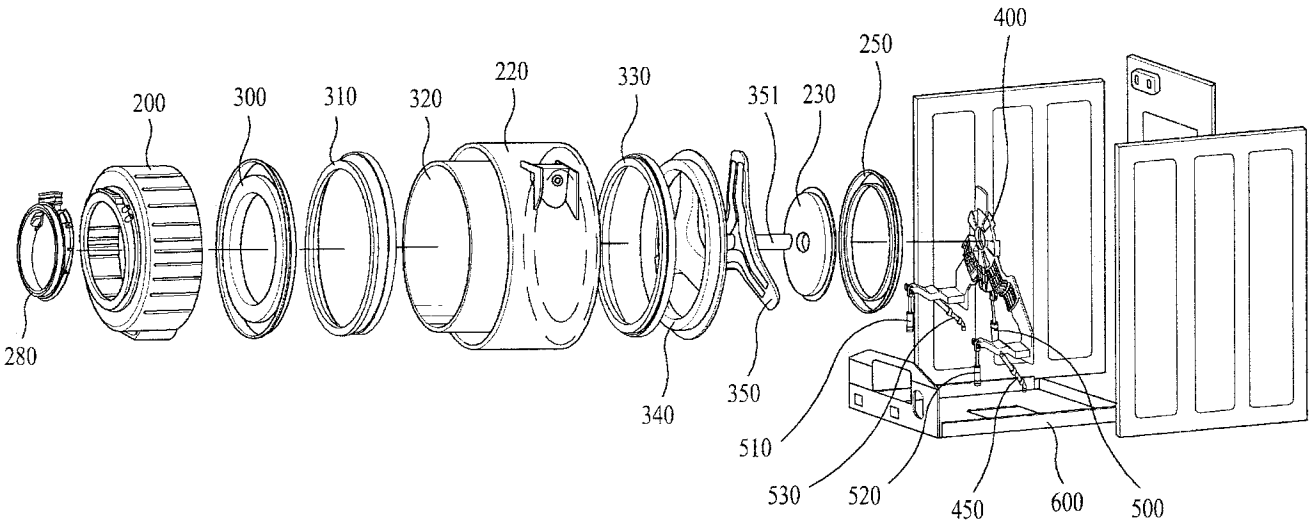
FIG. 2 is an exploded view of another exemplary laundry machine as embodied and broadly described herein.

FIG. 2 is an exploded perspective view of a laundry machine according to another embodiment as broadly described herein. A laundry machine according to various embodiments as broadly described herein may include a tub fixedly supported to a cabinet, or a tub supported to a cabinet via a flexible structure such as suspension unit, and thus not fixedly secured thereto, as shown in FIG. 2. Also, the supporting structure of the tub may be between the supporting via the suspension unit and the complete fixing structure. That is, the tub may be supported flexibly via a suspension unit which will be described later, it may be supported fixedly to be a more rigidly supported state than the above flexible supported state. In alternative embodiments, the laundry machine may be provided without a cabinet. For example, an installation space of a built-in type laundry machine may be defined by a wall structure instead of a cabinet. That is, in certain embodiments, a cabinet configured to form an independent exterior appearance may not be provided.

In reference to FIG. 2, a tub may include a tub front 200 and a tub rear 220 composing a rear portion of the tub front 200. The tub front 200 and the tub rear 220 may be assembled by screws or other appropriate fastening mechanism, and a predetermined space is formed therein to accommodate a drum. The tub rear 220 includes an opening formed in a rear surface thereof and a rear gasket 250 may be connected to an inner circumference of the opening. The rear gasket 250 may be connected to a tub back 230 and the tub back 230 may include a through-hole having a shaft that passes through a center thereof.

The rear gasket 250 is sealed and connected to each of the tub back 230 and the tub rear 220 to prevent wash water from leaking from the tub. As the tub back 230 vibrates when the drum is rotated, the tub back 230 may be distant from the tub rear 220 a predetermined distance not to interfere with the tub rear 220. Also, the rear gasket 250 may be formed of flexible material to enable the tub back 230 to relative-move, not interfering with the tub rear 220. The rear gasket 250 may include a corrugated part which is extendible to an enough length to allow the relative motion of the tub back 230. This embodiment presents the rear gasket 250 connected to the tub back 230 and the present invention is not limited thereto. The rear gasket 250 is configured to seal the gap between the tub and a driving part (not shown) including a shaft 351 and a bearing housing 400 and to allow the driving part to relative-move with respect to the tub. As a result, the shapes and the connected objects of the rear gasket 250 may be variable unlimitedly, only if this function is enabled. A flexible material 280 which will be described as front gasket later may be installed at a front portion of the tub front 200.

The drum may be configured of a drum front 300, a drum center 320 and a drum back 340. Ball balancers 310 and 330 may be installed in front and rear portions of the drum, respectively. The drum back 340 may be connected to a spider 350 and the spider 350 may be connected to the shaft 351. The drum is rotatable within the tub by a rotational force transmitted via the shaft 351.

The shaft 351 may be connected to a motor and pass through the tub back 230. In certain embodiments, the motor may be connected to the shaft 351 concentrically. In certain embodiments, the motor may be directly connected to the shaft 351, and in particular, a rotor of the motor may be directly connected to the shaft 351. In alternative embodiments, the motor and the shaft 351 may be indirectly connected with each other, for example, they may be connected by a belt.

The bearing housing 400 may be secured to the tub back 230 to rotatably support the shaft, between the motor and the tub back 230. A stator may be fixedly secured to the bearing housing 400. And the rotor may be located around the stator. As mentioned above, the rotor may be directly connected to the shaft 351, with the motor being an outer rotor type motor that may be connected with the shaft directly. The bearing housing 400 may be supported by a base 600 via the suspension unit. The suspension unit may include a perpendicular suspension and an oblique suspension configured to support the bearing housing 400 with respect to a forward and backward direction. For example, the suspension unit according to this embodiment may include three perpendicular (vertical, as shown in FIG. 2) suspensions 500, 510 and 520 and two oblique (angled, or inclined, as shown in FIG. 2) suspensions 450 and 530 configured to support the bearing housing 400 with respect to a forward and backward direction. The suspension unit may be connected to the base 600 with a predetermined elastic transformation enabling a forward/backward and/or rightward/leftward movement of the drum, and thus not connected fixedly. That is, the suspension unit may be supported by the base, with sufficient predetermined elasticity to allow rotation at a predetermined angle in forward/backward and rightward/leftward directions with respect to the points connected with the base. For such the elastic support, the perpendicular suspension may be installed to the base by a rubber bushing or other mechanism as appropriate.

The perpendicular suspension of the suspension unit may suspend the vibration of the drum elastically and the oblique suspension may dampen the vibration. That is, the perpendicular suspension may be used as spring and the oblique suspension as damping means in a vibration system including a spring and damping means.

The tub is supported to the cabinet and the vibration of the drum may be damped by the suspension unit. As a result, the laundry machine according to this embodiment may have a substantially independent supporting structure between the tub and the drum or it may have a structure having the vibration of the drum not directly transmitted to the tub.

II. Drum Rotation Motion

Diversification of drum driving motions and combinations thereof, as embodied and broadly described herein, may provide significant improvements in washing ability, noise/vibration, energy consumption, and customer satisfaction. A control method that provides improved washing ability will be described. The hand-wash effect may be embodied by various movement patterns of the laundry. For example, the hand-wash effect may be embodied by a combination of massaging and/or disentangling and/or striking and/or swinging and/or rubbing and/or squeezing/filtrating.

Such various movement patterns of the laundry may be implemented by various drum driving motions and combination(s) of different drum driving motions. The drum driving motions may include combinations of rotation directions and rotation speeds. The laundry located in the drum may have different falling directions, falling points and falling distance because of the drum driving motions. Because of that, the laundry may have different movement inside the drum. The drum driving motions may be embodied by, for example, controlling rotation direction and/or speed of the motor that drives the drum.

When the drum is rotated, the laundry is lifted by one or more lifts 135 provided at the inner circumferential surface of the drum. Because of that, the rotation direction of the drum may be controlled and the shock applied to the laundry may be varied accordingly. That is, a mechanical force applied to the laundry such as the friction generated between laundry items, the friction generated between the laundry and the water, and the dropping shock of the laundry may be varied. In other words, a degree of striking or scrubbing applied to the laundry items so as to wash the laundry may be varied and a degree of laundry distribution or turn-over inside the drum may be varied accordingly.

As a result, such a control method of the laundry machine may provide various drum driving motions and the drum driving motions are varied according to each of the cycles and a specific step composing the cycle, such that an optimal mechanical force may be used to treat the laundry depending on the type of laundry being washed, the soil level, and other such factors. Because of that, washing efficiency of the laundry may be improved. In addition, the excessive time required by the typical drum driving motion may be avoided.

In certain embodiments, to embody such various drum driving motions, the motor 140 may be a direct connection type. That is, the motor may have a stator fixed to a rear surface of the tub 120 and a rotor that rotates the drum 120 directly. Since the rotation direction and torque of the direct connection type motor may be controlled, time delay or backlash may be prevented and then the drum driving motion may be controlled as appropriate.

In contrast, drum driving motions allowing time delay or backlash, for example, a tumbling motion or spin motion, may be embodied in an indirect connection type motor including a pulley such that its torque may be transmitted to a shaft via the pulley. However, the indirect connection type motor may have limited applicability.

The drum driving motion may be embodied by the control of the motor 140. As a result, the control method of the motor may be diversified and then the various drum driving motions may be achieved.

Movement patterns of the laundry and the drum driving motion to achieve the movement pattern of the laundry will be described in detail hereinafter.

A massaging movement pattern of the laundry may be achieved if the friction between the laundry and the drum is maximized. For example, when the drum is continuously rotated in a predetermined direction at a predetermined speed or less, the laundry may be rolling-moved to achieve the massaging effect. if the rotation speed of the drum driven in the tumbling motion is defined as a reference speed, the predetermined speed may be the reference speed. For example, a drum driving motion configured to rotate the drum at a predetermined speed or less in a predetermined direction may be defined as 'rolling motion'.

A disentangling movement pattern may be embodied by, for example, a tumbling motion. The tumbling motion may be defined as a motion configured to continuously rotate the drum at the reference speed in a predetermined direction. The disentangling movement pattern drops the laundry inside the drum, with a medium level dropping distance and a medium sized friction.

A striking movement pattern may be achieved by dropping the laundry inside the drum from a maximum dropping distance. For example, if the drum is rotated at the reference speed or more to lift the laundry to the highest point inside the drum, and then the drum is suddenly braked, such a striking effect may be achieved. This drum driving motion may be defined as 'step motion'.

A swing movement pattern may be achieved when the drum is rotated at a predetermined speed lower than the reference speed in the clockwise/counter-clockwise direction. Such a drum driving motion may be defined as 'swing motion'.

A rubbing movement pattern may be achieved when the friction between the laundry and the drum is increased. For example, if the drum rotating at the reference speed or more in the clockwise direction is suddenly braked and then rotated in the counter-clockwise direction, the laundry is rolling-moved along the inner circumferential surface of the drum from a predetermined high point of the drum. Such a drum driving motion may be defined as 'scrub motion'.

A squeezing and filtrating movement pattern may be achieved if wash water is supplied while rotating the drum at the reference speed or more. Once the drum is rotated at a relatively high speed, the laundry may unfold, or spread out and cling along the inner circumferential surface of the drum and then the wash water sprayed into the drum passes through the laundry and then the laundry may be squeezed to improve the rinsing effect. Such a drum driving motion may be defined as 'filtration motion'

Various drum driving motions configured to achieve the above various movement patterns of the laundry will be described in reference to the drawings.

Figure 3:
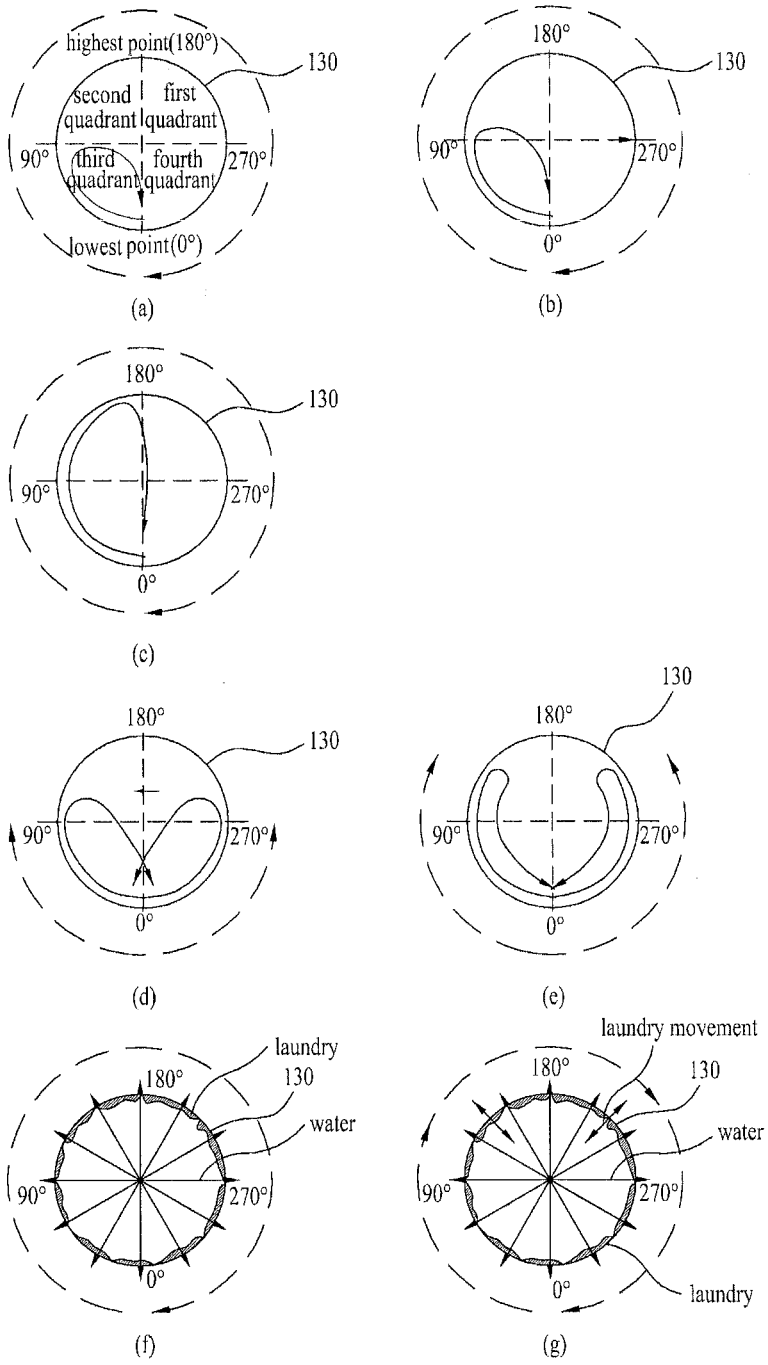
FIGS. 3A-3G, 4A-D, 5A-5F and 6 illustrate various drum motions and laundry movement patterns as embodied and broadly described herein.

FIG. 3 is a diagram of various drum driving motions as embodied and broadly described herein.

FIG. 3 (*a*) is a diagram of a rolling motion. In the rolling motion, the motor 140 continuously rotates the drum 130 in a predetermined direction and the laundry located on the inner circumferential surface of the drum rotating along the rotation direction of the drum is dropped from the position at an angle of approximately less than 90° with respect to the rotation drum of the drum to the lowest point of the drum.

That is, once the motor 140 rotates the drum at a speed that is lower than a reference rotational speed (tumbling rotational speed), for example, at approximately 40 RPM, the laundry located in the lowest point of the drum 130 is lifted to a predetermined height along the rotation direction of the drum 130 and then the laundry rolling-moves to the lowest point of the drum from the position of less than 90° with respect to the rotation direction of the drum from the lowest point of the drum. Visually, in case the drum is rotated in a clockwise direction, the laundry is continuously rolling in a third quadrant of the drum.

The laundry is washed by the maximum friction with the washing water and the maximum friction with other washing items and the maximum friction with the inner circumferential surface of the drum in the rolling motion. This rolling motion enables enough turn-over of the laundry to generate an effect of soft massaging-like washing. The drum RPM of the drum driving motion may determined based on a relationship to a radius of the drum. That is, the larger the drum RPM is, the larger the centrifugal force is that is generated in the laundry inside the drum. A difference between the size of the centrifugal force and the force of gravity applied to the laundry items in the drum differentiates the point at which the laundry is dropped and the corresponding motion of the laundry inside the drum. Both the rotation force of the drum and the friction between the drum and the laundry may also be considered. Thus, the RPM of the drum in the rolling motion may be determined so as to allow the generated centrifugal force and the friction force to be smaller than gravity (1 G).

FIG. 3 (*b*) is a diagram of a tumbling motion. In the tumbling motion, the motor 140 continuously rotates the drum 130 in a predetermined direction and the laundry located on the inner circumferential surface of the drum is dropped from the position of approximately 90° to 110° with respect to the rotation direction of the drum to the lowest point of the drum. If the drum is controlled to be rotated at a proper RPM in a predetermined direction, the mechanical force may be generated between the laundry and the drum in the tumbling motion. Because of that, the tumbling motion may be used in washing and rinsing.

That is, the laundry loaded into the drum 130 is located at the lowest point of the drum 130 before the motor 140 is driven. When the motor 140 provides a torque to the drum 130, the drum 130 is rotated and the lifter 135 provided at the inner circumferential surface of the drum lifts the laundry to a predetermined height from the lowest point of the drum. If the motor 140 rotates the drum 130 at the reference rotational speed, for example, approximately at 46 RPM, the laundry may be lifted to the position of approximately 90° to 110° with respect to the rotation direction of the drum and then dropped to the lowest point of the drum. In the tumbling motion, the drum RPM may be determined so as to allow the generated centrifugal force to be larger than the centrifugal force generated in the rolling motion and to be smaller than gravity.

Visually, if the drum is rotated in the clockwise direction in the tumbling motion, the laundry is sequentially lifted to the third quadrant and a part of a second quadrant from the lowest point of the drum. After that, the laundry is dropped to the lowest point of the drum. As a result, the tumbling motion enables the laundry to be washed by the shock generated by the friction with the washing water and the dropping shock. Because of that, in the tumbling motion, a mechanical force larger than the mechanical force of the rolling motion may be used to implement washing and rinsing. Also, the rolling motion may be effective in separating entangled-laundry and distributing the laundry uniformly.

FIG. 3 (*c*) is a diagram of a step motion. In the step motion, the motor 140 rotates the drum 130 in a predetermined direction and the laundry located at the inner circumferential surface of the drum is controlled to be dropped to the lowest point of the drum from the highest point (approximately 180°) with respect to the rotation direction of the drum. Once the motor 140 rotates the drum 130 at a speed that is higher than the reference rotational speed (tumbling rotational speed), for example, at approximately 60 RPM or more, the laundry may be rotated by the centrifugal force until reaching the highest point of the drum, without being dropped. In the step motion, the drum is rotated at a predetermined speed so as to not drop the laundry, and then is suddenly braked to maximize the shock applied to the laundry as it is dropped.

After rotating the drum 130 at the predetermined speed capable of not dropping the laundry (approximately 60 RPM or more) until the laundry reaches near the highest point of the drum, the motor 140 supplies a reverse torque to the drum 130 with the laundry located near the highest point of the drum (180° with respect to the rotation direction of the drum). Thus, the laundry is lifted from the lowest point of the drum 130 along the rotation direction of the drum, the drum is stopped momentarily by the reverse torque of the motor, and the laundry is dropped from the highest point to the lowest point of the drum 130. The step motion enables the laundry to be washed by the shock generated while the laundry is dropped with the maximum height difference. A mechanical force generated in this step motion is larger than the mechanical force generated in the rolling motion or tumbling motion mentioned above.

Visually, in the step motion, after moving from the lowest to the highest point of the drum via as the drum is rotated, the dropping distance inside the drum is the largest in the step motion, and the mechanical force of the step motion may be applied to a small amount of the laundry effectively. The motor 140 may be reversing-phase-braked in the step motion using a torque generated in a reverse direction with respect to a rotation direction of the motor. A phase of a current supplied to the motor may be reversed to generate a reverse torque in a reverse rotation direction of the motor and the reversing-phase brake enables the sudden brake to be applied. The reversing-phase brake may be used to apply the strong shock to the laundry.

Thus, after applying torque to rotate the drum in the clockwise direction, torque is applied to rotate the drum in the counter-clockwise direction and the drum is braked suddenly. After that, a torque is applied to the drum to rotate in the clockwise direction and the step motion is embodied. The step motion may be used to wash the laundry using the friction between the water drawn via the through hole 131 formed in the drum and the laundry and using the shock generated by the laundry dropping when the laundry reaches the highest point of the drum. This step motion may generate an effect of 'striking laundry'-like washing.

FIG. 3 (*d*) is a diagram of a swing motion. In the swing motion, the motor 140 rotates the drum 130 in clockwise and counter-clockwise directions alternatively and the laundry is dropped at a position of approximately less than 90° with respect to the rotation direction of the drum. That is, once the motor 140 rotates the drum 130 at a speed that is lower than the reference rotational speed (tumbling rotational speed), for example, at approximately 40 RPM in the counter-clockwise direction, the laundry located at the lowest point of the drum 130 is lifted a predetermined height along the counter-clockwise direction. Before the laundry reaches the approximately 90° position with respect to the counter-clockwise direction of the drum, the motor stops the rotation of the drum and the laundry is dropped to the lowest point of the drum from the approximately less than 90° position with respect to the counter-clockwise direction of the drum.

Hence, the motor 140 rotates the drum 130 at a speed that is lower than the reference rotational speed (tumbling rotational speed), for example, at approximately 40 RPM in the clockwise direction to lift the laundry a predetermined height in the clockwise direction along the rotation direction of the drum. Before the laundry reaches the position of approximately 90° with respect to the counter-clockwise direction of the drum, the motor stops the rotation of the drum and the laundry is dropped to the lowest point of the drum from the less than 90° position with respect to the clockwise direction of the drum.

Thus, the swing motion is a motion in which the rotation and stop with respect to a first direction and the rotation and stop with respect to a second (opposite) direction may be repeated. Visually, the laundry that is lifted to a part of the second quadrant from the third quadrant of the drum is dropped softly, and is re-lifted to a part of the first quadrant from a fourth quadrant of the drum and dropped softly, repeatedly.

In certain embodiments, the motor 140 may use rheostatic braking and a load applied to the motor 140 so that a mechanical abrasion of the motor 140 may be reduced, and the shock applied to the laundry may be adjusted. Using rheostatic braking, if a current applied to a motor is off, the motor functions as generator because of rotational inertia, and a direction of the current flowing in a coil of the motor will be changed into a reverse direction before the power is off and a force (Fleming's right hand rule) is applied along a direction which interferes with the rotation of the motor, to brake the motor. Different from reversing-phase braking, rheostatic braking does not generate sudden braking but instead changes the rotation direction of the drum softly. As a result, the laundry may be moved in a figure-8 shape over the third and fourth quadrants of the drum in the swing motion. The swing motion may generate 'swing the laundry'-like washing.

FIG. 3 (*e*) is a diagram of a scrub motion. In the scrub motion, the motor 140 rotates the drum 130 in both the clockwise and counter-clockwise directions alternatively and the laundry may be dropped from the position more than 90° with respect to the rotation direction of the drum.

That is, once the motor 140 rotates the drum 130 at a speed that is higher than the reference rotational speed (tumbling rotational speed), for example, at approximately 60 RPM or more in the counter-clockwise direction, the laundry located in the lowest point of the drum 130 is lifted a predetermined height in the counter-clockwise direction. After the laundry passes an approximately 90° position with respect to the counter-clockwise direction of the drum, the motor provides the drum a reverse torque to stop the drum temporarily, and the laundry located on the inner circumferential surface of the drum may be dropped rapidly, resulting particular, the laundry located on the inner circumferential surface of the drum is dropped to the lowest point of the drum from the position of 90° or more with respect to the clockwise direction of the drum. Thus, the laundry may be dropped rapidly from the predetermined height, in the scrub motion. The motor 140 may use reversing-phase-braking to brake the drum.

In the scrub motion, the rotation direction of the drum is changed rapidly and the laundry may not be away from the inner circumferential surface of the drum for a great amount of time. Because of that, an effect of strong-scrubbing-like washing by maximized friction between the laundry and the drum may be achieved in the scrub motion. In the scrub motion the laundry moved to a part of the second quadrant via the third quadrant is dropped rapidly and is re-dropped after being moved again to a part of the first quadrant via the fourth quadrant. As a result, visually in the scrub motion, the lifted laundry is dropped along the inner circumferential surface of the drum repeatedly.

FIG. 3 (*f*) is a diagram of the filtration motion. In the filtration motion, the motor 140 rotates the drum 130 so that the laundry is not dropped from the inner circumferential surface of the drum, and washing water is sprayed into the drum. That is, in the filtration motion, the laundry is spread along and maintains close contact with the inner circumferential surface of the drum as washing water is sprayed into the drum. The water is discharged out of the tub through the through holes 131 of the drum by the centrifugal force. Since the filtration motion spreads out/widens a surface area of the laundry and enables the water to pass through the laundry, the wash water may be supplied to the laundry uniformly.

FIG. 3 (*g*) is a diagram of the squeeze motion. In the squeeze motion, the motor 140 rotates the drum 130 so that the laundry clings to/is not dropped from the inner circumferential surface of the drum using centrifugal force, and then the motor lowers the rotation speed of the drum 130 to temporarily separate the laundry from the inner circumferential surface of the drum. This process is repeated and the water is sprayed into the drum during the rotation of the drum. That is, the drum is continuously rotated at a speed that is high enough not to drop the laundry from the inner circumferential surface of the drum in the filtration motion. In contrast, in the squeeze motion, the rotation speed of the drum is changed to repeat the process of the laundry clinging to and separating from the inner circumferential surface of the drum 130.

Spraying wash water into the drum 130 in the filtration motion and the squeeze motion may be implemented by, for example, a circulation path and a pump. The pump may communicate with the lower surface of the tub 120, with an end of the circulation path connected with the pump such that wash water is sprayed from the tub into the drum via the other end of the circulation path.

In alternative embodiments, wash water may be sprayed into the drum via a supply path connected with an external water supply source located outside of the cabinet. That is, one end of the supply path is connected with the external supply source and the other end thereof is connected with the tub. If a nozzle is provided to spray wash water into the drum, the wash water may be sprayed into the drum in either one or both of the filtration and squeeze motions.

Figure 4:
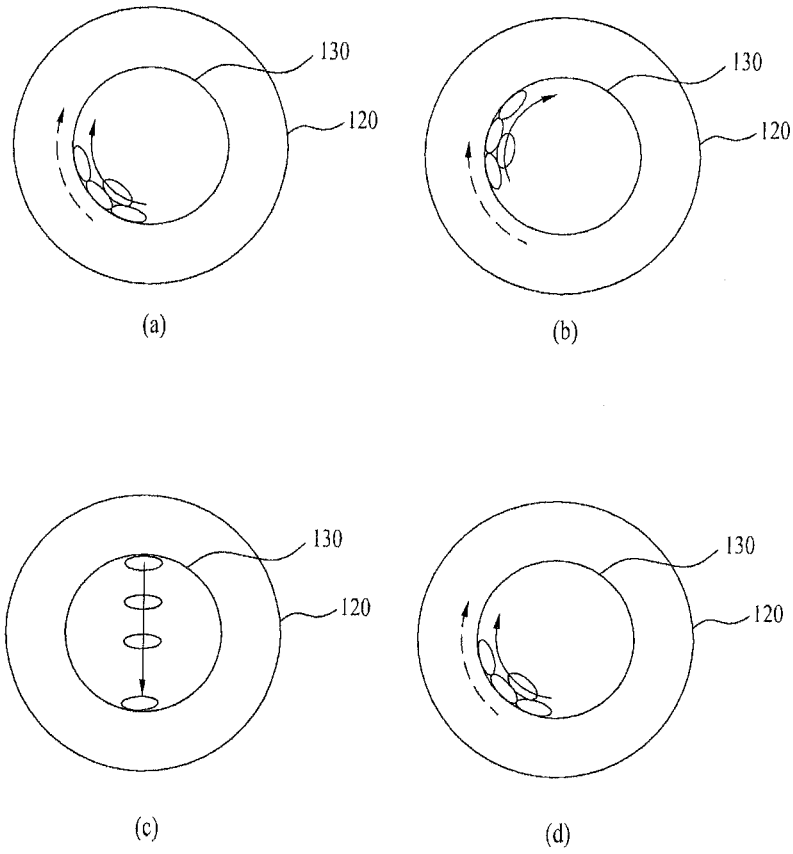

FIG. 4 is a diagram of the step motion in more detail.

First of all, the laundry is moved from a lowest point to a highest point of the drum 130 as shown in FIG. 4 (*a*)-(*c*). As described with respect to the tub 120 standing still adjacent to the drum 130, the laundry received in the drum 130 is moved from a position adjacent to the lowest point of the tub 120 to the highest point of the tub 120. For such the movement of the laundry, the motor 140 applies a rotation force, namely, a torque to the drum in a predetermined direction, which is a clockwise direction as shown in the drawings, and the drum 130 is rotated along the predetermined direction together with the laundry, to lift the laundry.

The laundry may be rotated together with the drum, in close contact with an inner surface of the drum 130 by a friction force with lifters and the inner circumferential surface of the drum 130. The laundry is lifted to the highest point of the drum 130, without being separated from the drum 130 by rotating the drum 130 at approximately 60 RPM or more, as this rotation speed generates a predetermined centrifugal force sufficient to prevent the laundry from separating from the drum 130 up to the highest point of the drum 130.

The rotation speed of the drum may be changed so that the centrifugal force generated is larger than gravity, allowing the laundry to be rotated together with the drum from the lowest point of the drum 130, which is a predetermined point of the inner surface of the drum adjacent to the lowest point of the tub 120 to the highest point of the tub 120. The laundry is dropped from the highest point of the drum 130 to the lowest point of the drum 130 when the drum 130 is suddenly braked, either at or just before the laundry reaches the highest point of the drum 130.

Specifically, to brake the drum 130 suddenly, the motor 140 provides the drum 130 with a reverse-torque. The reverse-torque is generated by reversing-phase braking configured to supply reversing-phase currents to the motor 140, as described in reference to FIG. 3 (*c*). The reversing-phase braking is a type of motor braking using a torque generated in a reverse direction with respect to a rotation direction of the motor. A phase of a current supplied to the motor may be reversed to generate a reverse torque in a reverse rotation direction of the motor and the reversing-phase braking enables the sudden brake to be applied to the motor. For example, as shown in the drawing, a current is applied to the motor to rotate the drum in the clockwise direction and then a current is applied to the motor to rotate the drum in the counter-clockwise direction suddenly.

The timing point of the reversing-phase-braking with respect to the motor 140 may be closely related to the location of the laundry inside the drum 130. Because of that, a device used to determine or predict the location of the laundry may be provided and a sensing device such as, for example, a hall effect sensor configured to determine a rotation angle of a rotor, may be examples of such a device. The control part may determine the rotation angle of the drum by using the sensing device and control the motor 140 to reversing-phase-brake when or just before the drum has a rotation angle of 180°. As a result, the drum rotated in the clockwise direction is stopped quickly in response to the counter-clockwise direction torque. The centrifugal force applied to the laundry is removed and then the laundry is dropped to the lowest point.

Hence, as shown in FIG. 4 (*d*), the drum 130 is continuously rotated in the clockwise direction and the rotation/dropping of the laundry is repeated. Although FIG. 4 shows that the drum is rotated in the clockwise direction, the drum may be rotated in the counter-clockwise direction to implement the step motion. The step motion generates a relatively large load on the motor 140 and a net acting ratio of the step motion may be reduced.

The net acting ratio is a ratio of a motor driving time to a total value of the driving time and the stopping time of the motor 140. If the net acting ratio is '1', it means that the motor is driven without a stopping time. The step motion may be implemented at approximately 70% of the net acting ratio, considering the load of the motor. For example, the motor may be stopped for 3 seconds after driving for 10 seconds. Other ratios and driving/stopping times may also be appropriate.

Before the falling laundry reaches the lowest point of the drum, that is, while the laundry is dropped, the drum 130 starts its rotation to implement the next step motion. In this case, the drum 130 is rotated to a predetermined angle and after that the laundry reaches the lowest point of the drum 130. From this point, the laundry and the drum may be rotated together. Although the drum is rotated to 180° as it is set, the laundry cannot be rotated to 180°, that is, the highest point of the drum 130 and it cannot be dropped from the highest point to gain the desired washing ability.

Because of that, the drum 130 is controlled to be re-rotated as shown in FIG. 4 (*d*) after the laundry reaches the lowest point of the drum. That is, the drum remains at a stand still until the laundry reaches the lowest point of the drum. More specifically, at the moment when the laundry actually starts to be dropped, the stopping of the drum 130 is generated. From the dropped point in time until the point at which the laundry reaches the lowest point of the drum, the drum remains stopped and does not rotate. The stopped time may be larger than the time taken for the laundry to be dropped to the lowest point (point 1) from the highest point of the drum. As a result, the drum may remain stopped for, for example, 0.4 second, or in certain embodiments, 0.6 second, to ensure enough time in the stopping state. This allows the step motion to be implemented more precisely to generate the maximum shock and the desired washing ability may be achieved accordingly.

Figure 5:
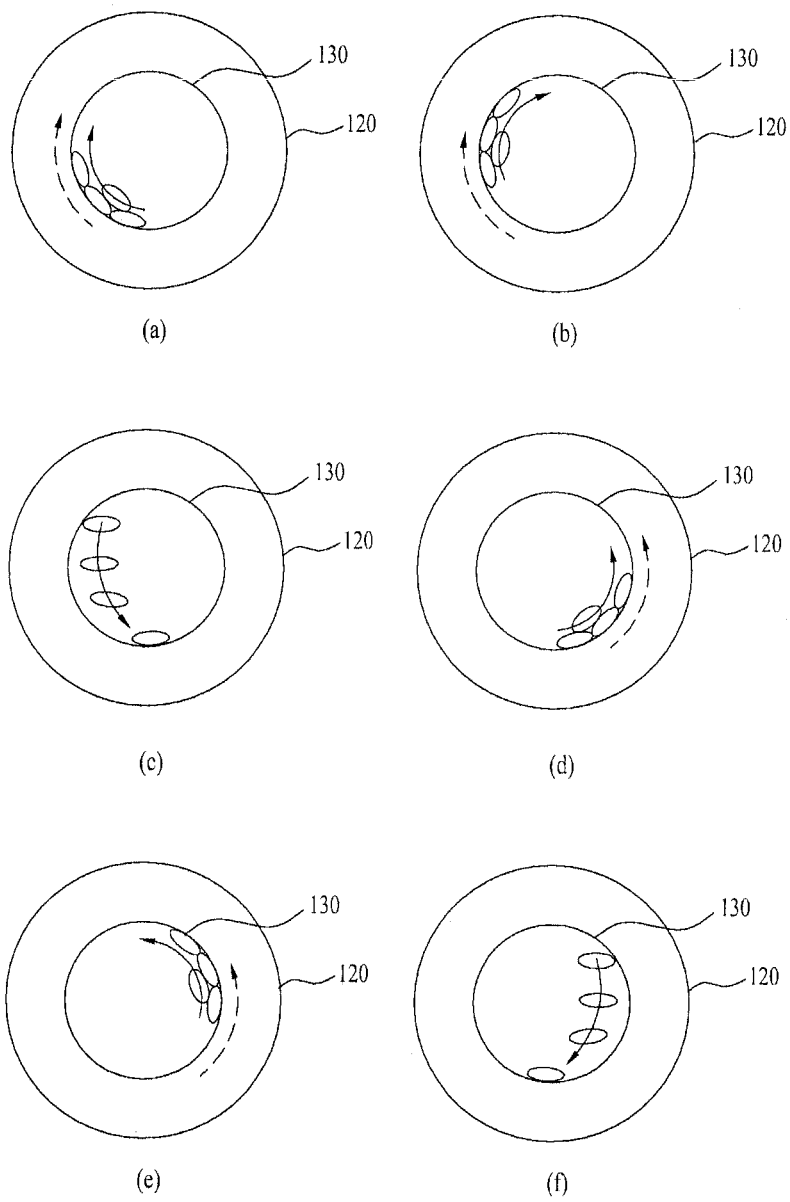

FIG. 5 is a diagram of the scrub motion in more detail.

First, the laundry is moved from the lowest point of the drum 130 to a position reached after 90° or more rotation in the clockwise direction of the drum 130, as shown in FIGS. 5 (*a*)-(*c*). As described with respect to the tub 120 standing still adjacent to the drum 130, the laundry inside the drum 130 is moved from the predetermined point of the inner drum surface adjacent to the lowest point of the tub 120 to the point of the inner drum surface rotated to 90° or more along the clockwise direction of the drum 120. To generate such movement of the laundry, the motor applies a rotation force, that is, a torque to the drum 130 in a predetermined direction, (clockwise direction) and then the drum 130 is rotated together with the laundry to lift the laundry.

The laundry is rotated together with the drum, in close contact with the inner circumferential surface of the drum 130 by the lifter and the friction with the inner circumferential surface of the drum, and is not separated from the drum 130. For that, the drum is rotated at approximately 60 RPM or higher to generate enough centrifugal force so that the laundry is not separated from the drum 130. The rotation speed of the drum may be set to generate a centrifugal force larger than gravity taking the size of the drum, such as an inner diameter, into consideration. As a result, the laundry is rotated together with the drum from the lowest point of the drum to the position of 90° or more rotation with respect to the lowest point of the drum.

The laundry is then dropped from the position of 90° or more rotation to the lowest point. For this dropping of the laundry, the drum 130 is suddenly braked when the laundry reaches the position of 90° or more drum rotation. The motor 140 provides the drum 130 with a reverse-torque to apply the sudden brake to the drum. As mentioned above in reference to FIG. 3 (*e*), the reverse-torque is a reverse-torque generated by reversing-phase braking configured to supply reversing-phase currents to the motor 140.

The control part may determine a rotation angle of the drum by using a sensing device as described above. Once the rotation angle of the drum is 90° or more, the control part may control the motor 140 to be reversing-phase-braked. As a result, the drum 130 rotating in the clockwise direction is provided with torque in the counter-clockwise direction to momentarily stop rotation and remove the centrifugal force applied to the laundry. As shown in FIG. 5 (*c*), the laundry may not be dropped perpendicularly by the torque of the counter-clockwise direction but dropped to the lowest point of the drum obliquely toward the inner circumferential surface of the drum. Because of the inclined dropping, the laundry may have a relatively large amount of friction with the inner surface of the drum in the middle of the dropping and the simultaneous friction between the laundry items and between the laundry and the wash water may be relatively large.

Hence, as shown in FIG. 5 (*d*), the drum 130 is rotated in the counter-clockwise direction continuously and the rotation/dropping of the laundry mentioned above may be repeated. FIG. 5 shows that drum is rotated in the clockwise direction earlier but the rotation of the counter-clockwise direction may be implemented earlier. The scrub motion generates a relatively large load applied to the motor 140, like the step motion, and the net acting ratio of the scrub motion may be reduced, for example, stopping of 3 seconds after the scrub motion may be repeated and the net acting ratio of the scrub motion may be controlled to be 70%. Other arrangements may also be appropriate.

Before the falling laundry reaches the lowest point of the drum, that is, while the laundry is dropped, the drum 130 starts its reverse direction rotation to implement the next step motion. In this case, the drum 130 is rotated to a predetermined angle and after that the laundry reaches the lowest point of the drum 130. From this point, the laundry and the drum may be rotated together. Although the drum is rotated to 90° as it is set, the laundry cannot be rotated to 90°, that is, the highest point of the drum 130 and it cannot be dropped from the highest point to gain the desired washing ability.

Because of that, the drum 130 is re-rotated as shown in FIG. 5 (*d*) after the laundry reaches the lowest point of the drum. That is, the drum is controlled to keep standing still until the laundry reaches the lowest point of the drum. More specifically, at the moment when the laundry actually starts to be dropped, the stopping of the drum 130 is generated. From point in time at which the laundry is dropped until the laundry reaches the lowest point of the drum, the drum remains in the stopped state and does not rotate. The time period of the drum stopping state may be larger than the time taken for the laundry to be dropped to the lowest point of the drum. As a result, the stopping state kept by the drum may be set to, for example, 0.2 second, which is smaller than the stopping state of the drum in the step motion.

As such the stopping state kept by the drum is set, the step motion may be implemented more precisely so as to generate the maximum friction between the drum inner surface and the laundry, maximum friction between laundry items, and maximum friction between the laundry and the wash water and the desired washing ability may be achieved accordingly.

Figure 6:
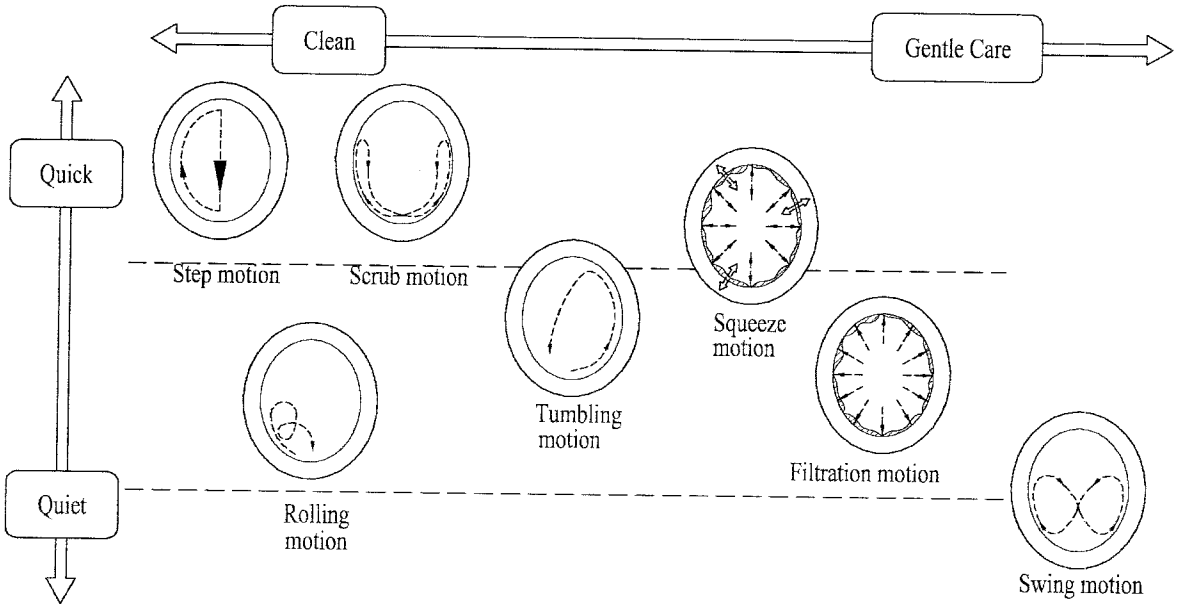

FIG. 6 is a graph comparing washing ability and vibration level of each motion shown in FIG. 3. A horizontal axis presents the washing ability, with easier separation of contaminants contained in the laundry moving to the left. A vertical axis presents the vibration or noise level, with higher levels moving upward, with the washing time for the same laundry being reduced.

The step motion and the scrub motion are proper to washing courses implemented to reduce the washing time when the laundry has severe contaminant. The step motion and the scrub motion have a high vibration/noise level and are typically not used to wash sensitive fabric and/or to minimize noise and vibration.

The rolling motion has a good washing ability and a low vibration level, with minimized laundry damage and low motor load. As a result, the rolling motion may be used in all of the washing courses, especially, to aid detergent dissolution in an initial washing stage and to wet the laundry.

The tumbling motion has a lower washing ability than the scrub motion and a middle vibration level in comparison to the scrub motion and the rolling motion. The rolling motion has a lower vibration level but it has a longer washing time than the tumbling motion. Because of that, the tumbling motion may be applicable to all of the washing courses and may be effective in a washing course to distribute the laundry uniformly.

The squeeze motion has a similar washing ability to the tumbling motion and a higher vibration level than the tumbling motion. The squeeze motion repeats the process of drawing the laundry toward and separating the laundry from the inner circumferential surface of the drum. In this process, the wash water is discharged outside of the drum after passing through the laundry. Thus, the squeeze motion may be applied to rinsing.

The filtration motion has a lower washing ability than the squeeze motion and a similar noise level to the rolling motion. In the filtration motion, the water passes through the laundry and is discharged out of the drum, with the laundry in close contact with the inner circumferential surface of the drum. As a result, the filtration motion may be applied to a course for wetting of the laundry.

The swing motion has the lowest vibration level and washing ability and may be applied in a low noise and low vibration washing course and a course for washing sensitive or delicate articles.

As mentioned above, each drum driving motion has its own advantages and it is preferable that those various drum driving motions are used to maximize the advantages. Each drum driving motion may also have advantages and disadvantages in relation to the laundry amount. Even in case of the same course and cycle, the various drum driving motions may be applied differently depending on the relation with the laundry amount.

An interior of the drum in the drum type washing machine may be visible from the exterior via the door. The various drum driving motions may be implemented in a washing course which will be described later. As a result, the user may view the various drum driving motions implemented in the interior of the drum. That is, a soft striking type of washing (tumbling motion), a strong striking type of washing (step motion), soft scrubbing type of washing (rolling motion) and a strong scrubbing type of washing (scrub motion) may be visibly identified. Because of that, the user may sense that washing is implemented well, which may generate improved user satisfaction in addition to the substantially improved washing efficiency.

III. Courses of a Laundry Machine

Various control methods, that is, various courses of a washing machine as embodied and broadly described herein, will now be discussed.

A. Course A (Standard Course)

Figure 7A:
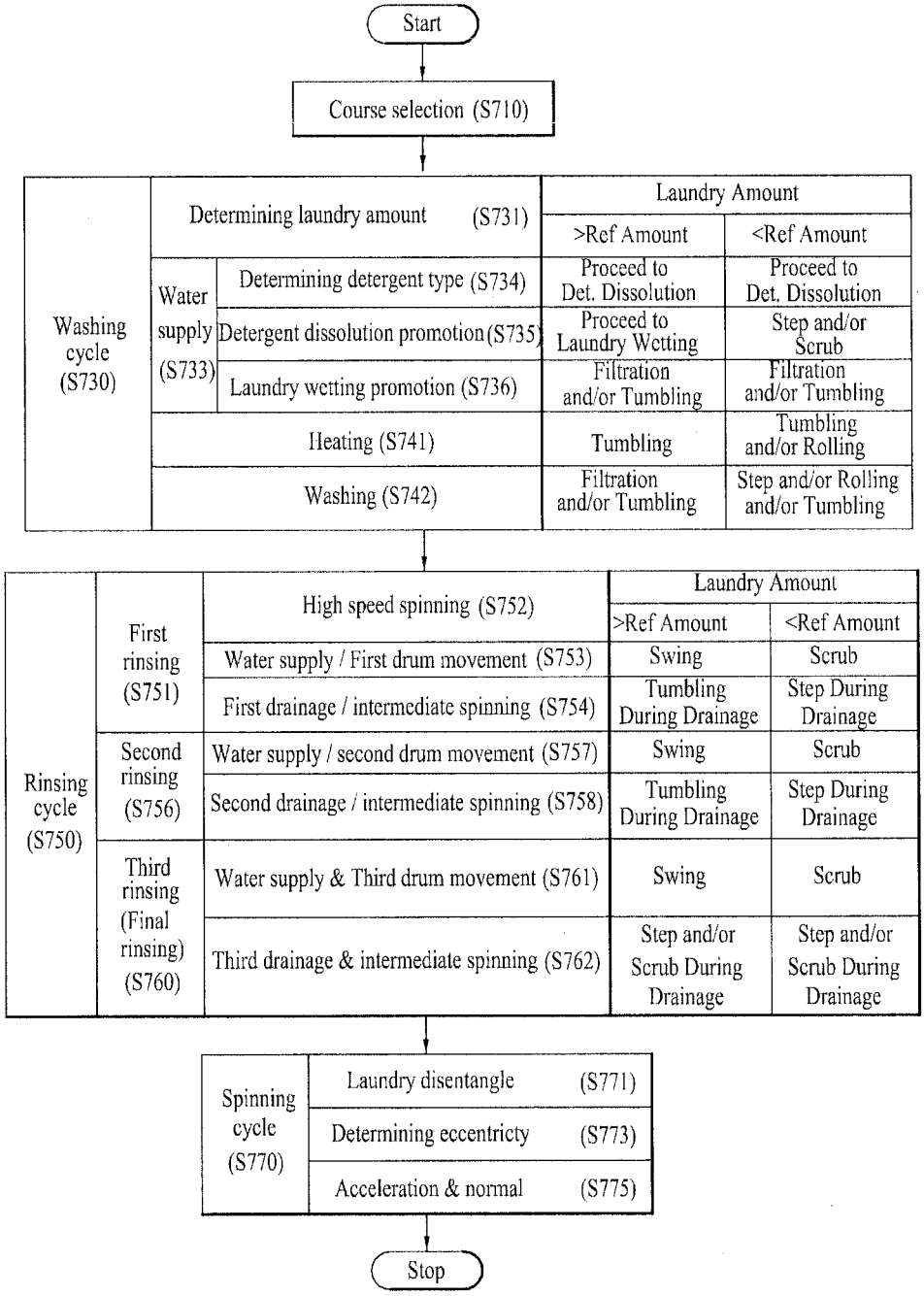
FIGS. 7-21 are flowcharts of various operation courses including the drum motions shown in FIGS. 3A-3G, 4A-D, 5A-5F and 6, in accordance with embodiments as broadly described herein.

Course A will be described in reference to FIG. 7A. Course A is a standard course which may be used to wash normal laundry without any auxiliary option. Course A includes a washing cycle, a rinsing cycle and a spinning cycle. The user may select the standard course from a course selecting part 117 (S710).

A.1 Washing Cycle (S730):

The washing cycle includes a water supplying step (S733) that supplies wash water and detergent to a tub 120 or a drum 130 to dissolve the detergent in the wash water, and a washing step (S742) configured to drive the drum to wash the laundry. In the water supplying step, water is supplied from an external water supply source to the washing machine, together with the detergent. By improving efficiency of the water supplying step in preparation for the washing step, efficiency of the washing cycle including washing efficiency and washing time reduction may also be achieved.

A.1.1 Determining Laundry Amount (S731):

As mentioned above, the water supplying step is done in preparation for the main-washing step. As a result, detergent dissolution, laundry wetting and the like may be implemented quickly and completely. However, considering the capacity of the drum and the amount of the wash water supplied to the drum, a drum driving motion may be controlled according to the amount of the laundry in the drum in the water supplying step. That is, a drum driving motion capable of performing the detergent dissolution and the laundry wetting more efficiently may be selected based on the amount of laundry in the drum.

A laundry amount determining step configured to determine the amount of the laundry accommodated in the drum may be implemented before the water supplying step. Based on the determined amount of laundry, the drum driving motion may be differentiated in the water supplying step.

A laundry amount may be determined by measuring electric currents used to drive the drum. For example, the currents used to implement a tumble motion may be measured. To implement the tumble motion, a control part controls the drum to be rotated at a predetermined RPM, for example, 46 RPM. A current value required to drive the drum at that RPM may be different, depending on the amount of laundry in the drum. Thus, the amount of laundry may be determined based on an amount of current required to drive a particular drum at a particular RPM in a particular motion.

If the laundry amount is relatively large, sufficient wash water may be supplied to the laundry at an initial stage of the water supplying step and washing efficiency of the washing may be further improved. The drum driving motion may be differentiated according to the laundry amount in the water supplying step and the parameters of the water supplying step may be determined appropriately.

A.1.2 Water Supplying (S733):

A.1.2.1 Detergent Type Determining (S734):

In the initial stage of the water supplying step, a detergent type determining step may be implemented to determine whether the detergent supplied during the initial stage of the water supplying step is a liquid type or powder type. This step is implemented to determine a drum driving motion or the number of rinsings in the rinsing cycle which will be implemented after the washing cycle. Information relating to the washing cycle and the rinsing cycle may be available to the user via a display part 119 in an initial operation of the washing machine. Because of that, the detergent type determining step may be implemented in the initial stage of the water supplying step, specifically, before a detergent dissolution promoting step.

A.1.2.2 Detergent Dissolution Promoting (S735):

As the wash water and the detergent are supplied in the water supplying step, the detergent dissolving step may be implemented. To improve the efficiency of the washing cycle, the detergent may be more completely and effectively dissolved in the initial stage of the water supplying step. As a result, the detergent dissolution promoting step may be implemented in the water supplying step to promote detergent dissolution.

A motion, namely, drum driving motion to move the laundry inside the drum to promote the detergent dissolution may be a motion configured to supply a strong mechanical force to the wash water and the laundry. For example, a step motion configured to repeatedly lift the laundry along the rotating drum and to drop the laundry from an inner circumferential surface of the drum according to a brake applied to the drum may be implemented in the detergent dissolution promoting step. Alternatively, a scrub motion configured to lift the laundry along the rotating drum and drop the laundry according to the brake and reverse-rotation of the drum to re-lift the laundry may be implemented instead of the step motion. The step motion and the scrub motion are motions configured to apply a sudden brake to the rotating drum to suddenly change the movement direction of the laundry and apply a strong shock to the laundry. In addition, the step motion and the scrub motion are configured to also apply the strong shock to the wash water. As a result, strong mechanical force is provided in the initial stage of the water supplying step to promote detergent dissolution and to improve the efficiency of the washing cycle accordingly.

In alternative embodiments, the detergent dissolution promoting step may be implemented by repeating the sequential combination of the step motion and the scrub motion. In this case, two types of drum driving motions are combined repeatedly and patterns of the wash water flow may be more diversified to improve the efficiency of the washing cycle.

In a typical water supplying step, the drum would be driven in the tumbling motion that continuously rotates the drum in a predetermined direction at a predetermined speed to lift and drop the laundry. However, it is found that the time taken to dissolve detergent in wash water in the tumbling motion may be greater than in either the step or scrub motions, or a combination thereof. For example, the time to dissolve detergent in the tumbling motion in an exemplary washer may be approximately 15 minutes, whereas the time taken to dissolve the detergent in the wash water in the step motion or scrub motion using the same washer may be 9 to 10 minutes. Thus, the step motion or scrub motion may dissolve the detergent in the wash water more quickly, and the corresponding time of the specific washing course to be reduced.

In the step and scrub motions, the laundry is dropped and the dropping shock is applied to the laundry, while the rotation and stopping of the drum may generate a strong vortex in the wash water.

Additionally, a circulating step configured to circulate the wash water held in the tub and to re-supply the wash water to the drum may be implemented in the detergent dissolution promoting step. In the circulating step, the wash water held below the drum is supplied to the inside of the drum, further promoting detergent dissolution and laundry wetting.

In certain embodiments, the detergent dissolution promoting step may be implemented for, for example, approximately 2 minutes, or other amount of time as appropriate, until the water supplying is completed. The water supplying may be completed in the detergent dissolution promoting step or water may be additionally supplied because a water level may be decreased in a following laundry wetting step. The detergent dissolution promoting step may be implemented for a relatively short time so as to not significantly impact laundry fabric damage. As a result, a drum driving motion in the detergent dissolution promoting step of each above course may be the scrub motion, depending on an amount of laundry in the drum.

That is, the detergent dissolution promoting step may be implemented if the determined laundry amount is a predetermined level or lower, as the drum driving motions configured to supply the strong mechanical force may be more effective with small amounts of laundry and because the small amounts of laundry may maintain sufficient contact with the wash water. Specifically, the small amount of laundry indicates that a surface area of the laundry which has to contact with the wash water is small and that the detergent dissolution and laundry wetting may be implemented by the mechanical force applied to turn over the laundry in a relatively short time. As a result, the step motion or the scrub motion enables the efficiency of the washing to be improved and the time of the washing time to be reduced accordingly.

In contrast, if the laundry amount determined in the laundry amount determining step is a predetermined level or higher, the detergent dissolution promoting step may be skipped. That is, if the amount of the laundry is relatively large, the mechanical force is not enough for the laundry to make sufficient contact with the wash water because wash water cannot be supplied to/absorbed by entangled laundry in a sufficient amount.

As a result, if the laundry amount is a predetermined level or higher, the detergent dissolution promoting step is omitted and the laundry wetting step starts immediately. If the laundry amount is the predetermined level or higher, the laundry may make better contact with the wash water to promote the detergent dissolution using the circulating step in the water supplying step.

A.1.2.3 Laundry Wetting (S736):

A step of sufficiently wetting the laundry with the wash water may be implemented in the water supplying step, together with the detergent dissolution. In the case of a drum type washing machine, the laundry is not necessarily fully submerged into the wash water, and thus laundry wetting may be implemented quickly in an initial stage of the washing cycle. After the detergent dissolution promoting step, a laundry-wetting promoting step may be implemented to promote laundry wetting. This step may be implemented after the water supplying step is implemented to a predetermined degree or until the water supplying step is completed to ensure that the laundry is sufficiently saturated. Alternatively, the detergent dissolution promoting step may be implemented after the water supplying is completed. The water level is decreased in the laundry wetting step and additional water supply may be implemented.

The laundry wetting step may be partially implemented in the detergent dissolution promoting step mentioned above and a water level may be increased enough to allow wash water to be collected inside the drum. Because of that, the step of promoting the laundry wetting may be implemented after the detergent dissolution promoting step. A drum driving motion of the laundry wetting promoting step may be controlled differently in comparison to that of the detergent dissolution promoting step. For example, the drum driving motion of the laundry wetting promoting step may include a rolling motion and/or a filtration motion. In certain embodiments, the filtration motion and the rolling motion may be implemented sequentially.

The filtration motion is a motion in which the laundry is broadly distributed to broaden the surface area of the laundry, and thus the filtration motion may be used to wet the laundry uniformly. The rolling motion is a motion in which the laundry is repeatedly turned over to make the wash water held under the drum contact the laundry uniformly, and the rolling motion may also be applied in laundry wetting. To utilize these effects as much as possible, different drum driving motions, that is, repeated/sequential implementation of the filtration and rolling motions in a predetermined order may maximize effect of the laundry wetting promoting step.

If the laundry amount is a predetermined level or higher, the drum driving motion of the laundry wetting promoting step may include the filtration motion. That is, in the filtration motion, the surface area of the laundry is broadened and the wash water is supplied in the filtration motion, and the laundry is distributed uniformly without being entangled and the wash water is supplied the laundry uniformly. Alternatively, or in addition to the filtration motion, the tumbling motion may also be implemented.

If the laundry amount is lower than the predetermined level, a filtration and/or tumbling motion may be employed during the laundry wetting promotion step.

The user may select a contamination level of the laundry from the option selecting part 118 and a net acting ratio of the motor may be differentiated according to this selection. However, the net acting ratio in the water supplying step may not be differentiated according to the selected contamination level, because the net acting ratio in the water supplying step is preset to optimize detergent dissolution and laundry wetting, and because concern of unnecessary damage to the laundry cannot be ignored. If the net acting ratio is decreased, the detergent dissolution and the laundry wetting cannot be sufficiently implemented.

The water supplying step in the standard course may include the detergent type determining step, the detergent dissolution promoting step and the laundry wetting promoting step described above. In alternative embodiments, the detergent type determining step, the detergent dissolution promoting step or the laundry wetting step may be provided independent from the water supplying step. In this case, the detergent determining step, the detergent dissolution promoting step or the laundry wetting step may be implemented after the water supply is completed.

A.1.3 Heating (S740):

The washing cycle includes the washing step. To prepare for washing, a heating step may be implemented between the washing and the water supplying steps.

The heating step may be configured to heat the wash water by using the heater provided under the tub or to increase the temperature of the wash water or the drum by using steam supplied to the inside of the drum. Because of that, the heating step may be implemented or omitted as necessary. That is, if using cold air or water to treat the laundry, the heating step may not be implemented. However, if the temperature of the wash water is preset to be higher than the temperature of the cold water because of a default temperature associated with a selected course, or if the temperature of the wash water is selected to be higher than the temperature of the cold water from the option selecting part 118, the heating step may be implemented.

The drum driving motion in the heating step may be differentiated according to the amount of the laundry. A tumble motion may be implemented in the heating step regardless of the laundry amount. However, as mentioned above, if the laundry amount is the predetermined level or lower, the rolling motion may be implemented in the heating step. That is, in case the laundry is relatively small, the repeated turn-over of the laundry in the lower portion of the drum may be more effective in heating and washing than the distribution of the laundry. Alternatively, with a small amount of laundry in the heating step, a combination of the tumbling and rolling motions may be used, and with a large amount of laundry, the tumble motion may be used.

The heating step may include a heating preparing step configured to prepare for heating after the water supplying step. This means that the water supplying step is completed after completion of the laundry wetting. As a result, it is possible to determine the amount of laundry more precisely after the water supplying step, because wet laundry items cannot be distinguished from dry laundry items based on the laundry amount before the laundry wetting. For example, the amount of wet laundry items may be determined larger than the actual amount, before the laundry wetting. As a result, in certain embodiments, a more precise laundry amount determining step may be implemented in the heating step, before the washing. If the heating step is omitted, a step corresponding to the heating preparing step may be implemented to determine the precise amount of the laundry. That is, if the heating step is omitted, the precise laundry amount determining step may be implemented before the washing step after the water supplying step is complemented.

A.1.4 Washing (S742):

Once the water supplying step and the heating step described above are completed, the washing step configured to wash the laundry may be implemented. A drum driving motion in the washing step may be a sequential combination of step and/or tumble and/or rolling motions to apply a strong mechanical force and move the laundry in diverse patterns to improve washing efficiency.

Alternatively, the drum driving motion in the washing step may be a sequential combination of the filtration motion and the tumble motion to continuously supply wash water to the laundry to improve washing efficiency generated by the detergent as well as washing efficiency generated by the mechanical force applied to the laundry.

As a result, the drum driving motion in the washing step may be differentiated according to the laundry amount because the drum driving motion capable of generating an optimal washing effect may be different depending on the laundry amount. The laundry amount may be the laundry amount determined before the water supplying step or in the heating step. In the washing step, the drum driving motion may be differentiated according to the laundry amount determined after the water supplying step.

If the laundry amount is a predetermined level or higher, the drum driving motion may include the filtration motion and/or the tumble motion. If the washing machine is not equipped to circulate the wash water, only the tumble motion may be implemented. In the case of a large amount of laundry, wash water may be supplied to the laundry uniformly and the mechanical force may be applied to the laundry simultaneously to improve washing efficiency.

If the laundry amount is a predetermined level or lower, the drum driving motion may include a step motion and/or a rolling motion to improve the washing efficiency as the laundry is moved in various patterns with the mechanical force applied to the laundry. In certain embodiments, the tumbling motion may also be implemented with the step motion and/or the rolling motion.

As mentioned above, in the standard course, the drum driving motion in the water supplying step, the heating step and the washing step may be diversified and efficiency of the washing cycle may be improved accordingly. In addition, the drum driving motion in each of the steps may be differentiated according to the amount of laundry in the drum and the optimized washing cycle may be implemented accordingly.

If the user selects a contamination level of the laundry from the option selecting part 118, the net acting ratio of the heating step and the washing step may be differentiated. If the net acting ratio is unnecessarily high in a case in which the contamination level is relatively low, the laundry would be unnecessarily damaged.

A.2 Rinsing Cycle (S750):

A control method of a rinsing cycle in Course A will be described in reference to FIG. 7A. According to this embodiment, the rinsing cycle may be implemented as a part of a single course, together with the washing cycle described above, or it may be implemented independently. Simply for ease of discussion, a control method of the rinsing cycle implemented after the washing cycle mentioned in the standard course will be described hereinafter.

A.2.1. First Rinsing (S751):

Once the washing cycle is completed, a first rinsing step configured to supply water and to drive the drum to implement rinsing may be performed.

One or more spinning steps may be implemented in the standard course in each of the washing cycle, the rinsing cycle and the spinning cycle. For example, spinning after the washing cycle and spinning in the rinsing cycle may be implemented. These spinning steps may be referred to as 'intermediate-spinning' to be distinguished from the spinning cycle which is the last cycle of the standard course.

A spinning level may be determined based on RPM of the drum. Typically, intermediate-spinning may be implemented at approximately 200 to 400 RPM, and, for example, at approximately 400 RPM in a Sensitive Course, approximately 600 RPM in a Weak Course, approximately 800 RPM in a Middle Course, and approximately 1000 RPM in a Strong Course. A drum RPM for intermediate-spinning may be selected based on a low resonance frequency and a high resonance frequency during operation depending on the current operation parameters.

The resonance frequency is an eigen physical value of the washing machine and the vibration of the washing machine is drastically increased near the resonance frequency. If the drum is rotated near the resonance frequency and the laundry not distributed uniformly, the vibration of the washing machine will be increased very suddenly. As a result, if spinning is implemented at a predetermined RPM higher than the resonance frequency, a laundry disentangling step would typically be implemented to distribute the laundry uniformly inside the drum and the vibration is sensed. If the sensed vibration is less than a predetermined value, an accelerating step may be implemented to be out of a resonance frequency band.

As water supplying and rinsing are repeated more times in the rinsing cycle, the time required by the intermediate-spinning implemented in the middle of the rinsings would be longer. To address concerns of residual detergent remaining after washing is completed, the rinsing steps may be implemented at least three times or more in the rinsing cycle. Intermediate-spinning implemented at this time may add a significant amount of time to the rinsing cycle, resulting in an excessively long rinsing cycle. According to this embodiment, the RPM in the intermediate-spinning implemented in the middle of the water supplying and the rinsing may be differentiated. That is, the drum may be rotated at a predetermined RPM lower than the low resonance frequency in a predetermined specific intermediate-spinning and at a predetermined RPM higher than the high resonance frequency in another predetermined specific intermediate-spinning.

When the specific intermediate-spinning is implemented at an RPM lower than the low resonance frequency, the time required by an auxiliary laundry disentangling step, vibration amount sensing step and accelerating step may be unnecessary, thus potentially reducing the time required by the rinsing cycle. The RPM of this intermediate-spinning may be set to be approximately 100 to 110. In contrast, if the specific intermediate-spinning is implemented at the RPM lower than the low resonance frequency, the time required by the rinsing cycle may be reduced, but wash water including detergent may not be completely discharged.

The most contaminants and detergent remnants may be found in the wash water after the washing cycle. Because of that, the wash water may be discharged from the laundry as thoroughly as possible after the washing cycle.

A high speed spinning (S752) may be implemented in an initial stage of the first rinsing step, after the washing cycle in the standard course. In the high speed spinning, the drum may be rotated at a higher RPM than the high resonance frequency such that a maximum amount of wash water may be discharged from the laundry. For example, the RPM may be set to be approximately 1000 RPM. The high speed spinning step may continuously rotate the drum at the high speed, that is, approximately 1000 RPM, regardless of the user's selection, so that detergent remnants may be discharged as thoroughly as possible before the rinsing.

Once the high speed spinning is completed, a first drum driving step (S753) may be implemented to drive the drum after water supplying to rinse the laundry. A rinsing water level may be a relatively high level allowing the water level to be visible through the door, so that the laundry submerged into the wash water. Thus, a significant amount of wash water may be supplied to rinse the laundry in an initial stage of the rinsing cycle.

A drum driving motion in the first drum driving step may be a scrub and/or swing motion, to move the maximum amount of laundry submerged into the wash water to improve rinsing performance. This scrub and swing motions correspond to a process of continuously hand-scrubbing the laundry under the wash water after submerging the laundry into the wash water. The tumbling and step motions correspond to a process of repeatedly moving the laundry into and out of the wash water. As a result, the first drum driving step may control the drum to be driven in the scrub and/or swing motion, with a high water level, allow the user to visually recognize that enough rinsing is implemented. In alternative embodiments, a circulating step configured to circulate the wash water held in the tub into the drum may be implemented in the first drum driving step. Wash water is sprayed into the drum to rinse the laundry. This process may be referred to as 'spray rinsing'. This also displays to a user, as it may be visible through the door, that enough rinsing is implemented.

Once the first drum driving step is completed, a first draining and intermediate-spinning step (S754) may be implemented. During water draining, the drum may be driven in the step and/or tumbling motion. The laundry is lifted and dropped to improve washing efficiency and bubbles are generated to improve rinsing efficiency. The drum driving motion may be differentiated according to the laundry amount. In the case of a small amount of laundry, the drum is driven in the step motion to generate the maximum distance between the lifting and the dropping. In the case of a large amount of laundry, the drum may be driven in the tumbling motion.

Intermediate-spinning may be implemented at approximately 100 to 110 RPM in the first draining and intermediate-spinning. Then, the laundry disentangling step, the vibration sensing step and the accelerating step may be omitted and the required time may be noticeably reduced.

In alternative embodiments, in the first draining and intermediate-spinning step in a standard course, the intermediate-spinning may be implemented at approximately 400 RPM higher than the low resonance frequency. In this case, the step and/or tumbling motion may be implemented when water is drained and the laundry is sufficiently distributed. Because of that, the laundry disentangling step may be omitted. Even at a rotation speed higher than the low resonance frequency, the intermediate-spinning may be implemented for a short time, with the vibration sensing step and the single accelerating step. Such intermediate-spinning may be implemented at a relatively high RPM to discharge detergent remnants and contaminants which fail to be discharged via the high speed spinning step. However, in a case in which the amount of vibration measured in the vibration sensing step is out of an allowable range, the vibration sensing step may be repeated so as to fail to enter into the accelerating step, and the rinsing time might be increased disadvantageously. Because of that, the vibration sensing step may be implemented at the drum speed of approximately 100 to 110 RPM and in case the accelerating step fails to start within a predetermined times of vibration step implementations, the first draining and intermediate-spinning step may finish.

A.2.2 Second Rinsing (S756) and Final Rinsing (S760):

A second rinsing step (S756) may follow the first rinsing step. The second rinsing step may include a second drum driving step (S757) and a second draining and intermediate-spinning step (S758). The second drum driving step may be essentially the same as the first drum driving step described above. Also, the second draining and intermediate-spinning step may be essentially the same as the first draining and intermediate-spinning step. However, intermediate-spinning is implemented at approximately 100 to 110 RPM in the second draining and intermediate-spinning step to reduce the rinsing time, because detergent remnants have already been discharged in the high speed spinning step and the first draining and intermediate-spinning step.

The rinsing cycle may make use of the result of the determination of the detergent type determining step.

If the detergent is a liquid type, relatively little detergent may remain and the second rinsing step may be omitted to reduce the time required by the rinsing cycle. If the detergent is a powder type, the first rinsing step and the second rinsing step may be performed by default.

If the detergent is a liquid type, a third rinsing step (S760) may serve as a final rinsing step after the first rinsing step. If the detergent is a powder type, a third rinsing step may serves as a final rinsing step after the second rinsing step. However, when bubbles are sensed in the third rinsing step (in the case of a powder type detergent), a fourth rinsing step as final rising step may be implemented.

A water level of the final rinsing step (S760) may be a relatively low level. In the case of a tilted drum type washing machine having a drum tilted at a predetermined angle, a water level may be a predetermined level sufficient to supply water only to a predetermined rear portion of the tilted drum. That is, the water level may be such that it is not sensed, or visible, outside the washing machine. However, such a water level is predetermined so as to not generate any more bubbles in the laundry. Even if bubbles are generated, the bubbles are generated in the tub, not in the drum, to prevent excess accumulation. As a result, the user may visually identify that no bubbles are generated in the final rinsing step and rinsing performance satisfaction may be improved.

A third draining step (S762) may be implemented after the third drum driving step (S761) in the final rinsing step, to implement the spinning cycle. The drum may be driven in the step and/or scrub motion to distribute the laundry uniformly in the third draining step.

A.3 Spinning Cycle (S770):

A control method of the spinning cycle in the standard course will be described in reference to FIG. 7A. The spinning cycle may be implemented as a part of the standard course, together with the washing cycle and the rinsing cycle, or independently as a single course. Simply for ease of discussion, a control method of the spinning cycle implemented after the washing cycle and the rising cycle composing the standard course will be described.

A.3.1 Laundry Disentangling (S771):

The spinning cycle may include a laundry disentangling step configured to disentangle the laundry by driving the drum to distribute the laundry uniformly. The spinning cycle is provided to minimize the vibration generated when the drum is rotated at a high speed. If the drum is driven in the step and/or scrub motion in the draining step right before the spinning cycle, the laundry is likely to be disentangled to a predetermined degree by the step and/or scrub motion and the time required by the laundry disentangling step may be significantly reduced.

A.3.2 Eccentricity Measuring (S773):

After the laundry disentangling step, the amount of eccentricity with rotating the drum at a predetermined RPM lower than the low resonance frequency for a predetermined time period, may be measured by accelerating the drum and determine whether the laundry is uniformly distributed inside the drum.

An eccentricity measuring step of a spinning cycle in a standard course according to another embodiment may be implemented before a laundry disentangling step. A significant amount of laundry disentangling may have been implemented by the drum driving motion of the rinsing cycle. As a result, the spinning cycle may start with the eccentricity measuring step to reduce the time of the spinning cycle. If the measured eccentricity compared with a reference eccentricity value is determined to be satisfactory, the accelerating, which will be described later, may be implemented. If the measured eccentricity is unsatisfactory compared with the reference eccentricity value, the laundry disentangling step may be implemented. The drum may driven in the step motion in the laundry disentangling step to promote the laundry disentangling and the eccentricity measuring step may re-start after the laundry disentangling step.

A.3.3 Accelerating and Normal Spinning (S775):

After the eccentricity measuring step, a step of accelerating the rotation of the drum to a normal-spinning RPM (accelerating step) may be implemented. After that, a normal-spinning step configured to rotate the drum at the normal-spinning RPM may be implemented to complete the spinning cycle. The drum rotation speed of the normal spinning may be defaulted to be approximately 1000 RPM. That is, the amount of the moisture contained in the laundry may be reduced as much as possible to minimize detergent remnants. The RPM of the normal-spinning may be changeable according to the user's selection, because RPM of the normal spinning is related to a residual moisture level and wrinkle level of the laundry after the spinning cycle is completed. As a result, the user may select and RPM of the normal spinning step, relating to a moisture level and a wrinkle-level of the laundry.

Figure 8:
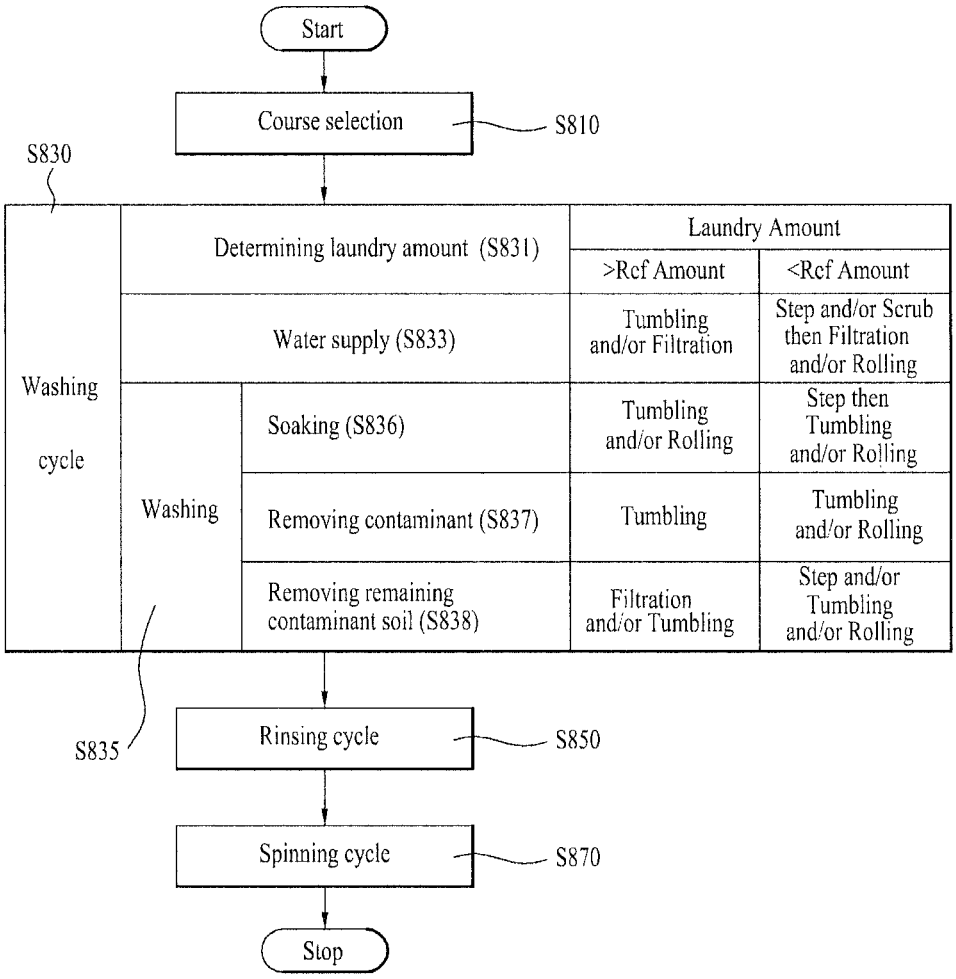

B. Course B (Heavy Contaminant Course):

A heavy contaminant course B in which heavy dirt is to be removed from laundry items will be described in reference to FIG. 8. The heavy contaminant course may be selected at the course selecting part 117 (S810).

B.1 Washing Cycle (S830):

B.1.1. Determining Laundry Amount (S831):

Once the heavy contaminant course is selected, a laundry amount determining step may be implemented to determine the amount of laundry loaded into the drum. The method of determining the laundry amount may be similar to that described above with respect to the standard course, and thus a repeated description thereof will be omitted accordingly. The laundry amount determining step could be implemented before the course selecting step.

The control part compares the laundry amount determined in the laundry amount determining step with a reference value and controls drum driving motions of a water supplying step and a washing step, which will be described later, based on the result of the comparison. Essentially, a determined laundry amount greater than a reference value may be considered a large load, and a determined laundry amount less than the reference value may be considered a small load. Drum driving motions of each step according to the determined laundry amount will be described.

B.1.2 Water Supplying (S833):

In a water supplying step, the control part controls the water supply device (e.g. the water supply path and water supply valve) connected with the water supply source and the tub to supply the wash water to the tub. If the laundry amount measured in the laundry amount determining step is smaller than a reference value, the control part may control the drum to be driven in the tumbling motion and/or the step motion and/or the scrub motion and/or the filtration motion and/or the rolling motion.

First, if the laundry loaded into the drum is entangled, the eccentric rotation of the drum would be generated, and the control part may control the drum to be driven in the tumbling motion in the water supplying step to disentangle the laundry. In the tumbling motion, the drum is rotated in a predetermined direction and the laundry is dropped to the lowest point of the drum from an approximately 90° or more position with respect to the rotation direction of the drum, such that the entangled laundry may be disentangled and distributed uniformly.

The control part controls the drum to be rotated in the step motion and/or the scrub motion so that a dropping shock is applied to the laundry loaded into the drum. The step motion and the scrub may be applied to remove insoluble contaminants smoothly. As a result, once the drum is driven in the step motion and/or the scrub motion, insoluble contaminants may be removed in the water supplying step, and reduced washing time and improved washing efficiency may be achieved.

The water supplying step supplies wash water to the tub and wets the laundry loaded into the drum, as mentioned above. Because of that, the control part may drive the drum in the filtration motion after the step motion and/or the scrub motion to perform laundry wetting.

In addition, the control part may drive the drum in the rolling motion to dissolve detergent in the wash water in the water supplying step, in addition to the rolling motion, to wet the laundry in the wash water, before the water supplying step is completed.

If the laundry amount is more than a reference value, the control part may control the drum to be driven in the tumbling motion and/or the filtration motion, in the water supplying step. If the laundry amount is relatively large, specifically, more than the reference value, the drum motion configured to apply a sudden brake to the drum such as the step motion and/or the scrub motion may apply too much load on the motor. By extension, the original effect of the step and/or scrub motion which is the application of the dropping shock cannot be achieved. Thus, the step and/or scrub motion are not implemented if a large amount of laundry is loaded in the drum. Also, if a large amount of laundry is loaded in the drum, the laundry wetting effect generated by the rolling motion having the relatively low rotation speed cannot be effectively achieved, and so instead the tumbling motion may be implemented for laundry wetting. Eventually, if the laundry amount is more than the reference value, the drum may be driven in the tumbling and/or the filtration motion such that the effects of the laundry distribution, the insoluble contaminant removal, the laundry wetting and the detergent dissolution mentioned above may be achieved.

B.1.3 Washing (S835):

After the water supplying step is completed, a washing step of the heavy contaminant course may start. The washing step of the heavy contaminant course may include a soaking step, contaminant removing step and a remaining-contaminant removing step. In this case, wash water having different temperatures may be supplied in each step and each step may be implemented accordingly.

B.1.3.1 Soaking (S836):

The soaking step is a process of soaking the laundry in cold water to loosen heavy contaminants contained in the laundry. Relatively cool water having a temperature of, for example, approximately 15° C. is used in the soaking step, to loosen protein components contained in the heavy contaminants attached to the laundry for a long time. If these protein components contact heated water, these heavy contaminants tend to be fixedly solidified in the laundry and it is difficult to separate them from the laundry. Because of that, the soaking step may be implemented using cold water, to prevent the heavy contaminants having the protein components from being fixed to the laundry.

If the laundry amount is less than a predetermined value, the motor may drive the drum in the step motion. The tumbling motion and/or the rolling motion may be added after the step motion. Since the step motion has excellent washing ability and reduced washing time, the heavy contaminants attached to the laundry may be soaked and a shock is applied to the laundry. As a result, the step motion has an effect of inducing separation of the heavy contaminants from the laundry.

If the laundry amount is more than the reference value, the drum may be driven in the tumbling motion and/or the rolling motion in the soaking step. That is, if the measured laundry amount is more than a predetermined reference value, the step motion may not be implemented due to the excessive load that would be applied to the motor. As noted above, the step motion applies a dropping shock to the laundry inside the drum and to improve washing efficiency. However, if the laundry amount is large the step motion may not be implemented. When the laundry amount is more than the reference value, the step motion is also not implemented in the contaminant removing and the remaining contaminant removing steps, which will be described later.

B.1.3.2 Contaminant Removing (S837):

After the soaking step, a contaminant removing step configured to heat wash water in a range of 35° C. to 40° C. to remove heavy contaminants may start. The temperature of the wash water used in the contaminant removing step is set be between 35° C. to 40° C. because sebum components contained in the heavy contaminants may be removed more easily at a temperature that is similar to a human body temperature. The heater provided in the bottom surface of the tub or the moisture supplying device configured to supply heated-moisture such as steam to the tub may be used to increase the temperature of the wash water up to within the predetermined range.

In the contaminant removing step, the control part may control the motor to drive the drum in the tumbling motion and/or the rolling motion if the laundry amount is the reference value or less. The tumbling motion and/or the rolling motion may apply low load on the motor and reduce the washing time, with high washing efficiency. Because of that, reduced washing time may be achieved.

If the laundry amount is more than the reference value, the control part may control the drum to be driven in the tumbling motion. In case of a large amount of laundry, the rolling motion configured to rotate the drum at the relatively low speed may not be effective in contaminant removal, and thus the tumbling motion may be applied.

B.1.3.3 Remaining-Contaminant Removing (S838):

The control part may implement a remaining-contaminant removing step configured to heat the wash water to have the temperature of approximately 60° C. and to sterilize and bleach the laundry, after the contaminant removing step. The temperature of the wash water may be approximately 60° C. or higher in the remaining-contaminant removing step to sterilize and bleach the laundry.

In the remaining-contaminant removing step, the control part may control the drum to be driven in the step motion or in the order of the step motion and/or tumbling motion and/or rolling motion, if the laundry amount is less than the reference value.

If the laundry amount is more than the reference value, the control part may control the drum to be driven in the filtration motion and/or the tumbling motion in the remaining-contaminant removing step.

B.2 Rinsing Cycle (S850):

The rinsing cycle of the heavy contaminant course may be similar to the rinsing cycle of the standard course described above and rinsing cycles of the other courses which will be described later. Thus, repeated description of the rinsing cycle will be omitted.

B.3. Spinning Cycle (S870):

The spinning cycle of the heavy contaminant course may be similar to the spinning cycle of the standard course described above and spinning cycles of the other courses which will be described later. Thus, repeated description of the spinning cycle will be omitted.

Figure 9:
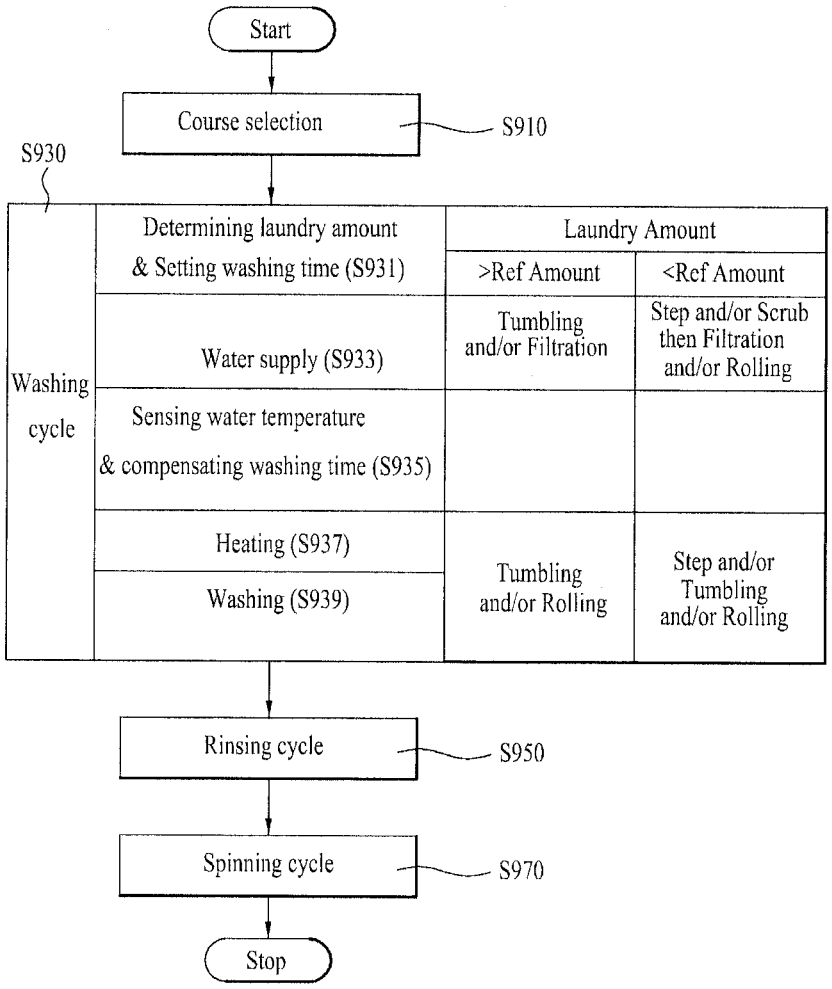

C. Course C (Quick Boiling Course):

Course C will be described in reference to FIG. 9. Course C may be referred to as 'quick boiling course' configured to heat the wash water to a predetermined temperature for a relatively short time to achieve an effect of laundry sanitary boiling, such as in a sanitization cycle.

Typically, when sterilizing and bleaching laundry, the wash water held in the tub is heated to a preset 'set temperature' and then washing is implemented. Since the washing time is relatively long and the electric power consumed quite a lot to heat the wash water only, it takes quite a long time and much electric power to heat the wash water held in the tub to the preset temperature. In the quick boiling course the laundry may be sterilized and bleached while also reducing the overall washing time and the power consumption. The quick boiling course heats the wash water supplied to the tub for a preset time period, regardless of the temperature of the wash water, instead of heating the wash water until the wash water reaches the preset temperature. To take the washing ability into consideration, a step of compensating the time of a washing step provided in the quick boiling course according to the temperature of the wash water may be included in this washing course, as will be described in reference to FIG. 9.

First, the user may select the quick boiling course from the course selecting part 117 (S910). Then, the control part implements a step of setting the time of the washing step of the quick boiling course. This washing time setting step allows the control part to determine the time required by the washing step of the quick boiling course, which is stored in a storage device, such as a memory. This step may be implemented simultaneously with the course selecting step or a water supplying step.

C.1 Washing Cycle (S930):

C.1.1 Determining Laundry Amount and Washing Time Setting (S931):

Once the user selects the quick boiling course, the control part may implement a laundry amount determining step configured to measure the amount of the laundry and a washing time setting step configured to set the time required by a washing step of the quick boiling course based on the determined laundry amount. The control part may use the time taken to rotate the drum to a predetermined position to determine the laundry amount, as described above, or the time of residual rotation after rotating the drum for a predetermined time.

In the washing time setting step, the control part may select a washing time corresponding to the measured laundry amount from proper times stored in the memory. The variety of the time required by the washing step of the quick boiling course is stored in the storage device, such as memory, so that, when the quick boiling course is selected, a proper time stored in the memory may be selected by the control part.

C.1.2 Water Supplying (S933):

The washing cycle of the quick boiling course may include a water supplying step configured to supply wash water to the tub. In the water supplying step, the control part controls the water supplying device (e.g. water supplying path and water supplying valve) connected with the water supply source and the tub to supply water to the tub. Also, the control part controls the drum to be driven in a similar drum driving motion to the drum driving motion of the water supplying step of, for example, the heavy contaminant course described above, and thus further detailed description will be omitted.

C.1.3 Water Temperature Measuring Step/Compensating (S935):

Once the water is supplied to the tub, the control part measures the temperature of the wash water using temperature a temperature sensor provided in the washing machine and compares the measured temperature with a reference temperature to adjust the time of the washing step.

For example, the control part may compare the measured temperature of the wash water to a reference temperature, for example, higher than approximately 50° C. If the measured temperature is higher than the reference temperature, for example, if heated-water is supplied to the tub, the control part may implement the washing step right away. However, if the measured temperature is lower than the reference temperature, the control part may implement a compensating step configured to adjust the time of the washing step.

As mentioned above, the washing step may be implemented after heating the wash water for the predetermined time period in this course, regardless of the water temperature. Because of that, the temperature of the wash water held in the tub may be different, depending on the temperature of the water supplied to the tub after a heating step is completed, and there would be difference in washing ability due to the difference in water temperature. As a result, the compensating step is provided to minimize the difference in the washing ability caused by the wash water having different temperatures after the heating step. If the temperature of the wash water is lower than the reference temperature, the time of the washing step is increased to compensate for the washing ability at the lower temperature.

The number of reference temperatures used to define a temperature range may be adjustable appropriately. For example, in one embodiment, a single reference temperature may be provided, and in alternative embodiments, a plurality of the reference temperatures may be provided. When the temperature of the wash water is higher than a first reference temperature (e.g. 50° C.) and there are three reference temperatures, that is, first, second and third reference temperature are provided, the control part may implement the washing step immediately. When the measured temperature of the wash water is lower than the first reference temperature and higher than the second reference temperature, the second reference temperature (e.g., 40° C.), being lower than the first reference temperature (e.g. 50° C.), and when the measured temperature is lower than the second reference temperature and higher than the third reference temperature, the third reference temperature (e.g. 30° C.) being lower than the second reference temperature (e.g. 40° C.), and when the measured temperature is lower than the third reference temperature, the compensating step configured to compensate the time of the washing step preset in the washing time setting step is performed.

When the time of the washing step is compensated, the control part may control the compensated time to be different depending on the temperature of the wash water. The washing ability is substantially in proportion to the temperature of the wash water. Because of that, the lower the measured temperature of the wash water is, the longer the compensated time is. The reference temperature and the range of the time added in the compensating step may be preset based on the capacity of the washing machine and other such factors.

C.1.4 Heating (S937):

Once the preset time of the washing step is compensated in the compensating step, a heating step configured to remove contaminants contained in the laundry by way of drum motion and to heat the wash water simultaneously may be implemented for a predetermined time period. The heating step may be implemented as an independent step or as a part of a washing step to be described later. Simply for ease of discussion, in this course description, the heating step will be described as the part of the washing step.

C.1.5 Washing (S939):

A drum driving motion of the washing step of the quick boiling course may include the step motion and/or the tumbling motion and/or the rolling motion.

The step motion has excellent washing ability and applies the shock to the laundry such that contaminants attached to the laundry may be separated and washing time may be reduced. As a result, the control part may rotate the drum in the step motion in an initial stage of the washing step. In this case, the heating step may be implemented after the step motion of the washing step.

In the step motion, the drum is rotated at a predetermined speed allowing the laundry not to be dropped from the inner circumferential surface of the drum due to the centrifugal force. When the laundry is located near the highest point of the drum, a reverse-torque is applied to the drum. Since the net acting ratio of the step motion is adjusted, the load applied to the motor is larger in the step motion than in the other motions. Because of that, if the heating step configured to heat the wash water is continued during the step motion, power consumption would be increased and a safety problem could occur due to the increase in the current amount. As a result, the heating step may be implemented for a predetermined time after the step motion is completed.

The heating step is configured such that the heater is not driven for a preset heating time period, and not necessarily until the temperature of the wash water reaches the preset value. This allows the time and electric power required by the washing step to be predicted accurately and the user to be notified of the predicted data. In addition, the washing step may be implemented only for essentially the same preset time, regardless of the temperature of the wash water supplied in the washing step, such that power consumption and washing time may be reduced.

Hence, the control part may control the tumbling motion and/or the rolling motion to be implemented. In this case, the tumbling motion and/or the rolling motion may be implemented simultaneously with the start of the heating step. The tumbling motion and the rolling motion apply a low load to the motor and have good washing ability, with reduced washing time. As a result, the tumbling motion and the rolling motion may achieve an effect of reducing the washing time required by the washing step and an effect of a proper washing ability even with the washing step implemented using the wash water having different temperatures.

C.2 Rinsing Cycle (S950):

A rinsing cycle of the quick boiling course may be similar to the rinsing cycles of the courses described above and rinsing cycles of other courses to be described later. Thus, further detailed description thereof will be omitted.

C.3 Spinning Cycle (S970):

A spinning cycle of the quick boiling course may be similar to the spinning cycles of the courses described above and spinning cycles of the other courses which will be described later. Thus, further detailed description thereof will be omitted.

Figure 10:
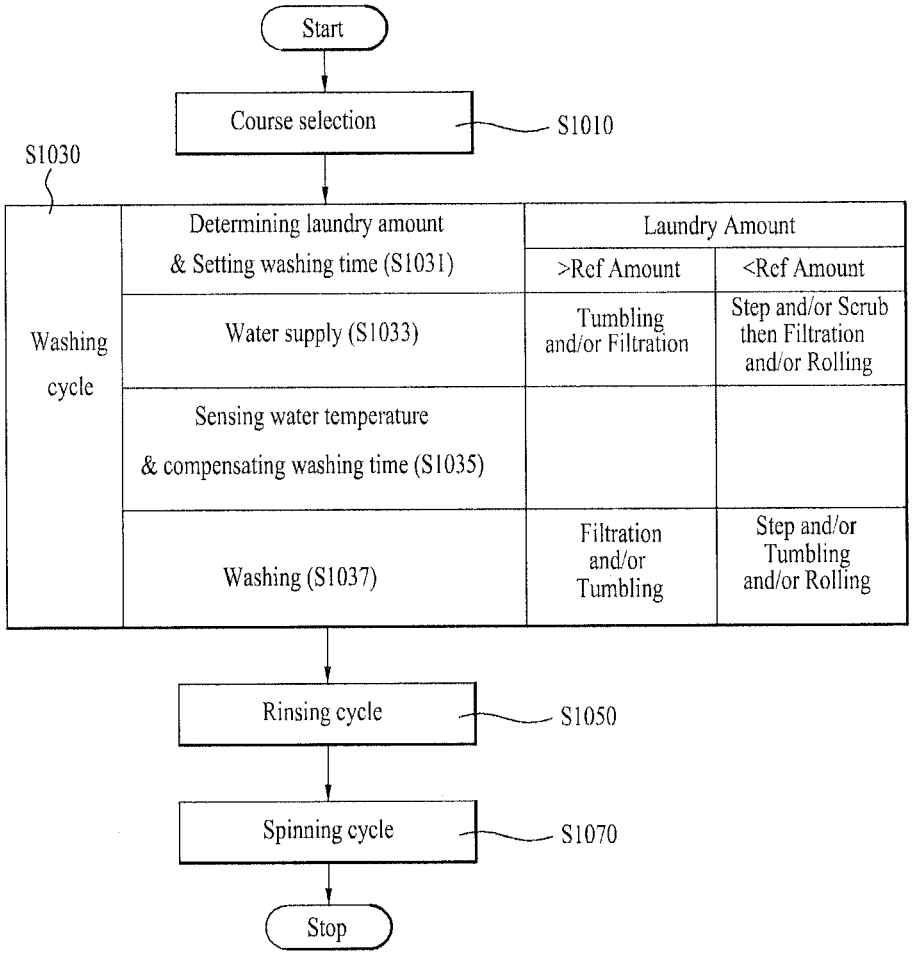

D. Course D (Cool Wash Course):

A Cool Wash Course D will be described in reference to FIG. 10. The Cool Wash Course D is configured to wash laundry without heating wash water, providing energy savings without degrading a desired washing ability. As a result, this course measures the temperature of the wash water supplied to the tub, the measured temperature is compared with a preset temperature, and operation parameters are adjusted accordingly, enabling the washing ability maintained. For example, if the temperature of the wash water does not reach a reference temperature based on the result of the comparison, the washing time is compensated enough to provide a target washing ability in the cool wash course.

First, the user may select the cool wash course from the course selecting part 117 (S1010). Once the user selects the cool wash course, the control part may implement a washing cycle, a rinsing cycle and/or spinning cycle sequentially or selectively.

D.1 Washing Cycle

First Embodiment (S1030)

D.1. Determining Laundry Amount/Washing Time Setting (S1031)

Once the user selects the cool wash course, the control part may implement a laundry amount determining step configured to measure the amount of the laundry and a washing time setting step configured to set the time required by a washing step of the cool wash course based on the measured amount of the laundry. In the laundry amount determining step, the control part may use the time taken to rotate the drum to a predetermined position or the time of residual rotation of the drum, to measure the amount of the laundry, as described above. In the washing time setting step, the control part may select a washing time corresponding to the measured laundry amount from proper times stored in the memory according to the laundry amount.

D.1.2 Water Supplying (S1033):

The washing cycle of the cool wash course may include a water supplying step configured to supply wash water to the tub. In the water supplying step, the control part controls the water supplying device (e.g. water supplying path and water supplying valve) connected with the water supply source and the tub to supply water to the tub. Also, the control part controls the drum to be driven in a similar drum driving motion to the drum driving motion of the water supplying step of the heavy contaminant course or the quick boiling course described above. Thus, further detailed description thereof will be omitted.

D.1.3 Water Temperature Measuring/Washing Time Compensating (S1035):

Once the wash water is supplied to the tub, the control part may measure the temperature of the wash water using a temperature measuring device provided in the washing machine. The control part may compare the measured temperature with a reference temperature (e.g. 15° C.). If the measured temperature of the wash water is the reference temperature or more, the control part may implement the washing step without compensating the washing time according to the laundry amount. If the measured temperature is less than the reference temperature, the control part may implement the washing time compensating step. In this example, the temperature of '15° C.' is presented as an example of a critical temperature capable of securing a washing ability in cool-washing and a reference temperature of a washing ability test using cool water. As a result, if the measured temperature of the wash water is less than the reference temperature, the control part may adjust the time of the washing step set in the washing time setting step. For example, if the measured temperature is less than the reference temperature, the control part may add a predetermined time to the time of the washing step to prevent deterioration of the washing ability due to the use of cool wash water having a lower temperature than the reference value. For example, if the measured temperature of the wash water is less than approximately 10° C., 10 minutes may be added to the time of the washing step in the washing time compensating step. If, for example, the measured temperature is more than 10° C. and less than 15° C., 5 minutes maybe added to the time of the washing step.

D.1.4 Washing (S1037):

Once the time of the washing step is compensated, the laundry amount measured in the laundry amount determining step mentioned above is compared with a reference laundry amount value and a washing step including different drum driving motions implemented according to the laundry amount may be implemented. The reference laundry amount value may be preset based on an amount of laundry that allows the step motion to be performed, taking into consideration of the size of the drum and the output of the motor. For example, the reference laundry amount value may be a half value of the washing capacity of the washing machine (approximately 5~6 Kg in a washing machine having an 11 Kg capacity). A case in which the measured laundry amount value is less than the reference laundry amount value will be described first, and then a case in which the measured value is the reference value or more will be described.

When the measured laundry amount value is less than the reference laundry amount value, the control part controls the step motion and/or the tumbling motion and/or the rolling motion to be implemented in the washing step. The step motion applies the dropping shock to the laundry loaded into the drum and contaminants contained in the laundry may be removed easily, even if cold water is used. If the laundry is entangled during the washing step, eccentric rotation of the drum may be generated. Thus, the control part drives the drum in the tumbling motion and/or rolling motion to disentangle and distribute the entangled laundry.

When the measured laundry amount value is the reference value or more, the control part controls the filtration motion and/or the tumbling motion to be implemented in the washing step. If the laundry amount is the reference value or more, the large load amount makes it difficult to achieve the effect of applying the shock to the laundry in the step motion and the effect of rolling the laundry along the inner circumferential surface of the drum in the rolling motion. Because of that, the filtration motion and the tumbling motion may be implemented, individually or sequentially, to achieve the effect of securing the washing ability and the effect of laundry distribution.

D.1' Washing Cycle

Second Embodiment (S1130)

Figure 11:
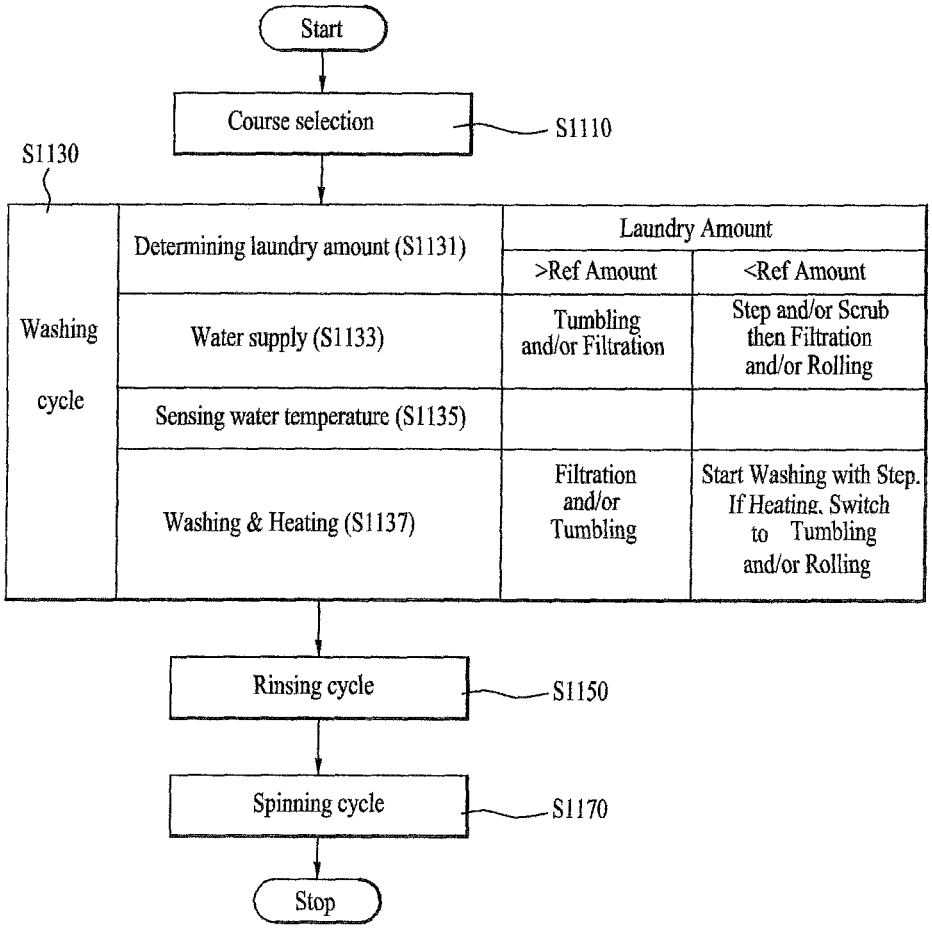

FIG. 11 is a diagram of a cool wash course according to a second embodiment as broadly described herein.

Compared with the cool wash course according to the first embodiment, the cool wash course according to the second embodiment omits a washing time setting step and a compensating step and instead heats the wash water using the heater if the temperature of the wash water is lower than 15□. That is, in a washing cycle according to the second embodiment, the laundry amount is determined (S1131) and a water supplying step (S1133) may be implemented immediately without setting the washing time. After that, the temperature of the wash water is measured (S1135) to implement the washing step (S1137). A drum driving motion of the drum may be differentiated according to the laundry amount in the washing step according to the second embodiment, which is similar to the first embodiment described above. The washing step according to the second embodiment may further include a heating step based on the measured temperature of the wash water.

A case in which the laundry amount measured in the washing step is less than the reference value will be described, in which the drum driving motion of the drum includes the step motion and/or tumbling motion and/or rolling motion.

When the measured temperature of the wash water is less than the reference value, the step motion is implemented after the washing step starts. After the step motion, a heating step configured to heat the wash water using a heater or a moisture supplying device provided in the tub may be implemented. The heating step starts after the step motion because the step motion applies increased load to the motor, as mentioned above. Thus, a safety problem as well as washing ability deterioration may occur if the heating step and the step motion are implemented simultaneously. Also, if the heating step is implemented before the step motion to avoid the above problems, the washing time would be increased disadvantageously. Thus, in this embodiment the heating step starts after the step motion is completed.

At the moment when starting the heating step, the control part may implement the tumbling motion and the rolling motion sequentially. The tumbling motion and the rolling motion have no concern in deterioration of washing ability deterioration and safety and can reduce washing time, even if they are implemented together with the heating step simultaneously.

The temperature of the wash water is re-measured after the heating step and it is determined whether the re-measured temperature reaches the reference temperature. When the temperature of the wash water reaches the reference temperature, the heating step may finish. However, if the temperature of the wash water fails to reach the reference temperature, the heating step may be continued during the washing step. That is, even if the temperature of the wash water heated in the heating step fails to reach the reference temperature, if the washing step finishes then the heating step finishes as well.

If the measured temperature is the reference temperature or more, the control part drives the drum in the step motion and/or the tumbling motion and/or the rolling motion essentially the same as the description of the drum driving motion according to the first embodiment, and thus further description thereof will be omitted accordingly.

If the laundry amount is the reference value or more in the washing step, the control part may drive the drum in the filtration motion and/or the tumbling motion. At this time, the heating step may be provided in case the measured temperature of the wash water is less than the reference temperature. As described above, the drum is not driven in the step motion during the heating step.

D.1" Washing Cycle

Third Embodiment (S1230)

Figure 12:
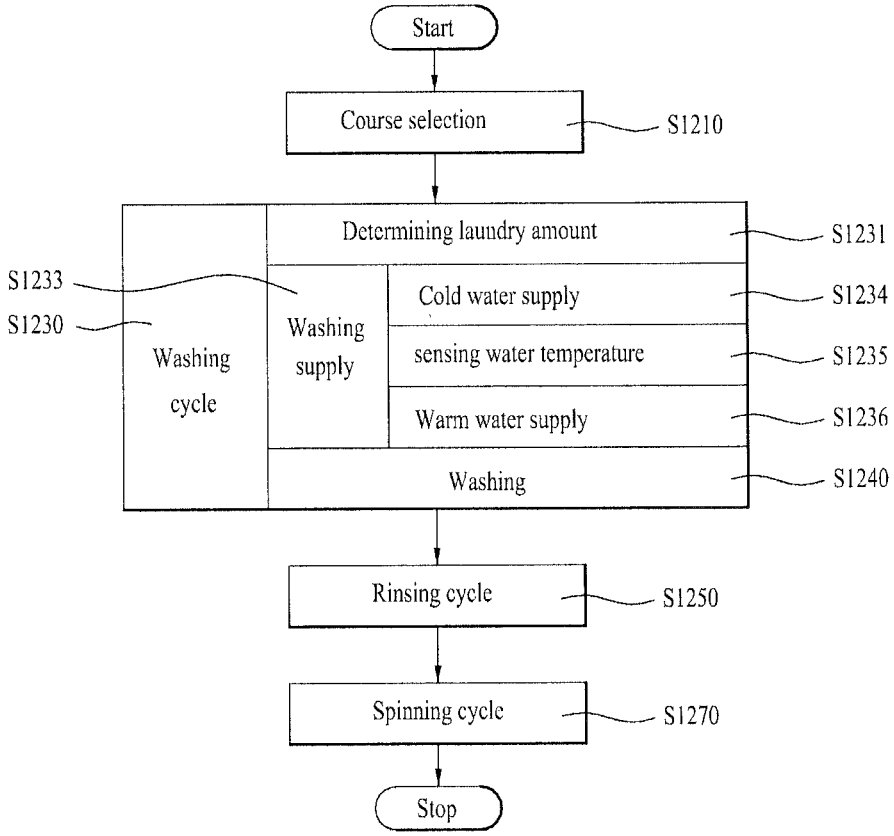

FIG. 12 is a diagram of a cool wash course according to a third embodiment as broadly described herein.

Compared with the cool wash course according to the first embodiment described above, the cool wash course according to the third embodiment supplies warm water to the tub if the temperature of wash water supplied in a water supplying step is lower than approximately 15° C. That is, after determining the amount of the laundry (S1231), the control part may implement a water supplying step (S1233) configured to supply wash water to the tub based on the determined laundry amount, omitting a washing time setting time and a compensating step.

At the moment when implementing the water supplying step, the control part supplies cold water to the tub (1234) and may also implement a water temperature measuring step (S1235) and the cold water supplying simultaneously. In this case, when the measured temperature of the wash water is 15° C. or higher, a washing step (S1240) may be implemented according to the amount of the laundry loaded into the drum. If the measured temperature is lower than 15° C., a warm water supplying step (S1236) may be implemented.

The water supplying step may be continued until the amount of the cold water and the amount of the warm water supplied in the water supplying step reaches the amount of wash water determined according to the laundry amount. Once the water supplying step is completed, a washing step implemented according to the laundry amount may start. The drum driving motion may be differentiated according the laundry amount in the washing step, like the first embodiment described above, and thus further detailed description thereof will be omitted.

D.2 Rinsing Cycle (S1050, S1150, S1250)

A rinsing cycle of the cool wash course may be similar to the rinsing cycles of the courses described above and rinsing cycles of the other courses to be described later. As a result, further detailed description thereof will be omitted.

D.3 Spinning Cycle (S1070, S1170, S1270)

A spinning cycle of the cool wash course may be similar to the spinning cycles of the courses described above and spinning cycles of the other courses which will be described later. As a result, further detailed description thereof will be omitted.

Figure 13:
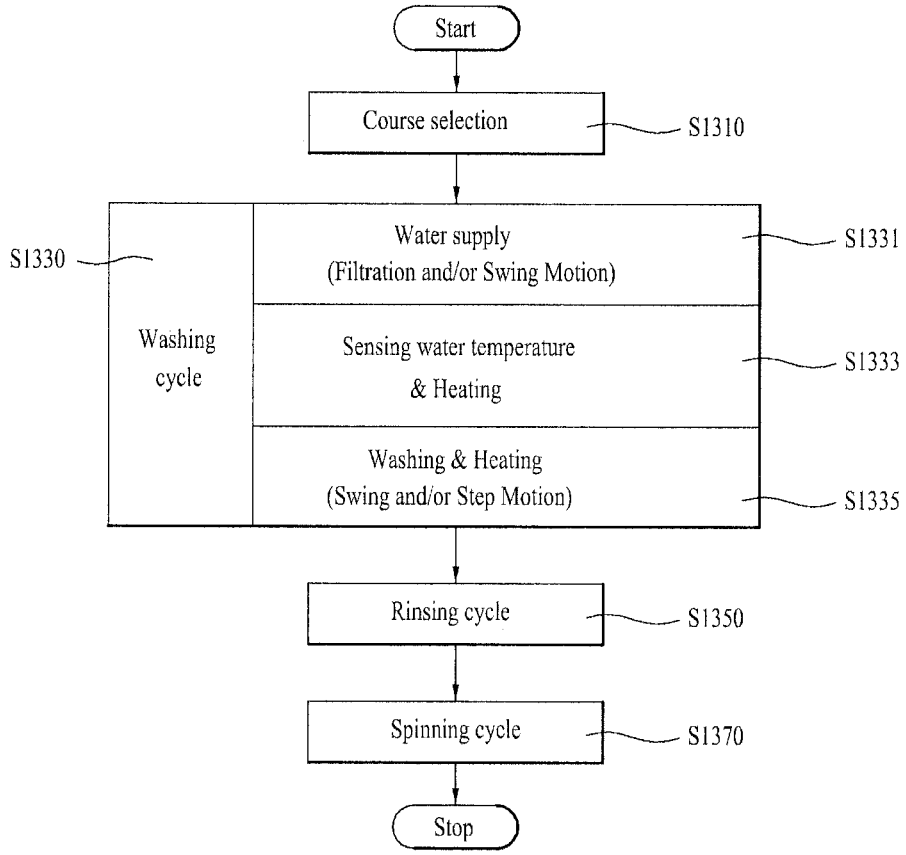

E. Course E (Color Item Course):

Course E will be described in reference to FIG. 13. Course E may be referred to as a 'Color Item Course' configured to wash colored laundry items more efficiently. When washing colored laundry items, a color migration problem, which can generate color running between colored items, fading, a lint problem and a pilling problem may occur. The above color migration is likely to be generated as the static friction between the drum and the laundry is larger. This course may include a temperature controlling step configured to prevent color migration by controlling the temperature of wash water, a colored-item washing step configured to drive the drum to prevent lint and pilling, and a rinsing step. As follows, the steps will be described in detail.

E.1 Washing Cycle

First Embodiment (S1330)

E.1.1 Water Supplying (S1331)

In a water supplying step, the control part controls cold water to be supplied to the tub. Color migration is more likely to occur in higher temperature wash water. In the water supplying step, the control part may control the motor to drive the drum in the swing motion or the filtration motion or a combination thereof. The water supplying step may provided to supply wash water required to wash the laundry to the tub and to wet the laundry loaded into the drum in the wash water. As a result, the drum is driven in the filtration motion in the water supplying step such that laundry wetting may be efficiently implemented. In addition, the drum may be driven in the swing motion in the water supplying step, rather than the filtration motion. The swing motion can minimize the movement of the laundry inside the drum, compared with the other motions, minimize lint generation and pilling which might be generated by the friction force between the laundry items.

E.1.2 Water Temperature Measuring Step/Heating (S1333)

Once the water supplying step is completed, the control part may measure the temperature of the wash water supplied to the tub. When the measured temperature is a reference temperature or more (e.g. 30° C. or 40° C.), the control part may start the washing step immediately. When the measured temperature is less than the reference temperature (e.g. cold water because the wash water supplied in the water supplying step is cold water), the control part may start a heating step configured to heat the wash water. In certain embodiments, the temperature (reference temperature) of the wash water allowing the washing step to start may be set to be 30° C. or 40° C., because the temperature of the wash water capable of maximizing washing ability, while minimizing color migration is in a range of 30° C. to 40° C.

The heating step heats the wash water supplied to the tub using a heater provided in the bottom surface of the tub or a steam generating device configured to supply steam to the tub.

E.1.3 Washing (S1335)

When the heating step enables the temperature of the wash water to reach the reference temperature (30° C. or 40° C.), the control part may start a washing step. In the washing step, the control part may control the drum to be driven in a drum driving motion which can minimize the mechanical friction force to prevent the lint and pilling and to achieve the desired washing ability. For example, the control part may control the drum to be driven in the swing motion and/or the step motion, in the washing step of this course. Such the step motion and the swing motion may be implemented sequentially and the sequential implementation may be repeated.

The swing motion rotates the drum in both opposite directions and drops the laundry from a position of approximately 90° or less with respect to the rotation direction of the drum. The swing motion applies rheostatic braking to the motor, because the physical friction applied to the laundry can be reduced as much as possible, while maintaining a predetermined level of washing efficiency. As a result, the possibility of lint and pilling, which may be generated by friction between the laundry items or between the laundry and the drum, may be minimized.

As mentioned above, the step motion rotates the drum at the predetermined speed allowing the laundry not dropped from the inner circumferential surface of the drum by the centrifugal force and then it applies the sudden brake to the drum to maximize the shock applied to the laundry. Because of that, the step motion has excellent washing ability, and enough to compensate for an insufficient washing ability of the swing motion. The amount of time the step motion is performed may be shorter than the amount of time the swing motion is performed to minimize the possibility of lint and pilling.

E.1' Washing Cycle

Second Embodiment (S1430)

Figure 14:
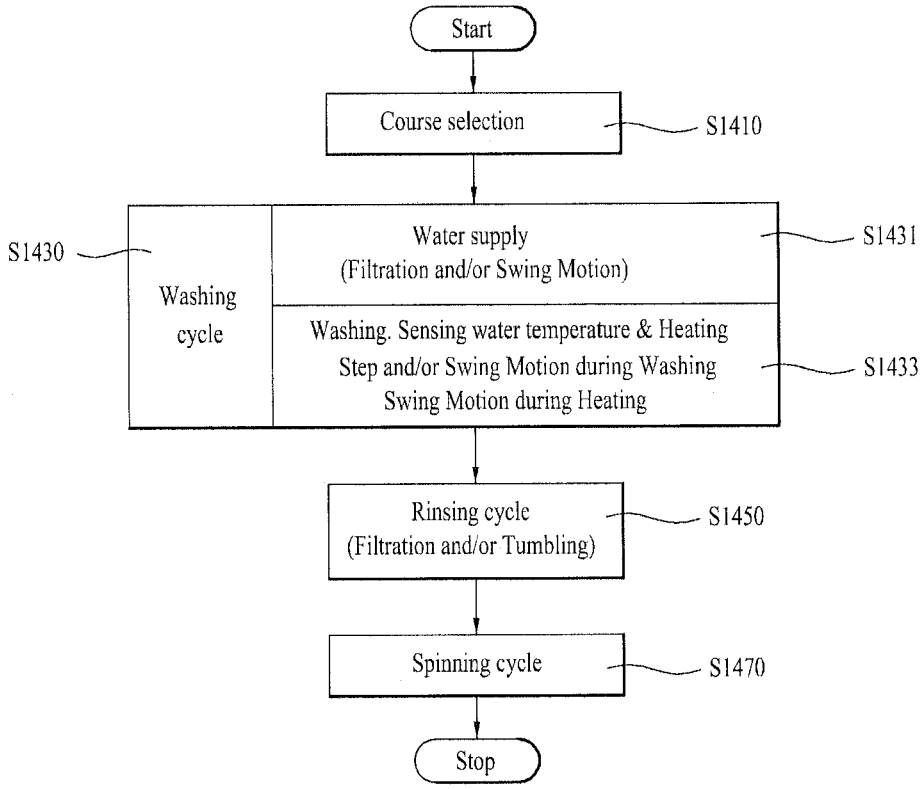

FIG. 14 is a diagram of a color item course according to a second embodiment. Different from the above course according to the first embodiment, the color item course according to the second embodiment allows a water temperature measuring step and a heating step to be implemented in a washing step (S1433) after a water supplying step (S1431). If the water temperature measuring step and the heating step are implemented before the washing step, the washing time would be increased disadvantageously. As a result, this embodiment presents a color item course capable of reducing the washing time in comparison to the above embodiment.

After the water supplying step (S1431), the control part may control the drum to be driven in the step motion and/or swing motion in the washing step and it may determined whether the temperature of wash water is a reference temperature (e.g. 30□ or 40□) or more simultaneously. When the temperature of the wash water is the reference temperature or more based on the result of the determination, the control part controls the drum to be driven continuously according to the washing step. When the temperature of the wash water is less than the reference temperature, the control part may start a heating step configured to heat the wash water.

The control part may control the drum not to be driven in the step motion in the heating step. That is, in the heating step, the control part drives the drum in the swing motion, not in the step motion. The reason why the heating step is not implemented together with the step motion simultaneously is described in the above courses and thus further detailed explanation will be omitted.

E.2 Rinsing Cycle (S1450)

The control part may start a rinsing cycle after the washing cycle is completed. The control part may control the drum to be driven in the filtration motion during the rinsing cycle. The filtration motion rotates the drum at the predetermined speed allowing the laundry not dropped from the inner circumferential surface of the drum by the centrifugal force and then sprays wash water into the drum such that the filtration motion may be applied to wet or rinse the laundry. Also, the filtration motion may generate little friction between laundry items and between the laundry and the drum. Because of that, the filtration motion allows the laundry to be rinsed in a relatively short time. The control part may implement the tumbling motion in the rinsing cycle to supplement the rinsing ability of the filtration motion.

E.3 Spinning Cycle (S1470)

After the rinsing cycle is completed, a spinning cycle configured to remove wash water from the laundry may start. The spinning cycle of the color item course may be similar to the spinning cycles of the courses described above and spinning cycles of the other courses to be described later and thus further detailed description thereof will be omitted.

F. Course F (Functional Cloting Course)

Figure 15:
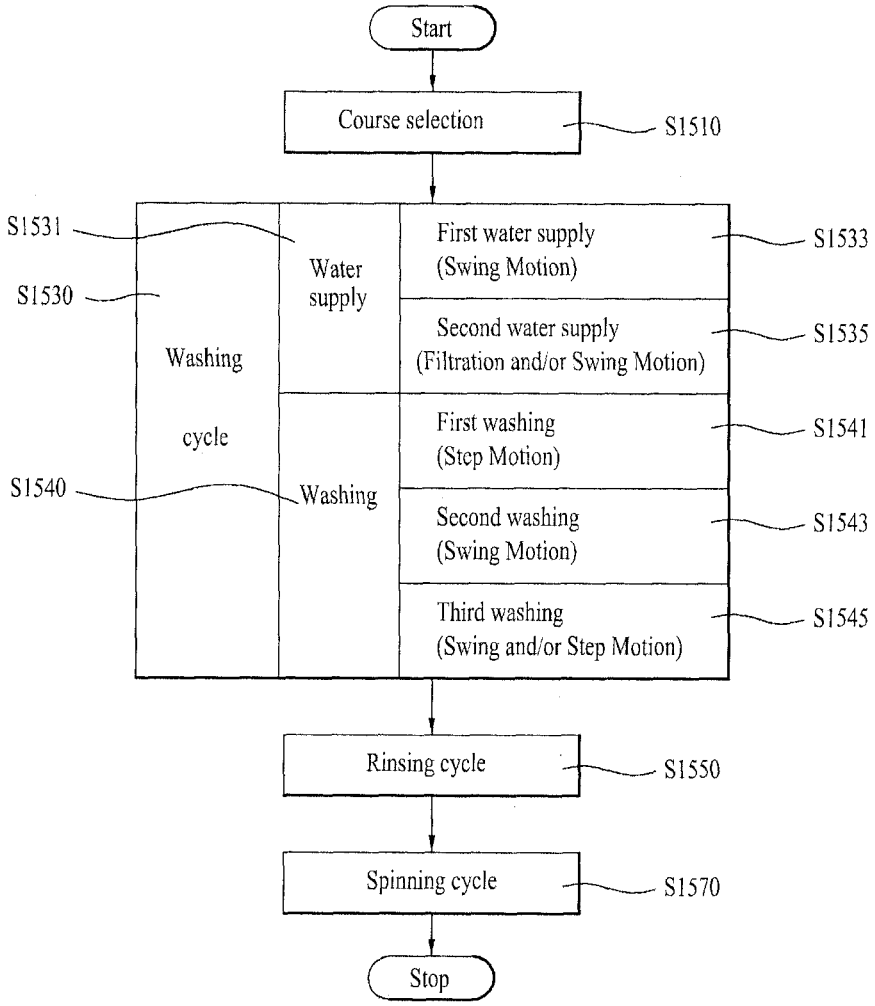

Course F will be described in reference to FIG. 15. Course F may be referred to as a 'functional clothing course' configured to wash functional clothing, including outdoor clothing such as mountain-climbing clothes and other athletic wear, effectively, without fabric damage. Functional clothing is manufactured to be appropriate for outdoor activities such as mountain-climbing, swimming, cycling and the like. Functional clothes absorb sweat quickly and discharge the absorbed moisture outside, and they help maintain body heat. However, these functional clothes are made of thin synthetic fabric and are more fragile than other kinds of fabrics. A washing course for functional clothes may be optimized to be proper for functional clothes.

First, the user may select the functional clothing course from the course selecting part 117 (S1510). Once the user selects the functional clothing course, the control part may start a washing cycle, a rinsing cycle and/or a spinning cycle sequentially or selectively.

F.1 Washing Cycle (S1530):

F.1.1 Water Supplying (S1531):

The control part implements a water supplying step of a washing cycle. The water supplying step supplies wash water required to wash the laundry. Also, the water supplying step dissolves detergent in the supplied wash water and wets the laundry loaded into the drum.

F.1.1.1 First Water Supply (S1533):

The water supplying step includes a first water supplying step implemented for a predetermined time period. In the first water supplying step, the drum may be driven in the swing motion. As mentioned above, the swing motion rotates the drum in a predetermined direction and a reverse direction alternatively. After being rotated to 90° or less from the lowest point of the drum in the predetermined direction and the reverse direction, the laundry may be dropped. As a result, the alternative rotation of clockwise/counter-clockwise direction generates a vortex in the wash water and detergent dissolution may be promoted. At the same time, the laundry rotated to 90° or less is dropped and a big shock is not applied to the laundry. Because of that, the swing motion in the first water supplying step allows the detergent to be dissolved in the wash water and a big shock is not applied to the functional clothing. The swing motion may be repeated for a predetermined time period, several numbers of times.

F.1.1.2 Second Water Supplying (S1535):

Once the first water supplying is completed, a second water supplying may be implemented for a predetermined time period. In the second water supplying, wash water is continuously supplied and the filtration motion and the swing motion are sequentially implemented. The first and second water supplying steps may be classified according to a preset time. The time of each step may be adjustable according to the amount of the laundry and other parameters as appropriate. For that, a laundry amount determining step configured to determine the amount of the laundry may be provided before the water supplying step.

As mentioned above, the filtration motion rotates the drum at high speed to generate the centrifugal force and the laundry is in close contact with the inner circumferential surface of the drum due to the centrifugal force. Also, the wash water passes through the laundry and the through holes of the drum by the centrifugal force and is discharged to the tub. As a result, the laundry is wet by the wash water in the filtration motion to be washed. In addition, the wash water passes through the laundry simply and the functional clothes may not be damaged while being wet in the wash water. After the filtration motion is implemented for a predetermined time period, the swing motion may be implemented. As mentioned above, the detergent may be continuously dissolved, without damage to the functional clothes. The laundry may be effectively wet in the wash water by the generated vortex and by extension, the swing motion generates the repeated drum rotation in the clockwise/counter-clockwise direction. Because of that, the entangled laundry may be disentangled before being washed. In addition, the swing motion drops the laundry from a relatively low position and fabric damage of the laundry may be minimized while disentangling the laundry. As a result, the combination of the filtration and swing motions may minimize damage of the functional clothes and enable laundry wetting, detergent dissolution and laundry disentangling to be achieved effectively. Such the sequential combination of the filtration and swing motions may be repeated several numbers of times for a predetermined time period.

F.1.2 Washing (S1540):

Once the wash water is supplied to a predetermined water level, the water supplying step is completed and then a washing step may start. As the functional clothes are relatively light and thin, essentially the same washing step may be implemented, regardless of the amount of laundry in the drum.

F.1.2.1. First Washing (S1541):

The washing step may include a first washing step implemented for a predetermined time period, with the drum driven in the step motion. As mentioned above, the step motion drops the laundry from the highest position. As a result, the step motion in the first washing step mixes the laundry items uniformly and the wash water preliminarily. Also, the step motion soaks contaminants of the laundry and applies the shock to the laundry to separate the contaminants from the laundry by using the big rotation/dropping of the laundry.

F.1.2.2. Second Washing (S1543):

After the first washing step, a second washing step may be implemented for a predetermined time period. In the second washing step, the wash water is heated for more effective washing and contaminant removal. First, the wash water may be heated by a heater provided in a bottom surface of the tub or a steam generating device configured to supply steam to the tub. Substantially, the wash water may be heated up to approximately 25° C. to 30° C., preferably, approximately 27° C. in the second washing step. The functional clothes are made of thin synthetic fabric texture and they may be damaged if the temperature of the heated wash water is excessively high. As a result, wash water having a proper temperature used in the second washing step may improve washing efficiency and may prevent fabric damage.

Simultaneously with the heating of the wash water, the drum may be driven in the swing motion in the second washing step. The swing motion uses the drop of the laundry from the relatively low position and the alternative rotation of the drum. Because of that, the laundry may be swung gently and moved enough in the wash water. The wash water in the swing motion may be heated uniformly in a relatively short time and heat may be transmitted to the laundry enough. Also, the swing motion can generate shock by the friction between the wash water and the laundry and dropping shock and it may remove contaminants effectively without fabric damage.

F.1.2.3. Third Washing (S1545):

After the second washing step, a third washing step may be implemented for a predetermined time period. In the third washing step, any remaining contaminants may be removed and a combination of the swing and step motions may be implemented. Although the swing motion may remove contaminants without fabric damage as mentioned above, the washing ability is relatively low in comparison to the other motions. As a result, the step motion capable of applying the strongest shock is added and the washing ability of the washing step mostly configured of the swing motion for the functional clothes may be improved. In addition, the strong shock of the step motion may prevent lint from being attached to the laundry. As a result, the third washing step may minimize damage to the functional clothes and separate contaminants from the laundry completely and effectively.

F.2. Rinsing Cycle (S1550):

A rinsing cycle of the functional clothing course may be similar to the rinsing cycles of the courses including the standard course mentioned above and rinsing cycles of the other courses to be described later and thus further detailed description thereof will be omitted.

To reinforce the overall rinsing ability, the rinsing cycle may be repeated more often than the rinsing cycle of the standard course. For example, the rinsing cycle may be implemented at least three times or more. This is because the drum is rotated at a lower RPM in a spinning cycle of the functional clothing course than in the standard course thus providing weaker rinsing ability. That is, the spinning cycle separates the wash water from the laundry using the centrifugal force generated by the high speed rotation of the drum and may provide a rinsing function configured to separate detergent and contaminants together with the wash water from the laundry simultaneously. A normal spinning step of the spinning cycle of the functional clothing course uses a relatively low RPM of the drum rotation and the final rinsing ability may be weakened. Thus, the rinsing step of the rinsing cycle of the functional clothing course may be implemented three times or more.

F.3 Spinning Cycle (S1570):

A spinning cycle of the functional clothing course may be similar to the spinning cycles of the courses including the standard course mentioned above and spinning cycles of the other courses to be described later. A normal spinning step of the spinning cycle may rotate the drum at a lower RPM than the normal spinning step of the standard course, to prevent damage to the laundry.

Figure 7B:
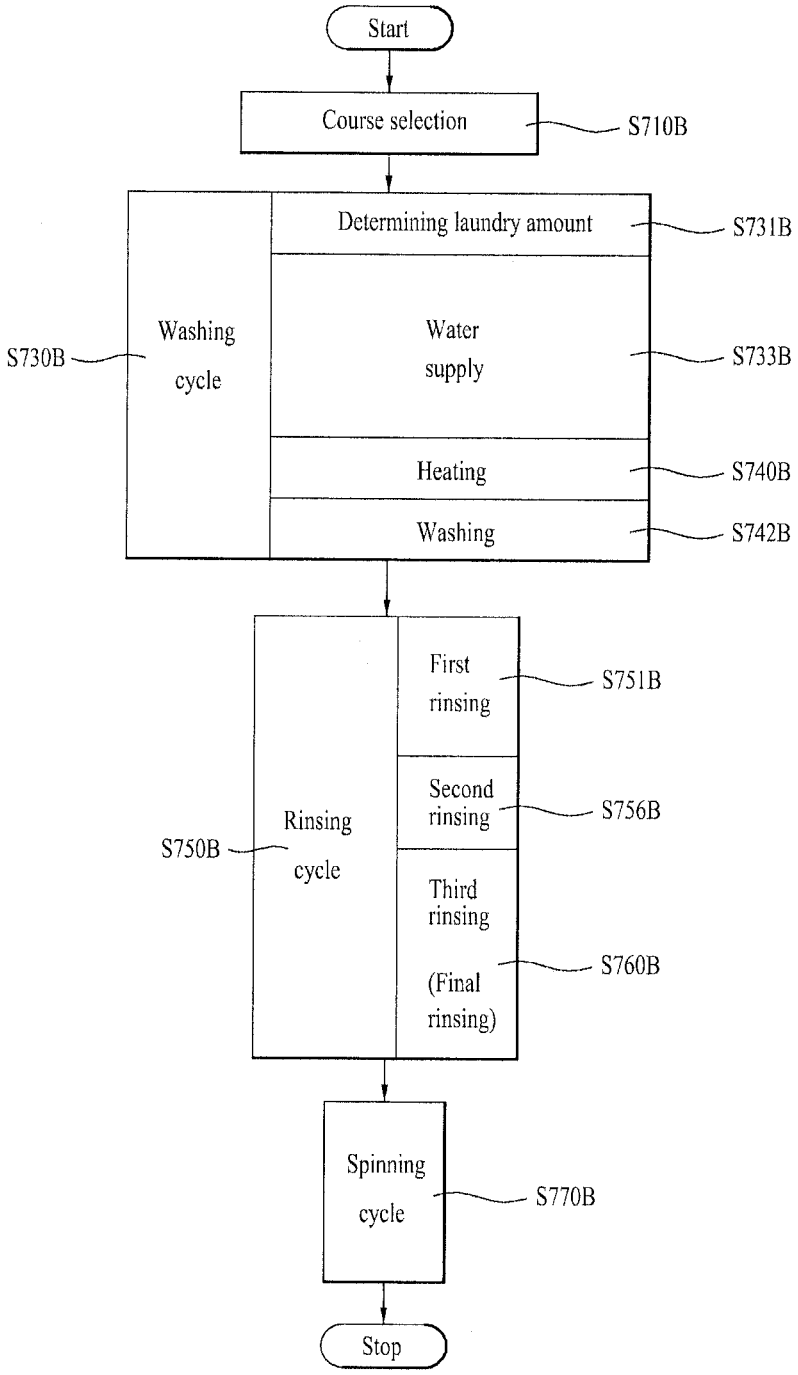

G. Course; G (Speed Wash Course):

A Speed Wash Course G, referred to as a 'speed wash course' capable of washing the laundry in a relatively short time, compared with the other courses, will be described with respect to FIG. 7B. A small amount of laundry typically requires a substantially short time in comparison to a large amount of laundry. In the case of a small amount of laundry, an unnecessarily long amount of time may be taken to implement overall washing. Because of that, a course used to wash a small amount of laundry in a short amount of time may be provided. The speed wash course is based on the standard course described above with respect to FIG. 7A, and each cycle or operational conditions of each step in the standard course may be optimized, or a predetermined number of steps may be omitted as appropriate.

First of all, the user may select the speed wash course from the course selecting part 117 (S710B) and the control part may implement a washing cycle (S730B), a Rinsing Cycle (S750B), and a Spinning Cycle (S770) composing the speed wash course.

G.1 Washing Cycle:

G.1.1 Laundry Amount Determining:

The control part may start a laundry amount determining step to determine the amount of laundry (S731B). The laundry amount determining step may be implemented before a water supplying step starts after the user selects the speed wash course. The laundry amount measured in the laundry amount determining step of the standard course as described above may be categorized into two categories, that is, a large amount and a small amount, to determine the following cycle or the drum motion of each step and other operational conditions. In the speed wash course, the measured laundry amount may be used to determined the total time of the overall washing, that is, the total time taken to complete the washing, rinsing and spinning cycles as well. In this case, the laundry amount may be specified into more categories, for example, three or more categories in the speed wash course. If the laundry amount is classified into more categories, a different overall-washing time (that is, the total time taken to complete the washing, rinsing and spinning cycles) may be set for each of the categories of laundry amount. As a result, the overall washing time may be controlled corresponding to the amount of laundry. Because of that, a relatively short time may be properly applied to a small amount of laundry without deteriorating the actual washing ability.

For example, the measured laundry amount may be classified into three categories including first, second and third categories, or may be classified into more than three categories. For example, the first category correspond to a load of less than approximately 1.5 Kg and a proper washing time of the first category may be set to be approximately 25 to 30 minutes, an in particular, 29 minutes. The second category may correspond to a load of approximately 1.5 to 4.0 Kg and a proper washing time of the second category may be set to be approximately 35 to 40 minutes, an in particular, 39 minutes. Lastly, the third category may correspond to a load of more than approximately 4.0 Kg and a proper washing time of the third category may be 45 to 50 minutes, and in particular, 49 minutes. Such categories and times may be stored in the memory of the control part as table data.

Once the laundry amount is determined in the laundry amount determining step, the control part determines which category the measured laundry amount corresponds to, in reference to the stored category table. After that, the control part may set the washing time given to the category corresponding to the measured laundry amount to be an actual washing time.

G.1.2. Water Supplying/Heating/Washing:

After the above series of steps, the control part may sequentially implement a water supplying step (S733B), a heating step (S740B) and a washing step (S742B) of the washing cycle (S730B). The water supplying step, the heating step, the washing step of the washing cycle of the speed wash course are similar to those of the washing cycle of the standard course shown in FIG. 7A and thus further detailed description thereof will be omitted.

As mentioned above in the standard course shown in FIG. 7A, a heating preparing step configured to promote heating of wash water may be implemented before a heating step. However, the heating preparing step may be a preliminary step and a drum motion of a predetermined time period may increase the overall washing time. As a result, preliminary steps such as the heating preparing step before the heating step may not be implemented in the speed wash course. After the water supplying course, the heating step may start.

G.2 Rinsing Cycle:

Once the washing cycle is completed, a rinsing cycle (S750B) configured to remove detergent remnants and contaminants remaining in the laundry may be implemented. The rinsing cycle (S750B) is similar to the rinsing cycle (S750) of the standard course shown in FIG. 7A and thus further detailed description of the rinsing cycle will be omitted.

The first rinsing step implemented in the initial stage of the rinsing cycle of the standard course may include the first drum driving step using the filtration motion that requires much time. In contrast, the drum motions implemented in the rinsing steps (S751B, S756B, S760B) require a relatively short time, while still providing the laundry with enough rinsing. As a result, the filtration motion of the first rinsing step provided in the rinsing cycle of the speed wash course may be omitted to reduce the overall washing time.

G.3 Spinning Cycle:

Once the rinsing cycle is completed, the control part may start a spinning cycle (S770B). The spinning cycle of the speed wash course is similar to the spinning cycle of the standard course shown in FIG. 7A and thus further detailed description thereof will be omitted.

The laundry disentangling step implemented in the initial stage of the spinning cycle of the standard course implements a drum motion capable of disentangling the laundry. However, such a drum motion may not affect the spinning ability substantially. Because of that, the laundry disentangling step may not be implemented in the spinning cycle of the speed wash course to reduce the overall washing time.

While the drum in the normal spinning step of the standard course may be rotated at approximately 1000 RPM, the drum in a normal spinning step of the speed wash course may be rotated at approximately 800 RPM. As the rotation speed of the drum increases, the vibration and noise of the drum may get more severe and the preparing steps implemented for the drum to reach the target RPM such as the eccentricity measuring step may be repeated enough to require a relatively long operation time. As a result, the target rotation speed of the speed wash course is lowered in comparison to that of the standard course and the time of the speed accelerating may be prevented from being increased.

As mentioned above, the speed wash course may classify the laundry amounts into specific categories and it may set the overall washing time proper to each category, such that the overall washing time of the large amount of the laundry as well as the small amount of the laundry may be reduced properly. In addition, compared with the standard course, unnecessary steps may be omitted from the cycles to reduce the overall washing time. Nevertheless, most of the drum motions applied to the cycles of the standard course are adapted in the speed wash course and the desired washing ability may be achieved. As a result, the speed wash course may wash a small amount of the laundry in a short time, while maintaining washing ability.

Figure 16:
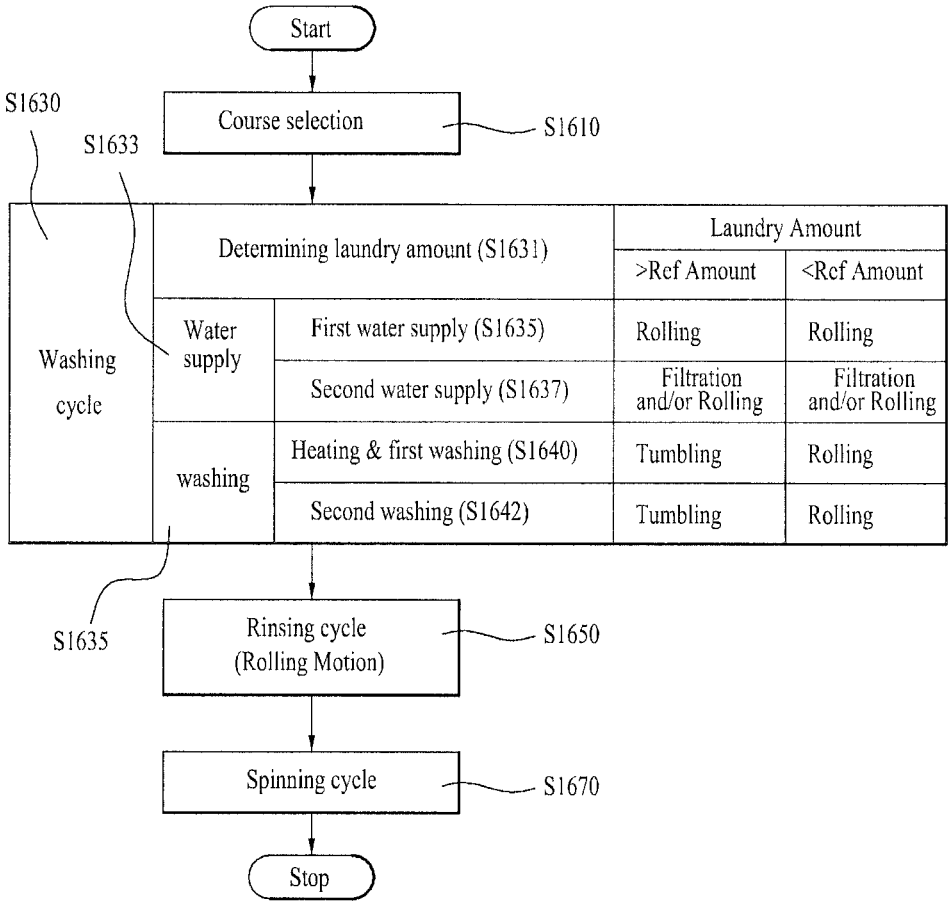

H. Course H (Silent Course):

Course H will be described in reference to FIG. 16. Course H may be referred to as a 'silent course' capable of reducing noise during washing.

In certain circumstances, less noise of the washing machine may be required by the user. For example, if washing is performed at night and/or an infant or child is asleep, it is preferable that the washing machine operate with less operation noise. Reduced operational noise may be achieved in various ways. Optimization of a washing control method may reduce the noise effectively, without increased production cost. The washing control method configured to reduce such noise may be embodied by a single course, namely, a silent course presented by optimization of operation conditions. The silent course is based on the standard course and is embodied by optimizing or omitting certain operational conditions of certain cycles or steps of the standard course. FIG. 16 is a flow chart of different steps of the silent course from the steps of the standard course. First, the user may select the silent course from the course selecting part 117 (S1610) and the control part may implement a following series of operations.

H.1 Washing Cycle (S1630):

H.1.1 Laundry Amount Determining (S1631):

The control part may start a laundry amount determining step to determine the amount of laundry. The laundry amount determining step has been described above and thus further detailed description thereof will be omitted. An object of the silent course is to reduce noise and/or vibration while also maintaining washing ability. A drum driving motion of each step may be differentiated according to the laundry amount.

H.1.2. Water Supplying (S1633):

Once the user selects the silent course, a water supplying step may start. The water supplying step supplies wash water to the tub. Also, the water supplying step dissolves detergent mixed with the wash water and wets the laundry loaded into the drum. In the water supplying step of the silent course, the control part may supply a larger amount of wash water to the tub, compared with the water supplying step of the standard course. The reason why more wash water is supplied will be described in a following washing step.

H.1.2.1 First Water Supplying (S1635):

In the water supplying step, the control part may implement a first water supplying step, together with the supply of the wash water. In the first water supplying step, the control part controls the drum to be driven in the rolling motion.

As mentioned above, the rolling motion rotates the drum in a predetermined direction continuously and the laundry is separated from the drum after being rotated to the position of 90° or less with respect to the rotation direction of the drum from the lowest point of the drum. In the rolling motion, the drum is rotated at a relatively low speed and the separated laundry is rolling-moved on the inner surface of the drum to the lowest point of the drum, without dropping to the lowest point. Because of that, the rotation of the drum and the rolling movement of the laundry may generate a predetermined vortex in the wash water and detergent dissolution may be promoted in the wash water. At the same time, the rolling motion induces the rolling movement of the laundry along the inner surface of the drum and it may have no noise of the shock generated by the sudden dropping of the laundry. As a result, the rolling motion in the first water supplying step may allow the detergent to be sufficiently dissolved in the wash water while also reducing noise. In the first water supplying step, the rolling motion may be repeated for a predetermined time period a number of times.

H.1.2.2 Second Water Supplying (S1637):

Once the first water supplying step is completed, the control part may start a second water supplying step. In the second water supplying step, the control part may control the drum to be driven in the filtration motion and the rolling motion sequentially, with supplying the wash water to the tub continuously. The first and second water supplying steps may be distinguished from each other according to the respective preset time and the time of each step may be adjustable according to the amount of laundry.

As mentioned above, the filtration motion rotates the drum at a high speed to generate a centrifugal force and the generated centrifugal force maintains the laundry in close contact with the inner circumferential surface of the drum. Also, the wash water passes through the laundry and the through holes of the drum by the centrifugal force to be discharged to the tub. As a result, the laundry is wet by the wash water in the filtration motion. In addition, the wash water passes through the laundry simply and the laundry may not be damaged while being wet in the wash water. After the filtration motion is implemented for a predetermined time period, the rolling motion may be implemented. As mentioned above, the rolling motion in the first water supplying step may allow the detergent to be sufficiently dissolved in the wash water while also reducing noise. Also, a broader surface area of the laundry contacts the wash water, rolling-moved along the inner surface of the drum, and thus the laundry may be wet in the wash water more effectively and uniformly. As a result, the combination of the filtration and rolling motions may minimize the noise and enable laundry wetting, detergent dissolution and laundry disentangling to be achieved effectively. Such the sequential combination of the filtration and rolling motions may be repeated several numbers of times for a predetermined time period.

H.1.3 Washing (S1635):

Once the wash water is supplied to a predetermined water level, the water supplying step is completed and then a washing step may start.

H.1.3.1 Heating Step/First Washing (S1640):

Once the water supplying step is completed, the control part starts a first washing step. The first washing step may include a heating step configured to heat the wash water to a predetermined temperature. Different from the heating step and the washing step of the standard course, the first washing step of the silent course may include only the rolling motion. The rolling motion enables the laundry to rolling-move along the inner surface of the drum without suddenly dropping the laundry. As a result, such a rolling movement may maximize the friction between the laundry and the wash water and between the laundry and the drum and the washing step may remove contaminants from the laundry effectively, with minimized noise.

As mentioned above, the control part in the water supplying step may supply a larger amount of wash water, compared with the water supplying step of the standard course. For example, the control part may control the amount of wash water supplied in the washing step of the silent course to be 1.2 times as much as the amount of the wash water supplied to the same amount of laundry. The increase in the wash water amount results in increasing of the water level inside the drum. When the laundry is rolling-moved in the drum with the increased water level by the rolling motion, the friction between the wash water and the laundry may be further increased and the washing ability may be further improved. Eventually, the rolling motion adapted in the washing step may provide adequate washing ability while also suppressing noise generation.

Once a predetermined amount or more of the laundry is loaded into the drum, the slow speed rotation of the drum cannot rotate the laundry together with the drum easily. Even if rotated together with the drum, the large amount of laundry may have difficulty being rolling-moved on the inner surface of the drum because of the volume. As a result, since the rolling motion rotates the drum at a relatively low speed, the large amount of laundry fails to rolling-move as intended and thus fails to achieve the desired washing ability. Because of that, if washing a large amount of laundry, the washing step may adapt a different drum motion from the rolling motion described above.

That is, when the laundry amount measured in the laundry amount determining step is larger than a preset reference value, the tumbling motion may be implemented in the washing step, instead of the rolling motion. The tumbling motion rotates the drum in the predetermined direction continuously, similar to the rolling motion, and the rotation speed of the drum in the tumbling motion is higher then that of the drum in the rolling motion. As a result, the laundry is separated from the drum after being rotated to the position of 90° or more with respect to the rotation direction of the drum from the lowest point of the drum. Since the drum is rotated at a relatively high speed in the tumbling motion, the separated laundry is dropped to the lowest point of the drum and this is different from the rolling motion. As a result, the laundry may be washed by the shock generated by the friction between the laundry and the wash water and the dropping. Although the tumbling motion generates more noise than the rolling motion, the generated noise may be less than the noise generated in the other drum motions such as the step motion and the scrub motion which have the strong washing ability. Because of that, tumbling motion may wash the large amount of the laundry effectively, while suppressing noise generation as much as possible. When the measured laundry amount is less than the reference value, the rolling motion may be implemented as mentioned above.

To promote the heating of the wash water, a heating preparing step may be implemented before a heating step. However, the heating preparing step may include a drum motion and the drum motion may generate noise. As a result, preliminary steps such as the heating preparing step before the first washing step may not be implemented in the washing step of this course and the wash water may be heated to a predetermined temperature in the first washing step. The wash water may be heated by the heater or the steam generating device installed in the tub.

H.1.3.2 Second Washing (S1642):

The control part may start a second washing step after the first washing step. Contaminants may be more completely removed in the second washing step. Like the first washing step, the second washing step of the silent course may include only the rolling motion. The noise generation may be minimized in the rolling motion and the contaminants of the laundry may be removed effectively in the rolling motion, as described above. Also, a larger amount of wash water is supplied in the rolling motion, compared with the amount of wash water supplied in the standard course. Because of that, the adaptation of the rolling motion may secure sufficient washing ability while also suppressing noise generation.

If the laundry amount is large, the drum is driven in the tumbling motion. If the laundry amount is small, the drum is driven in the rolling motion, similar to the first washing step described above.

H.2 Rinsing Cycle (1650):

Once the washing cycle is completed, a rinsing cycle configured to remove detergent remnants and contaminants from the laundry may start. The rinsing cycle is similar to the rinsing cycles of the standard course described above and thus further detailed description thereof will be omitted.

The first rinsing step implemented in the initial stage of the rinsing cycle of the standard course includes the first drum driving step using the filtration motion, which may generate much noise. As a result, the filtration motion is not implemented in the rinsing cycle of the silent course. While the steps of the rinsing cycle of the standard course may adapt various drum motions, the silent course may apply only the rolling motion to the steps of the rinsing cycle to reduce noise as in the washing step.

To reinforce the overall rinsing ability, the rinsing steps are repeated a more times in the silent course than in the standard course. For example, the rinsing cycle may be implemented four times or more. This is because the drum is rotated at a lower RPM in the spinning of the silent course than in the spinning cycle of the standard course, thus deteriorating rinsing ability. That is, in the spinning cycle, the wash water is typically separated from the laundry by the centrifugal force generated by the high speed rotation of the drum and detergent and contaminants are separated from the laundry together with the wash water simultaneously. However, in the normal spinning step of the spinning cycle of the silent course, the drum is rotated at a lower RPM and thus the final rinsing ability may be deteriorated. As a result, the rinsing steps may be implemented four times or more in the rinsing cycle of the silent course.

H.3 Spinning Cycle (S1670):

Once the rinsing cycle is completed, the control part may start a spinning cycle. The spinning cycle is similar to the spinning cycle of the standard course and thus further detailed description thereof will be omitted.

In a normal spinning step of the silent course, the drum may be rotated at a lower RPM than in the normal spinning step of the standard course to reduce noise. For example, to reduce noise, the drum may be rotated at a predetermined RPM which is 50% of the RPM of the normal spinning cycle of the standard course. That is, the drum may be rotated at approximately 400 RPM.

I. Course I (Cotton, Synthetic, Mixture Courses)

Like the functional clothing course described above, courses may be provided corresponding to the kinds of laundry items and to fabric types of the laundry. For example, there may be provided a cotton course configured to wash cotton fabric such as towels, tablecloths, T-shirts and the like, a synthetic course or easy care course configured to wash synthetic fabric, and a mixture course configured to wash a mixture of fabric types such as cotton and synthetic fabrics. Synthetic material may include, for example, polyamide, acrylic, polyester and other such fabrics.

Cotton fabric and synthetic fabric have different characteristics. That is, cotton fabric is more resistant to friction and shock, with less concern of deformity, than the synthetic fabric. In addition, cotton fabric can absorb more wash water than the synthetic fabric and has less concern of wrinkles than the synthetic fabric. However, it is not easy to separate the cotton fabric laundry items from synthetic fabric laundry items and to implement corresponding washing courses to wash them separately all the time. This is because the user usually wears clothes fabricated from the cotton and synthetic fabric together, and does not want to wash separate partial loads of cotton and synthetic clothing. As a result, a washing course combining the merits of the cotton course and the synthetic course, that is, a mixture course, may be provided.

The mixture course may be useful for many reasons. For example, if the user separates the cotton fabric laundry items and synthetic fabric laundry items to wash them separately, washing may be delayed disadvantageously until a predetermined amount of laundry is collected, and thus contaminated laundry may be neglected for a relatively long time. Of course, if a small amount of laundry is washed separately, energy may be wasted. Because of that, the mixture course capable of washing conventional kinds of fabric laundry items together may prevent the problem of laundry neglect and energy waste.

Figure 17:
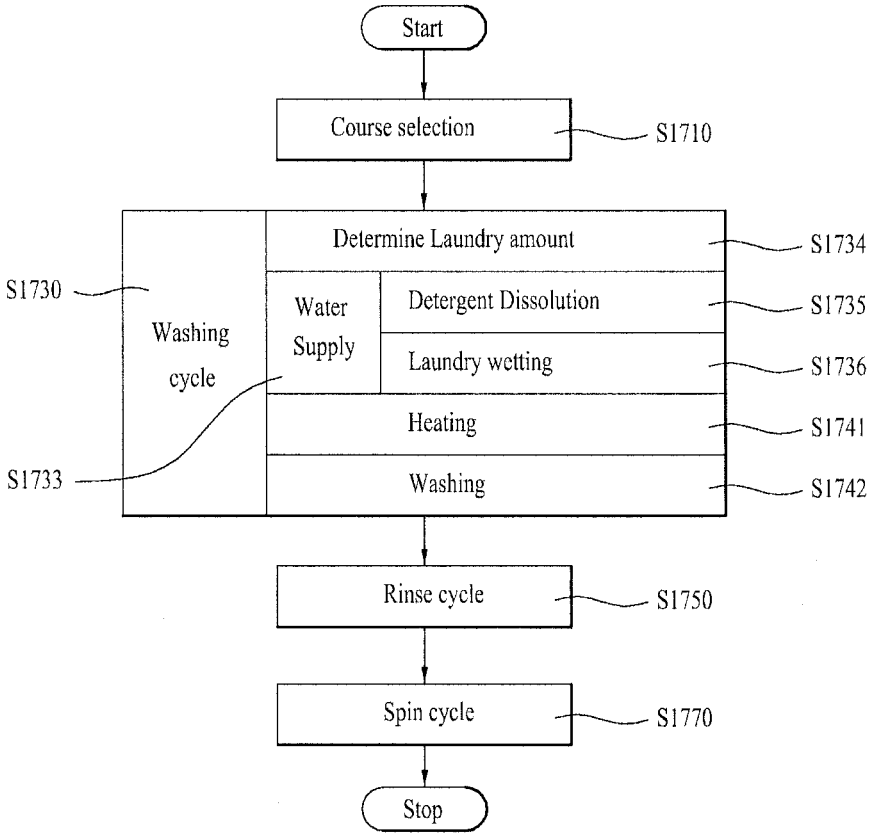

In the washing course provided corresponding to such mixtures of types of fabric shown in FIG. 17, a washing cycle, a rinsing cycle and a spinning cycle may be differentiated according to the characteristics of the particular type of fabric. As follows, the cotton course, the synthetic course and the mixture course having operational conditions of each step adjusted based on the type of fabric will be described in reference to the cycles and steps of the standard course described above. Compared with the standard course, repeated detailed description will be omitted as appropriate, and difference will be described in detail.

Once the user selects the cotton course, the synthetic course or the mixture course (S1710) according to the type of fabric of the laundry, the control part may implement a wash cycle (S1730), a rinse cycle (S1750), and a spin cycle (S1770) and steps according to the selected course.

I.1 Washing Cycle:

I.1.1 Laundry Amount Determining Step (S1734):

The control part may determine the amount of the laundry in a washing cycle and a method of laundry amount determining in this course is similar to the above methods and repeated description will be omitted. The measured laundry amount may be used in a following step properly, which will be described in detail.

I.1.2. Water Supplying Step (S1733):

The control part may implement a water supplying step configured to supply wash water and detergent to the tub or the drum and to dissolve the detergent in the wash water. That is, the wash water is supplied from an external water supply source, together with the detergent. To supply the wash water and the detergent to the laundry initially, the wash water and the detergent are supplied to the laundry inside the drum directly. That is, a water supply path of the wash water may be located in a front upper portion of the drum toward the drum inside, not in a lower portion of the tub. When the detergent is a powder type, detergent dissolution fails to be sufficiently implemented and a drum driving motion of the water supplying step, which will be described later, may dissolve the detergent sufficiently. As a result, the wash water and the detergent are supplied to the laundry in the initial stage of the washing cycle and the time required by the washing cycle may be reduced to improve washing efficiency.

I.1.2.1 Detergent Dissolution Promoting (S1735):

In a detergent dissolution promoting step, a drum driving motion may be differentiated according to the type of laundry fabric. For example, the scrub motion may be implemented for cotton fabric laundry items and the step motion may be implemented for synthetic fabric laundry items. In alternative embodiments, the scrub motion and/or the step motion may be implemented.

The scrub motion bends/stretches and scrubs the laundry by dropping the laundry, to generate friction. Because of that, a human hands' scrubbing-like effect can be expected in the initial stage of the washing cycle. However, this scrub motion may be implemented for fabric which is somewhat resistant to friction and the drum driving motion may be the scrub motion in the detergent dissolution promoting step of the cotton course.

According to characteristics of the synthetic fabric, synthetic laundry items are lighter than the cotton laundry items and the synthetic laundry items have a lower percentage of the water than the cotton laundry items. Also, the synthetic laundry items have more concern for damage caused by friction than the cotton laundry items. Because of that, the step motion may be implemented in the detergent dissolution promoting step to promote the detergent dissolution and to prevent fabric damage. That is, a drum driving motion in a detergent dissolution promoting step for the synthetic fabric may be the step motion. The step motion applies the maximum dropping shock to light synthetic fabric to promote the detergent dissolution and the effect of the humans' striking-like washing effect may be expected in the initial stage of the washing cycle.

A drum driving motion of a detergent dissolution promoting step in the mixture course may be combination of the step motion and the scrub motion. That is, the step motion and the scrub motion which are optimal to the cotton fabric and the synthetic fabric, respectively, may be combined such that the detergent dissolution may be promoted and the washing effect may be expected in the initial stage of the washing cycle. In this case, the different drum driving motions are combined and because of that, laundry movement patterns and wash water movement patterns may be diverse enough to improve the efficiency of the washing cycle.

I.1.2.2 Laundry Wetting (S1736):

In the laundry wetting step of the standard course, the drum may be rotated in the rolling motion. The rolling motion generates less friction applied to the laundry than the above scrub motion and the rolling motion is implemented in a period having the laundry wetting implemented. As a result, although friction is applied between the wet laundry items, there will be little concern of laundry damage and the laundry wetting step implemented in the rolling motion may be implemented similarly, regardless of the fabric kinds of the laundry.

Regardless of whether the fabric is cotton or synthetic, the rolling motion may be implemented in the laundry wetting step. Even when the user selects any one of the cotton course, the mixture course or the synthetic course, the rolling motion may be implemented in the laundry wetting step after the detergent dissolution promoting step.

The laundry wetting step may include two steps including first and second laundry wetting steps which are separately implemented. For example, when the laundry wetting step is implemented for 10 minutes, the first laundry wetting step may be implemented for 5 minutes and the second laundry wetting step may be implemented for 5 minutes. Specifically, additional water supply may be implemented in the first laundry wetting step and the second laundry wetting step may be implemented once the additional water supply is completed.

Drum driving motions of the first and second laundry wetting steps may be differentiated to wet the laundry more effectively and to supply both the detergent and wash water to the laundry uniformly. For example, the drum driving motion of the first laundry wetting step may be the rolling motion and the drum driving motion of the second laundry wetting step may be a combination of the rolling motion and filtration motion. That is, the rolling motion may be implemented at a predetermined net acting ratio in the first laundry wetting step. In the second laundry wetting step, after the filtration motion is implemented one time, the rolling motion is implemented four times and this composes a single cycle. The cycle may be repeated.

The rolling motion continuously turns-over the laundry in the lower portion of the drum to increase the contact time between the wash water and the detergent. The filtration motion spreads the laundry broadly and allows the wash water and the detergent to be supplied to the laundry uniformly, such that effective laundry wetting may be possible. It may typically take approximately 13 minutes to complete the laundry wetting in the tumbling motion, while laundry wetting may take approximately 10 minutes according to this embodiment.

The drum driving motion of the first laundry wetting step may be differentiated according to the amount of laundry. The drum driving motion of the first laundry wetting step may be differentiated according to the laundry amount determined in the laundry amount determining step. For example, if the determined laundry amount is a predetermined level or more, the drum is driven in the rolling motion as mentioned above. If the determined laundry amount is less than the predetermined level, the drum may be driven in a combination of the step and rolling motions.

The step motion suddenly drops the laundry after lifting. If the laundry amount is large, the distance of the laundry dropping may be reduced. Thus, the step motion is proper to a small amount of laundry. Such a step motion might cause damage to the laundry. As a result, in the cotton course, when the laundry amount is less than the predetermined level, the combination of the step motion and rolling motion may be implemented in the first laundry wetting step. When the laundry amount is the predetermined level or more, the rolling motion may be implemented in the first laundry wetting step. In the synthetic course and the mixture course having a concern of laundry damage, the rolling motion may be implemented in the first laundry wetting step, regardless of the laundry amount.

In alternative embodiments, a circulating step may be implemented in the water supplying step, in relation to the drum driving. That is, the circulating step may be synchronized with the driving of the motor configured to drive the drum. The wash water circulated when the laundry is moved by the driving of the drum may be supplied to the laundry and the object of the water supplying step may be achieved more effectively.

The detergent dissolution promoting step and the laundry wetting step are included in the water supplying step according to this embodiment. However, the detergent dissolution promoting step and the laundry wetting step could be provided independently from the water supplying step. In this case, after the water supply, the detergent dissolution promoting step or the laundry wetting step may be implemented.

I.1.3. Heating (S1741):

A heating step may be differentiated according to the selected operation course in this course. For example, the temperature of wash water used in the heating step may be set different depending on the type of fabric of the laundry.

Cotton fabric is somewhat tolerant of heat. As the temperature of the wash water increases, the more the detergent is dissolved in the wash water and activation of the detergent is further promoted. As a result, when the cotton course is selected, the temperature of the wash water may be set to be approximately 60□ in the heating step. Such a temperature of the wash water may be selected from a within a range extending from cold water up to water at approximately 95□ via the option selecting part 118. As the temperature of the wash water increases, detergent activation may be further promoted and the washing ability may further improved, further improving an effect of sterilization/bleach if appropriate.

Synthetic fabric may be more subject to/less tolerant of heat and thus the synthetic course or mixture course aims to prevent the heat from damaging the laundry. When the synthetic course or the mixture course is selected, the temperature of the wash water may be set to be approximately 40□ in the heating step. In the synthetic course or the mixture course, the user may be prevented from selecting the temperature of the wash water to be higher than 60□, to prevent laundry damage. For example, when the synthetic course or the mixture course is selected, the temperature of the wash water in the heating step may have the highest limit of 60□.

A drum driving motion of the heating step may be the tumbling motion, regardless of the selected course. This is because the tumbling motion can disentangle the laundry, while reducing laundry damage. As a result, the tumbling motion may allow steam or heated-wash water to be sufficiently transmitted to the laundry.

In alternative embodiments, a circulating step may be implemented in the heating step. The circulating step may be synchronized with the driving of the drum. Since the circulating step is implemented after initial heating is implemented to a predetermined degree, the circulating step may be synchronized with the drum driving in a predetermined time after the initial driving of the drum starts.

I.1.4 Washing (S1742):

A drum driving motion of a washing step may be a sequential combination of the rolling motion and/or tumbling motion and/or swing motion. The drum driving motion of the washing step may be differentiated according to the selected course, because both the effect of fabric protection and the effect of improved washing ability are to be achieved.

That is, in the case of washing cotton fabric laundry, a drum driving motion configured to wash the laundry using a strong mechanical force may be implemented. In the case of washing synthetic fabric laundry, a drum driving motion configured to wash the laundry by using a relatively low mechanical force may be implemented. The washing step may include one of the steps of the washing cycle, which requires the longest time. As a result, the washing step may be controlled to implement washing most efficiently. Since the required time of the washing step is long, the most laundry damage is likely to be generated in the washing step.

Considering that, the drum may be driven in combination of the rolling motion and tumbling motion in the washing step when the cotton course is selected. The combination of the two different motions applies various patterns of the strong mechanical force to the laundry and the washing efficiency may be improved. That is, according to the characteristics of the cotton fabric, there is little concern of fabric damage. Because of that, the strong mechanical force is applied to wash the laundry and the washing effect may be improved more. When the cotton course is selected, a combination of the filtration motion and the tumbling motion may be implemented in a washing step, with the circulating step synchronized with the driving of the drum. Since the cotton fabric has little concern of laundry damage, the filtration motion may supply the wash water and the detergent to the laundry continuously and effectively.

In contrast, when the synthetic course is selected, the drum may be rotated in a combination of the swing motion and the tumbling motion in the washing step. The combination of the two different motions may improve the washing effect. The swing motion swings the laundry in the wash water gently and thus laundry damage generated by the friction may be minimized. In addition, the time in which the laundry contacts with the wash water may be increased enough to improve the washing effect.

As the mixture course is provided to wash both cotton laundry items and synthetic laundry items together effectively, the washing effect is to be improved and the laundry damage is to be reduced as much as possible, regardless of the laundry fabric type. To satisfy that, the drum driving motion of the washing step when the mixture course is selected may be a combination of the tumbling motion and/or swing motion and/or rolling motion. That is, the swing motion configured to prevent the fabric damage may be provided and the rolling motion configured to improve the washing ability may be provided.

In the synthetic course and the mixture course, a circulating step may be synchronized with the drum driving to allow both of wash water and detergent to be supplied to the laundry continuously.

As mentioned above, although one of the cotton course, synthetic course or the mixture course is selected, the drum driving motions of the washing step may be controlled for a combination of different two motions. This is to generate diverse patterns of the mechanical force and the movement of the laundry and to improve the user's satisfaction visually.

When a contaminant level of the laundry is selected from the option selecting part 118, the net acting ratio of the motor may be adjusted according to the selected contaminant level. However, increasing the net acting ratio also increases the time in which the mechanical force is applied to the laundry. Considering that, the net acting ratio of the washing cycle may be differentiated according to the course selected by the user. That is, the net acting ratio of the cotton course may be larger than that of the synthetic course and mixture course.

I.2.2 Rinsing Cycle (S1750):

Once the washing cycle is completed, a rinsing cycle may start. In the rinsing cycle, rinsing steps configured to drain the wash water after the laundry is rinsed using supplied wash water may be repeated. The rinsing step of the rinsing cycle in this course may be repeated three times or more.

The wash water may be supplied for a water level of the rinsing cycle to be higher than a water level of the washing cycle. That is, the wash water may be supplied to a predetermined water level that is visible from the outside to improve the rinsing effect by using sufficient wash water.

A drum driving motion of the rinsing cycle may be the tumbling motion. The tumbling motion submerges/removes the laundry into/from the wash water and this may be repeated. The high water level together with the tumbling motion visually notifies the user of sufficient rinsing. The tumbling motion of the rinsing cycle may prevent overheat of the motor as well improve rinsing efficiency. That is, the water level of the rinsing cycle may be higher than that of the washing cycle and the load applied to the drum may be increased by the wash water accordingly. The step motion, scrub motion and the swing motion repeat the rotation and brake of the motor. As a result, such a brake may generate excessive load on the motor. Also, if the water level is high, the load generated by the wash water may be increased. In the rinsing cycle having a high water level, the drum driving motion does not have nay sudden brake to prevent the overheat of the motor. Thus, the tumbling motion configured to rotate the drum in the predetermined direction may be preferable in the rinsing cycle.

A circulating step may be implemented in the rinsing cycle to circulate the wash water held in the tub into the drum. This may generate an effect of visual notification to the user of sufficient rinsing.

I.3. Spinning Cycle (S1770):

Once the washing cycle and the rinsing cycle are completed, a spinning cycle configured to discharge the wash water from the laundry as much as possible may be implemented. In a normal spinning step of the spinning cycle, the drum RPM may be differentiated according to the course selected by the user, considering the percentage of water content and residual wrinkling according to the type of fabric.

Cotton fabric has a high percentage of water content or absorption, with less concern of wrinkles. Even if there are wrinkles generated in the cotton fabric, it is easy to remove the wrinkles. In contrast, the synthetic fabric has a low percentage of water content or absorption, with large concern of wrinkles. As a result, in the cotton course, a preset RPM may be higher than in the synthetic course and mixture course, and the preset RPM may be, for example, 1000 RPM or more. Here, the spinning RPM may be changeable via the option selecting part by the user.

The preset RPM of the synthetic course and the mixture course may be set to be 400 to 600 RPM. Even when spinning synthetic laundry items at a low RPM, the wash water may be discharged from the synthetic laundry items enough and wrinkles may be prevented. In this case, the spinning RPM may be changeable via the option selecting part by the user. In certain embodiments, the spinning RPM is set to a maximum of 800 RPM.

J. Course J (Wool Course):

A washing course provided according to a type of fabric of the laundry may also include a wool course, rather than the cotton course, synthetic course and mixture course. The wool course is applied to laundry having less contaminants and a large concern for fabric damage. That is, the wool course may be provided to wash wool fabric laundry items which are hand washable. If washed using the strong mechanical force, the wool fabric laundry items are likely to be damaged. As a result, in the wool course, the drum is driven in a predetermined motion having a weak mechanical force, for example, the swing motion. Considering characteristics of the wool fabric, drum driving motions of a washing cycle, a rinsing cycle and spinning cycle of the wool course may be different from the drum motion of the standard course.

J.1. Washing Cycle:

In the wool course, it is important to prevent fabric damage and the drum may be driven in the swing motion configured to move the laundry rightward and leftward in a lower portion of the drum gently, in a washing cycle of the wool course. In this case, a water level may be high enough to allow a water level of the drum inside to be visible from outside. Because of that, the friction between the inner circumferential surface of the drum and the laundry may be minimized and the lifts touching of the laundry may be repeated, rotating the laundry submerged in the wash water, and this prevents damage to the laundry and it allows washing or rinsing to be implemented softly. This swing motion may minimize damage to the laundry and increase the time of contact with the wash water and the detergent with the laundry to improve the washing effect.

Figure 18:
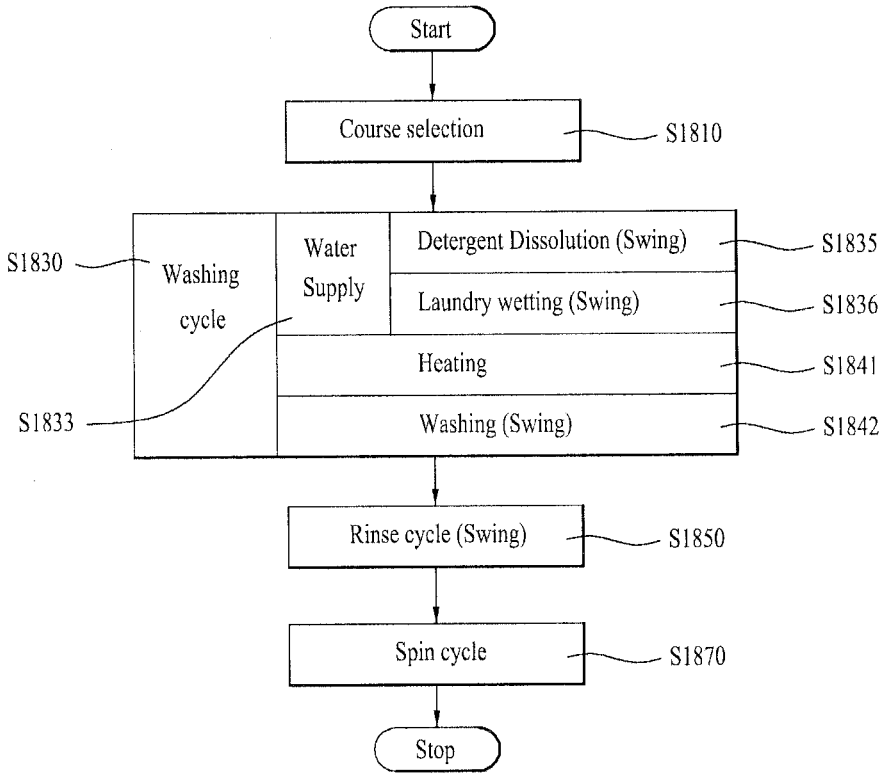

The wool course is shown in FIG. 18. A washing cycle of the wool course is selected (S1810). In an initial stage of the washing cycle (S1830), wash water and detergent may be supplied to the tub or the drum, that is, a water supplying step (S1833) may be implemented. The water supplying step may include a detergent dissolution promoting step (S1835) and a laundry wetting step (S1836). The detergent dissolution promoting step is configured to promote detergent dissolution implemented in an initial stage of the water supplying step and the laundry wetting step is configured to wet the laundry enough to prepare a washing step after the water supplying is completed. The laundry wetting step may be implemented after or before the water supplying is completed.

The detergent used in the wool course may be neutral detergent and typically a liquid type which may not require as much time to be dissolved in the wash water as a powder type. Considering that, the detergent is supplied to the laundry in the initial stage of the water supplying, together with the wash water. Once the water supply starts, wash water is supplied to the liquid detergent held in a detergent box. The wash water and the liquid detergent are supplied together to the tub or the drum. To supply the wash water and the liquid detergent to the laundry more quickly, the wash water and the liquid detergent mixed with each other may be sprayed onto the laundry located in the drum. For more effective detergent dissolution, a circulating step configured to supply the wash water held in the tub to the upper portion of the drum may be implemented.

The drum may be driven in the swing motion and then a gentle vortex is generated in the wash water such that the detergent dissolution may be promoted, while simultaneously preventing laundry damage. Once the water supply is completed, the swing motion and the circulating step may be implemented together to prepare for the washing step. This may be considered a type of laundry wetting step.

Once the detergent dissolution promoting step and the laundry wetting step are completed, a heating step (S1841) configured to heat the wash water may be implemented if necessary. However, the temperature of the wash water in the heating step my be controlled not to exceed 40° C. Heat generated if the temperature of the wash water is heightened too much will deform the laundry and damage wool fabric laundry. The temperature of 40° C. generates no thermal deformity and promotes activation of the detergent and wash water absorption into the laundry.

A drum driving motion of the washing step (S1842) may be the swing motion. The washing step requires the longest time out of the steps of the washing cycle and, in order to prevent laundry damage in the washing step, the swing motion is used in the washing step. If mechanical force application and stopping are applied to the wool fabric laundry repeatedly, fabric damage may be generated. Such mechanical repetition generates contraction of wool fabric. To prevent the contraction, the swing motion may be implemented in the washing step continuously.

As mentioned above, the swing motion drives the drum by using the rheostatic braking and it may not apply much load to the motor. In addition, the swing motion may have drum driving configured to reciprocate between right and left less than 90° C. As a result, a large load is not required to lift the laundry. If the drum were to be driven in the scrub motion and the step motion continuously, excessive load may be applied to the motor. In the tumbling motion, a smaller load may be applied to the motor than in the scrub motion and the step motion, but the laundry is lifted and dropped to generate fabric damage. Considering this, the swing motion is implemented in the washing step.

J.2 Rinsing Cycle (S1850):

Once the washing cycle is completed, a rinsing cycle may be implemented. First, a medium spinning may be implemented. After the medium spinning, wash water is supplied to start rinsing and the rinsing cycle is implemented several times if necessary. That is, after the water supplying and rinsing, water draining may be repeated. Typically, medium spinning is implemented in the middle of the water supplying after water draining.

The medium spinning disentangles the laundry at a relatively low rotation speed. Medium spinning includes an intermediate-spinning configured to disentangle the laundry at a relatively low rotation speed, while sensing vibration, and a main-spinning configured to spin the laundry at a relatively high rotation speed for a predetermined time. The intermediate-spinning may be implemented at approximately 100 RPM and the main-spinning may be implemented at approximately 200 RPM (low resonance frequency) or more.

However, when the wool course is selected, the medium spinning may be omitted. The medium spinning is a process of discharging the wash water from the laundry by centrifugal force and a tensile force may be generated in the laundry inevitably. Because of that, wool fabric laundry which is subject to external force may be subject to damage in the spinning cycle. To relieve such a concern, the medium spinning may be omitted. For example, the main-spinning of the medium spinning is omitted and only the intermediate-spinning may be implemented. If all of the process of discharging the wash water by the centrifugal force is omitted, the rinsing ability may be deteriorated remarkably. Considering the rinsing ability and the laundry damage, only the intermediate-spinning may be implemented and the main-spinning may be omitted.

The series of the rinsing step including the water supplying and draining may be implemented three times or more, because detergent remnants have to be sufficiently discharged from the laundry. The water level of the rinsing may be higher than the water level of the washing step and a circulating step may be implemented in the rinsing. When the liquid detergent is used, it is generally possible to discharge the detergent remnants sufficiently because of rinsing step is implemented two times and the medium spinning. However, in case of this course, the main-spinning of the medium spinning is omitted to prevent the laundry damage and the rinsing step may be implemented three times to achieve the desired rinsing effect.

A drum driving of the rinsing step may be the swing motion to prevent laundry damage. The swing motion gently swings the laundry in the wash water and allows detergent remnants absorbed in the laundry to be discharged into the wash water, such that rinsing efficiency may be enhanced.

J.3 Spinning Cycle (S1870):

Once the rinsing cycle is completed, a spinning cycle may start. The spinning cycle is similar to the spinning cycle of the standard course described above. the drum RPM of the normal spinning step may be set to be 800 RPM or less to protect the wool fabric of the laundry.

Figure 19:
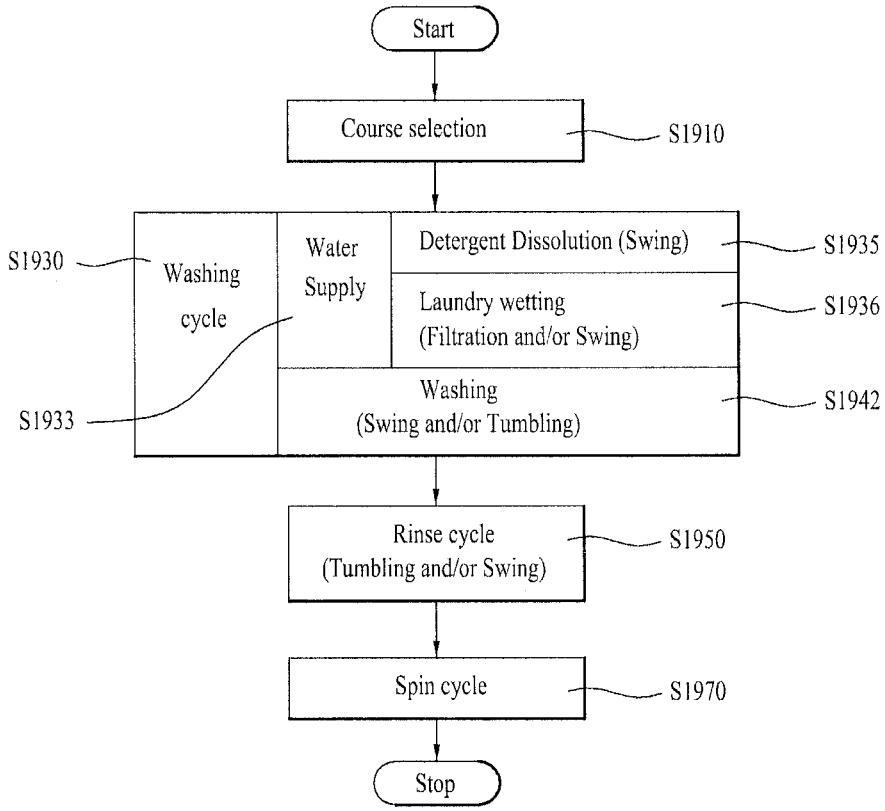
Figure 20:
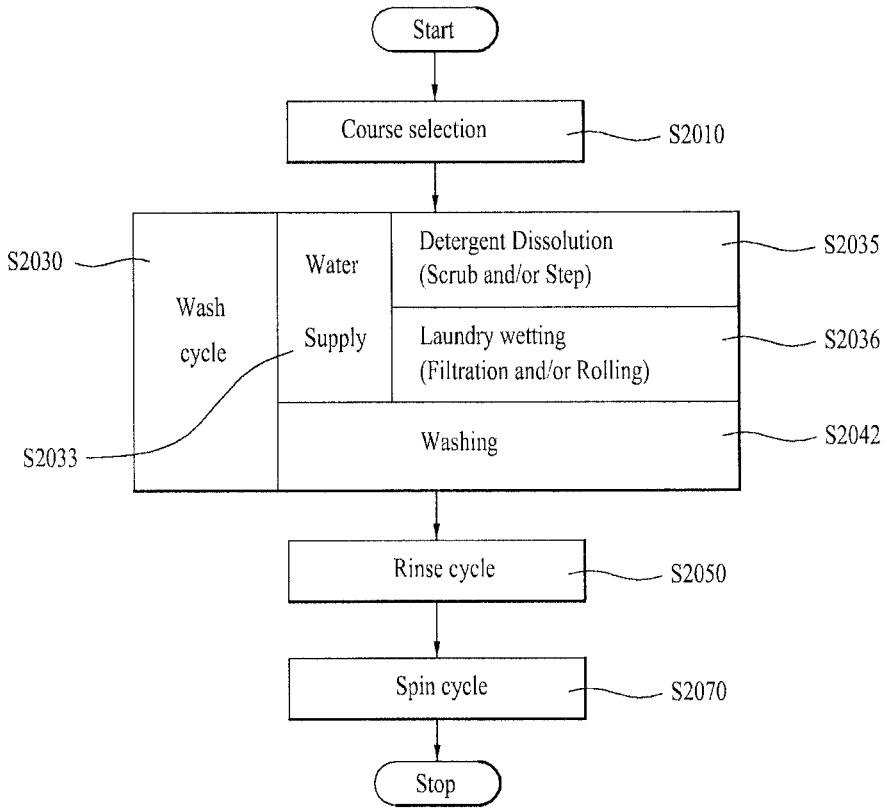

K. Course K (Delicate Course):

A washing course provided according to the type of fabric of the laundry may include a delicate course as shown in FIG. 19 to wash laundry items made of delicate fabric such as silk, plastic fabric, laundry items having metal accessories attached thereto and other such delicate articles. A drum motion having a relatively weak mechanical force, for example, the swing motion, may be implemented to wash the delicate laundry gently in the delicate course, similar to in the wool course. As a result, taking characteristics of the delicate fabric into consideration, drum driving motions of a washing cycle, a rinsing cycle, and a spinning cycle of the delicate course may be different from the drum driving motions of the standard course.

K.1 Washing Cycle (S1930):

Similar to the wool course, the delicate course is selected (S1910) and the drum is driven in the swing motion in a washing cycle (S1930) of the delicate course and wash water is supplied (S1933) to a relatively high water level. Also, a detergent dissolution promoting step (S1935) may be similar to the detergent dissolution promoting step of the wool course, because liquid type detergent is generally used to wash the delicate fabric laundry items in the delicate course, like in the wool course. However, after the detergent dissolution promoting step, a laundry wetting step (S1936) may be different from the laundry wetting step of the wool course. The wool fabric has relatively good water absorption ability in comparison to the delicate fabric, and the delicate fabric is more subject to heat damage in comparison to the wool fabric. Because of that, the temperature of the wash water used to wash the delicate fabric may be set to be approximately 30° C. Although cold water could be selected, a temperature higher than 40° C. is generally not selected.

The laundry wetting may be implemented effectively using the filtration motion in the laundry wetting step. A circulating step may also be implemented. After spin-driving the drum and distributing the laundry uniformly inside the drum to broaden the surface area of the laundry, the circulating step circulates the wash water held in the tub toward the laundry. In addition, the swing motion is implemented to submerge the laundry in the wash water and to generate gentle movement of the laundry to promote laundry wetting. The filtration motion and the swing motion are repeated in various patterns to promote laundry wetting. However, the drum driving motion of the laundry wetting step may be only the swing motion.

Once the laundry wetting is completed, a washing step may start (S1942). A drum motion of the washing step may be the swing motion. The delicate fabric may be more resistant to the external shock, compared with the wool fabric. To achieve more effective washing efficiency, the drum motion of the washing step may be a combination of the swing motion and the tumbling motion, with a relatively high wash water level.

Alternatively, only the tumbling motion may be implemented in the washing step. In this case, the dropping laundry is collided against the surface of the wash water, not the inner bottom surface of the drum because of the high water level. That means the dropping distance is reduced. While the shock applied to the laundry is reduced by the high water level, a vortex is generated in the wash water to improve the washing effect. Since such the laundry has relatively low contamination, the time of the washing step may be set to be relatively short and the net acting ratio may be set to be relatively low. Although only the tumbling motion is implemented, it is possible to prevent laundry damage. A circulating step may also be implemented in the washing step.

K.2 Rinsing Cycle (S1950):

Once the washing cycle is completed, a rinsing cycle may start. As mentioned above, the liquid type detergent may be used in the delicate course and detergent remnants may be sufficiently discharged by the rinsing step implemented two times. Like the wool course, a medium spinning may be omitted in the delicate course. For example, an intermediate-spinning is not omitted and only a main-spinning may be omitted. A drum motion of the rinsing cycle may be only the tumbling motion. Such the tumbling motion has the effect of laundry distribution. That is, the tumbling motion allows the surface area of the laundry to contact the wash water uniformly and discharge detergent remnants outside. In this case, a wash water level may be relatively high. The swing motion may be added to the tumbling motion in the rinsing cycle.

K.3 Spinning Cycle (S1970):

Once the rinsing cycle is completed, a spinning cycle may start. The spinning cycle of this course may be similar to that of the wool course. The drum RPM of a normal spinning step may be set not to exceed 800 RPM. The delicate fabric has a low percentage of water content/absorption and wash water may be discharged sufficiently even when the drum is rotated at a relatively low RPM in the normal spinning step. Also, the normal spinning may be implemented at a relatively low RPM to prevent fabric damage generated by spinning.

L. Course L (Sportswear Course):

A sportswear course shown in FIG. 2D may be provided in the washing course categorized based on the type of fabric of the laundry will now be described. The sportswear course may be provided to wash laundry items made of functional fabric having good air permeability and good perspiration absorbing function such as mountain-climbing clothes, jogging suits and sportswear. Like the wool course or delicate course, a drum motion having a weak mechanical force, for example, the swing motion, may be implemented in the sportswear course. Because of that, considering characteristics of sportswear fabric, drum motions of washing, rinsing and spinning cycles provided in the sportswear course may be different from the drum motions of the standard course. Once the sportswear course is selected (S2010), the washing cycle (S2030), rinsing cycle (S2050) and the spinning cycle (S2070) may be implemented like the wool course and the delicate course. However, because of the characteristics of the sportswear, the washing cycle of the sportswear course may be different from the washing cycle of the other courses described above.

L.1 Washing Cycle (S2030):

Sportswear has hydrophobic characteristics which prevent moisture from permeating into fabric easily. As a result, compared with other kinds of fabrics, the sportswear fabric has a low percentage of water content/absorption and thus water may be supplied to the sportswear fabric sufficiently and continuously in the washing cycle. For that, a drum driving motion of the washing cycle (S2030), especially, a water supplying step (S2033) provided in the washing cycle, may be different from the drum motion of the washing cycle in the other courses.

First, in this course, a drum driving motion of a detergent dissolution promoting step (S2035) may be the scrub motion and/or the step motion. The sportswear fabric has little concern of fabric damage, compared with the wool or delicate fabric, so the sportswear course may use the drum driving motion capable of applying a stronger mechanical force than the swing motion.

A laundry wetting step (S2036) of the sportswear course may be different from the wool course and the delicate course. Although it can prevent laundry damage, the swing motion fails to supply enough wash water to a folded portion of the laundry due to the hydrophobic characteristics of the sportswear fabric. Considering this, the filtration motion (including a circulating step) may be implemented in the laundry wetting step of the sportswear course. The filtration motion distributes the laundry inside the drum uniformly and supplies the wash water to the laundry uniformly. Together with the filtration motion, the rolling motion configured to turn over the laundry continuously may be implemented.

L.2 Rinsing Cycle (S2050):

A rinsing cycle of this course may similar to the rinsing cycles of the standard course, the wool course and the delicate course, and thus further detailed description thereof will be omitted.

L.3 Spinning Cycle (S2070):

A spinning cycle of this course may similar to the spinning cycles of the standard course, the wool course and the delicate course, and thus further detailed description thereof will be omitted.

M. Course M:

In the washing machine according to the second embodiment described above with respect to FIG. 2, the tub is directly fixed to the cabinet and the drum is provided in the tub. According to the second embodiment, the tub is fixed and only the drum vibrates. As a result, it is important to prevent the drum from contacting the tub when the drum is rotated and the distance between the tub and the drum may be larger than the distance in the washing machine according to the first embodiment shown in FIG. 1.

When the distance between the tub and the drum is large, the laundry loaded in the drum may not be wet sufficiently by the wash water supplied to the inside of the tub. Because of that, when the water is supplied in the washing machine according to the second embodiment, a circulating pump is put into operation to wet the laundry efficiently and the wash water supplied to the tub may be circulated. For example, the circulating pump may be continuously driven or driven at a predetermined interval, with the water supply valve being open.

In the washing machine according to the second embodiment, the drum is connected with the tub back 230. However, the tub back 230 is supported by the suspension unit via the bearing housing 400, not by the tub. Because of that, compared with the washing machine according to the first embodiment which includes the tub back directly connected to the tub to support the load of the drum, the degree of freedom of the drum provided in the washing machine according to the first embodiment may be relatively large and the front portion of the drum may have an increased degree of freedom.

However, when the water is supplied to the tub, a water supply line and a circulation line are used to supply the wash water from the front portion of the tub. As a result, the laundry located in the front portion of the drum would be wet first and the load on the front portion of the drum is larger than the load on the rear portion. This may cause the front portion of the drum to move downward. If the front portion of the drum moves downward, noise and vibration may be increased during rotation of the drum and may cause the drum to contact the inner surface of the tub. As a result, in the washing machine according to the second embodiment, the laundry located in the front portion and the rear portion of the drum should be wet uniformly when water is supplied to the laundry. Course M is referred to as a washing course applicable to the washing machine according to the second embodiment, namely, a standard course of the washing machine according to the second embodiment. This course will be described in reference to FIG. 21.

Figure 21:
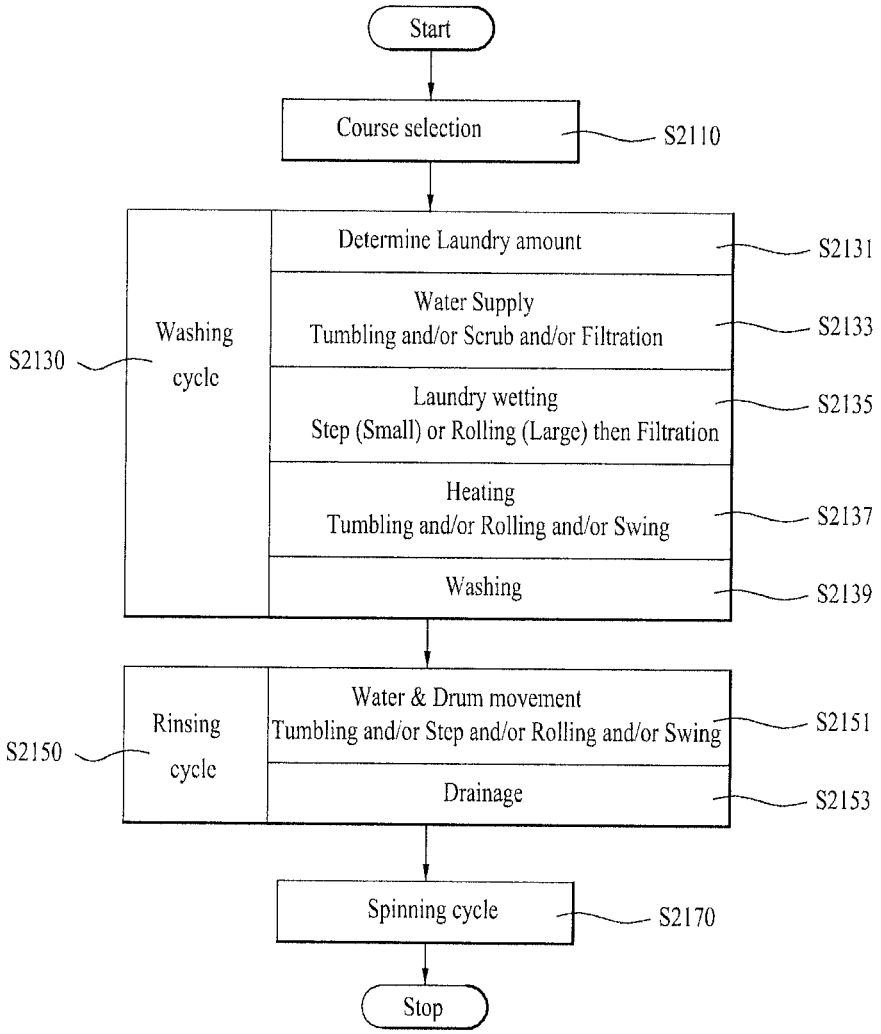

M.1 Washing Cycle (S2130):

FIG. 21 is a flowchart of Course M. Once the user selects this course from the course selecting part (S2110), the control part may implement the following series of processes.

The washing cycle may include a laundry amount determining step (S2131), a water supplying step (S2133), a laundry wetting step (S2135), a heating step (S2137) and a washing step (S2139). In the following description, the laundry wetting step is described as an independent step separated from the water supplying step. However, the laundry wetting step may be included in the water supplying step.

M.1.1 Water Supplying (S2133):

After sensing the amount of laundry in the washing cycle, a water supplying step may start. A laundry determining step of the water supplying step is described in detail in the above courses and thus further detailed description thereof will be omitted.

The control part supplies wash water to the inside of the tub in the water supplying step. Specifically, the control part opens the water supplying valve to supply wash water to the tub via the water supply line and the detergent box. As follows, when the wash water is supplied to the laundry in the washing machine according to the second embodiment, embodiments of water supplying methods capable of wetting the laundry located in the front portion and the rear portion of the drum uniformly will be described.

According to a water supplying method according to a first embodiment, when the water supplying step supplies water, the circulating pump is put into operation to circulate the wash water and the drum is put into operation simultaneously. The control part may drive the drum in the scrub motion of the drum motions described above.

In the washing machine according to the second embodiment, the distance between the drum and the tub is larger than the distance between the tub and the drum in the first embodiment. Thus, in the second embodiment, if the drum is driven in the tumbling motion (as in the first embodiment) during the water supplying step, the laundry located in the rear portion of the drum fails to be wet uniformly. That is, since the gap between the drum and the tub is larger, the wash water between the drum and the tub fails to be lifted by the rotation of the drum in the tumbling motion and especially, the laundry located in the rear portion of the drum fails to be wet.

As a result, in the water supplying step of this course, the scrub motion is implemented instead of the tumbling motion. As mentioned above, the scrub motion rotates the drum at a higher RPM (compared with the tumbling motion), and the wash water located between the drum and the tub may be lifted by the rotation of the drum and then dropped onto the laundry.

In particular, if the rear portion of the drum and the tub are tilted downward in the washing machine according to the second embodiment, the wash water located at the rear portion of the tub may be supplied to the surface area of the laundry by the scrub motion. The scrub motion rotates the drum in the clockwise/counter-clockwise direction, reversing the rotation direction suddenly. As a result, the sudden reversed-rotation of the drum generates a vortex in the wash water and the laundry located in the front and rear portions of the drum may be wet uniformly.

When the water supply valve is open to supply the wash water, the drum is driven and rotated and the laundry is moved inside the drum according to the driving of the drum. In this case, the wash water supplied via the water supply line connected to the front portion of the drum may be mostly supplied to the laundry moved in the front potion of the drum. The laundry located in the front portion of the drum is wet earlier, compared with the laundry located in the rear portion of the drum. As a result, according to the second embodiment of the water supply method, the drum may not be driven until a predetermined time passes after the water supply valve is open for the water supply, or until the water level reaches a predetermined level. When the drum is not driven for the predetermined time or until the wash water reaches the predetermined level, the wash water supplied via the water supply line may be held in the lower portion of the tub. The predetermined water level may be determined in consideration of the gap between the tub and the drum and the predetermined time may be determined according to the capacity of the tub and the drum and the amount of the laundry.

In particular, if the rear portion of the tub provided in the washing machine according to the second embodiment is tilted downward, much wash water may be collected in the rear portion of the tub. Hence, after a predetermined time passes, the drum is driven and rotated and the wash water held in the rear portion of the tub may wet the laundry located in the rear portion of the drum uniformly. When the drum is driven in the washing machine according to the second embodiment, a drum motion may be the tumbling motion or the scrub motion.

When the water supply valve is open for the water supply according to the second embodiment, without driving the drum, on/off of the water supply valve may be controlled. That is, when the water supply valve is open to supply the water, the wash water may have a predetermined pressure because of the pressure of an external water supply source such as a tap and then the wash water supplied along the water supply line may be supplied to the front portion of the drum by the water pressure, such that the laundry located in the front portion of the drum may be wet earlier.

As a result, during the water supply in the second embodiment, the water supply valve is repeatedly controlled to be on and off, not open continuously, and then the supplied wash water may be controlled to be on and off to have a predetermined water pressure enough not to be supplied to the drum directly. The pressure enough not to be supplied to the drum directly means a water pressure which enables the water supplied via the water supply line to fall along the drum, tub or door to be collected in the lower portion of the tub, not sprayed into the drum directly. The water falling along the drum, tub or door may be collected in the rear portion of the tub and description of the wash water collected in the tub is similar to the second embodiment, such that repeated description may be omitted.

When the laundry inside the drum is entangled during the water supplying step, the laundry may be wet partially. In particular, the laundry located in a center of a lump of the entangled laundry may not be wet and only the laundry located in a surface area of the lump may be wet. If only some of the laundry is wet, washing cannot be implemented in the washing cycle and a washing ability may be deteriorated. As a result, the control part may drive the drum in the filtration motion to wet the laundry uniformly if the laundry is entangled.

That is, the control part opens the water supply valve for the water supply and it drives the circulating pump to circulate the wash water simultaneously. Also, the control part rotates the drum at a predetermined RPM. The predetermined RPM is determined to be a RPM enabling the laundry not to be dropped by the gravity but to be in close contact with the inner surface of the drum during the rotation of the drum. As a result, the predetermined RPM may be set for the centrifugal force generated by the rotation of the drum to be larger than the gravity acceleration when the drum is rotated. In addition, the predetermined RPM may be set to be lower than an over speed area (approximately 200 RPM to 35 RPM) which generates resonance in the washing machine. If the drum is rotated at a higher RPM than the over speed area, the noise and vibration may be increased remarkably by the resonance. As a result, the predetermined RPM may be set to be approximately 100 RPM to 170 RPM in this control method.

As a result, once the control part rotates the drum at the predetermined RPM, the laundry may be in close contact with the inner surface of the drum due to the centrifugal force. The wash water supplied via the circulation line and the water supply line may be distributed along the rotation of the drum. The distributed wash water may be supplied to the drum and to the laundry in close contact with the inner surface of the drum, such that the laundry may be uniformly wet.

M.1.2 Laundry Wetting (S2135):

After the water supplying step, the control part may start a laundry wetting step. In the laundry wetting step, the control part turns off the water supply valve. The control part drives the drum and the wash water is circulated, while driving the circulation pump. Although the laundry wetting is implemented in the water supplying step, the water supply valve is off in the laundry wetting step and the laundry wetting may be implemented by the driving of the drum.

In the laundry wetting step of this course, the control part drives the drum to implement the laundry wetting. In this case, the control part may drive the drum in the rolling motion. Since the rolling motion rolling-moves the laundry inside the drum along with the rotation of the drum, the wash water contacts the laundry frequently and the laundry wetting may be implemented smoothly.

When implementing the laundry wetting step, the control part classifies the laundry wetting step into first and second laundry wetting steps. The first and second laundry wetting steps may be driven according to drum motions of the drum/that is, the control part may control the drum motions of the first and second laundry wetting step to be different from each other. Operating the circulating pump is as follows.

Specifically, in the first laundry wetting step, the control part may drive the drum in one of the rolling and/or step motions. The selection of the drum driving motions may be determined according to the laundry amount. That is, if the amount of the laundry inside the drum is less than a predetermined reference value, for example, if the laundry amount is small, the control part may drive the drum according to the step motion. If the laundry amount is the reference value or more, the control part may drive the drum according to the rolling motion.

As mentioned above, if the laundry amount is small, the laundry dropping effect of the step motion may be improved. As a result, if the laundry amount is small in the first laundry wetting step, the step motion drops the laundry with the maximum dropping distance to allow the water absorbed in the laundry. In the meanwhile, if the laundry amount is large in the first laundry wetting step, the rolling motion is implemented. This is because the laundry dropping distance of the step motion is not relatively large in case of the large amount of the laundry.

Hence, in the second laundry wetting step, the control part may drive the drum at a predetermined RPM enabling the laundry to be in close contact with the inner surface of the drum, not dropped by the gravity, that is, according to the filtration motion. Eventually, the drum is rotated at the predetermined RPM and the laundry may be in close contact with the inner surface of the drum due to the centrifugal force. The wash water supplied by the circulating pump is supplied to the laundry attached to the inner surface of the drum uniformly and thus the laundry may be wet uniformly.

In the second laundry wetting step, the control part may implement another drum driving motion after the filtration motion. For example, the control part may implement the rolling motion after the filtration motion. In this case, the filtration motion distributes the laundry to supply the wash water to the laundry and the rolling motion rolling-moves the laundry to wet the laundry in the wash water uniformly.

M.1.3 Heating (S2137):

After that, the control part starts a heating step. Specifically, the control part drives the drum according to one of the tumbling and/or rolling and/or swing motions in the heating step, with driving the heater provided in the tub to heat the wash water held in the tub.

In the washing machine of the second embodiment, the gap between the drum and the tub is larger than the gap of the first embodiment. Because of that, when the wash water is heated by driving the heater, the drum is rotated and only the wash water held in the tub is heated, not the wash water held in the drum. As a result, compared with the heated wash water, contaminants of the laundry may not be removed smoothly in a washing step, which will be described later, because of the relatively low temperature of the laundry.

Because of that, the control method applied to the washing machine according to the second embodiment drives the circulating pump in the heating step, to circulate the wash water. The heated-wash water held in the tub is re-supplied to the top portion of the tub by the circulating pump such that the laundry may be heated. However, in the heating step, the circulating pump may be intermittently driven at a predetermined interval, not continuously driven. In particular, in the heating step, the circulating pump may be controlled so that the off-time of the circulating pump is longer than the on-time. If the circulating pump is driven continuously in the heating step or if the on-time of the circulating pump is longer than the off-time, the wash water not heated to the predetermined temperature would be circulated and the wash water may not be heated to the desired temperature.

If the heater is provided in the tub, it is important to drive the heater when not exposed out of the water surface. If the heater is driven while exposed, too much load is applied on the motor and the heater may malfunction. As a result, if the heater is driven in the heating step, a predetermined water level distant from the heater (hereafter, reference water level) may be maintained in the heating step. That is, when the water level is less than a reference level in the heating step, the control part turns off the heater. When the water level increases to the predetermined level or more by the re-water-supply, the control part turns on the heater again (hereinafter, 'cut off').

However, if the heating step uses the cut-off method in the washing machine according to the second embodiment, too much load may be applied to the heater and a variety of circuits and washing machine usage life may be reduced.

That is, the heating step of the washing machine according to the second embodiment drives and heats the heater, while driving circulating pump simultaneously as mentioned above. As a result, the water level inside the tub may not be maintained regularly by the driving of the circulation pump but may vary to a predetermined degree continuously. In this case, the water level inside the tub is varied enough to be lowered below the reference water level. Especially, if the water level inside the tub is varied beyond the reference level, the heater may be turned on if the water level is beyond the reference level and turned off if the water level is below the reference value, such that on/off of the motor may be repeated continuously. The repeated on/off of the heater may apply too much load to the heater and the variety of the circuits and it may reduce usage life.

As a result, if the water level inside the tub is decreased to reach the reference level during the driving of the motor in the heating step of the washing machine according to the second embodiment, water re-supply may be implemented to prevent repeated on/off of the heater. Specifically, when the water level inside the tub is decreased below the reference level in the heating step, the control part stops the driving of the drum and turns off the circulating pump. At this time, additionally, the water supply valve is open to implement water re-supply. The reason why the drum and the circulating pump are turned off is that it is difficult to sense an accurate water level due to the varying water level when the drum and the circulating pump are driven. By extension, it is possible to turn off the motor. In the meanwhile, the water re-supply may be implemented for a predetermined time or until the water supply is implemented for the water level to reach the reference level or beyond the reference level by the water level sensing. A specific water level of the water re-supply may be differentiated according to the kind of course selected in the initial stage of heating.

M.1.4 Washing (S2139):

After the heating step, the control part may implement a washing step configured to drive the circulating pump, while driving the drum. In the washing step, a drum driving motion of the drum may be properly selected out of the drum motions according to the course selected by the user. For example, a drum driving motion of the washing step may be determined, similar to one of the washing steps provided in the above courses. The circulating pump may be driven at a predetermined interval to circulate the wash water held in the tub.

M.2 Rinsing Cycle (S2150):

Once the washing cycle is completed after the above steps, the control part may start a rinsing cycle. The general rinsing cycle may include a rinsing-spinning step, a water supplying step, a drum driving step and a water draining step. First, the control part starts the rinsing-spinning, rotating the drum at a second rotation speed (RPM 2) (S2151), in the rinsing-spinning step, to remove moisture and detergent remnants remaining in the laundry, while rotating the drum at approximately 500 RPM to 700 RPM. The control part stops the drum and opens the water supply valve, to supply rinsing-water to the tub. The rinsing water level may be preset according to the course selected by the user or according to the user's manual setting.

After the water supply, the control part drives the drum at a first rotation speed (RPM 1) at a predetermined interval. In the drum driving step, the control part controls a drum driving motion of the drum and removes detergent from the laundry. The control part of this step may control the drum to be one of the tumbling and/or step and/or scrub and/or rolling and/or swing motions described above.

Hence, the control part stops the driving of the drum and drives the water drainage pump to drain the rinsing water held in the tub to the outside (S2153).

The rinsing-spinning cycle, water supplying step, water supplying step, drum driving step and draining step described above may compose a single cycle of the rinsing cycle. The control part may implement the cycle one time or several times according to the selected course or the user's selection. However, the single cycle of the rinsing cycle may include the rinsing-spinning step. The second rotation speed of the rinsing-spinning step may correspond to approximately 500 RPM to 700 RPM, as mentioned above, and the rotation speed of such the rinsing-spinning may correspond to the over speed area (approximately 200 RPM to 350 RPM) which generates resonance of the washing machine.

As a result, if the laundry located in the drum is not distributed uniformly, a laundry distributing step configured to distribute the laundry may be implemented and after that, the drum speed may be accelerated for the rinsing-spinning. The laundry distributing step repeatedly rotates the drum at the predetermined RPM in the clockwise and/or counter-clockwise direction. After the laundry distributing step, an eccentricity level of the drum is identified. f the eccentricity level of the drum is less than a predetermined value, the rinsing-spinning may be implemented. If the eccentricity level is the predetermined value or more, the laundry distributing step may be repeated. As the laundry distributing step is implemented before the rinsing-spinning step, the time of the rinsing cycle may be increased. In particular, as the laundry distributing step is repeated, the time of the rinsing cycle may be increased noticeably and the time consumed by the rinsing cycle cannot be predicted accurately.

As follows, to solve the above problem, a control method of the rinsing cycle capable of reducing the overall time consumed by the rinsing cycle will be described.

As shown in FIG. 21, the rinsing cycle of the washing machine according to the second embodiment may include a washing water supplying step, a drum driving step (S2151) and a water draining step (S2153). Compared with the first embodiment, the rinsing cycle according to the second embodiment omits a rinsing-spinning step. Since the rinsing-spinning cycle is omitted, the time of the rinsing cycle may be reduced as much as the time of the rinsing-spinning step and the laundry distributing step may not be necessary, thus preventing noticeably increased time of the rinsing cycle caused by the repetition of the laundry distributing step. Although omitting the rinsing-spinning step reduces the time of the rinsing cycle, the rinsing-spinning step configured to remove detergent remnants by rotating the laundry at the relatively high speed is omitted and then it would be difficult to remove the detergent remnants sufficiently.

As a result, in the control method of the rinsing cycle according to the second embodiment, the drum is rotated at the second rotation speed (RPM 2) for approximately 1 to 3 minutes, and not stopped in the water draining step. The second rotation speed is determined to be a predetermined speed that allows the laundry to be attached to the inner surface of the drum due to gravity, and not dropped, during the rotation of the drum. The second rotation speed may be set for the centrifugal force generated by the rotation of the drum to be larger than the gravity acceleration. Also, the second rotation speed may be set to be lower than the over speed area of the washing machine. If the drum is rotated over the overspeed area, the resonance may increase the noise and the vibration remarkably. As a result, the second rotation speed may be set to be approximately 100 to 170 RPM.

Eventually, the draining step rotates the drum at the predetermined speed and thus the laundry may be in close contact with the inner surface of the drum due to the centrifugal force so as to remove detergent remnants from the laundry. Compensating for the omitted rinsing-spinning step, the draining step rotes the drum at the second rotation speed to prevent deterioration of the rinsing ability.

In the step of rotating the drum at the second rotation speed (the predetermined speed that allows the laundry to be in close contact with the inner surface of the drum), if the water held in the tub is drained, all of the draining steps may be implemented before the rinsing cycle. That is, even if the water is drained in the washing cycle, the step of rotating the drum at the predetermined RPM may be implemented.

M.3 Spinning Cycle (S2170);

A spinning cycle of this course may be similar to the spinning cycles of the other courses, for example, the spinning cycle of Course A. Thus, further detailed description thereof will be omitted.

Course M described above may be applied to the washing machine according to the second embodiment. However, Course M may also be applied to the washing machine according to the first embodiment. That is, Course M may be applicable to any of the washing machines according to the first and second embodiments.

N. Time Management Option:

A time management option will now be described. Generally, once a specific course is selected, an operation of the selected course starts based on a preset algorithm and the operation finishes in a predetermined amount of time. The operation time required to implement the course may be to the total of the times required by the individual cycles composing the course. This total operation time may be displayed on the display part 119.

In certain circumstances, the operation time may be too long. For example, if the user has to leave in 1 hour and the preset operation time is 1 hour and 20 minutes, the operation time is 20 minutes longer than desirable to the user. In contrast, severe contamination may make the washing operation implemented for 1 hour and 20 minutes not sufficient to wash the laundry. To solve the problem, a washing machine and control method thereof capable of managing time are provided.

The washing machines described above may include a time management option provided to manage time. That is, the operation time of a specific course may be increased or decreased via the option part. Specifically, the user may select a time save option from the time manage option. Alternatively, the user may select an intensive option via the time manage option. If no such options are selected, the operation may be implemented according to the preset course. This time manage selection may be implemented before the washing cycle starts and after selecting the operation course.

For example, when the user selects the time save option if the operation time of the cotton course is 120 minutes, the required operation time may be reduced to, for example, 100 minutes. When the user selects the intensive option, the operation time may be increased to 140 minutes to ensure sufficient cleaning of heavily contaminated laundry items. There may be a predetermined difference between the preset time and the actually required time.

The required time of the washing cycle and/or the rinsing cycle may be changeable according to the selection of the time save option. That is, the cycle whose required operation time is changed/adjusted may be different depending on the selected course. For example, in case of the cotton course, the synthetic course and the mixture course, it is important to improve the washing ability. Because of that, the required time of the normal washing cycle may not be changeable even if the time save option is selected. Thus, the required time of one of the components of the rinsing cycle may be considered for adjustment.

The rinsing cycle repeats the water supplying, water draining and spinning. The rinsing may be implemented two times, three times or four times. The spinning may be implemented in the same order of the spinning cycle, with the RPM and the time of the main-spinning less than those of the spinning cycle. As a result, when the time save option is selected, the main-spinning of the rinsing cycle may be omitted.

When the time save option is selected, the laundry amount determining step may be omitted, depending on the selected course. For example, when the wool, delicate or sportswear course is selected, the amount of this special fabric is relatively small. If such the fabric items get contaminated, the user tends to wash them immediately. As a result, it is rare to wash a large amount of these types of laundry items in a single course operation. Considering that, the laundry amount determining step may be omitted when the wool, delicate or sportswear course is selected.

In contrast, when the intensive option is selected, the number of rinsing implementations in the rinsing cycle or the required time of the washing cycle may be increased, or both may be increased.

This time management option satisfies the object of the specific course and allows the user to manage time conveniently.

IV. Drum Driving Motion According to Course and Step of Course

A drum driving motion according to each cycle of each course will now be described. As mentioned above, the drum driving motion includes a combination of the drum rotation direction and the drum rotation speed, and differentiates the dropping direction and the dropping point of the laundry located in the drum to compose the different drum motions. These drum driving motions may be implemented under the control of the motor.

Since the laundry is lifted by the lift provided at the inner circumferential surface of the drum during the rotation of the drum, the rotation speed and the rotation direction of the drum are controlled to differentiate the shock applied to the laundry. That is, the mechanical force including friction between laundry items, friction between the laundry and the wash water and the dropping shock may be differentiated. In other words, a laundry striking or scrubbing level may be differentiated to wash the laundry, and a laundry distribution level or a laundry turning-over level may be differentiated.

As a result, a drum driving motion may be differentiated according to each cycle composing various washing courses and each specific step composing each cycle so that the laundry may be treated by an optimized mechanical force. Because of that, washing efficiency may be improved. In addition, a single fixed drum driving motion may result in excessive washing time. A drum driving motion for each cycle will now be described.

1. Washing Cycle:

A washing cycle includes a laundry amount determining step, a water supplying step and a washing step. The water supplying step includes a detergent dissolution promoting step configured to dissolve detergent and a laundry wetting step configured to wet the laundry. The detergent dissolution promoting step and the laundry wetting step may be provided independently, separate from the water supplying step. A heating step may be further provided according to each course.

1.1. Laundry Amount Determining:

Electric currents used to rotate the drum are measured to implement the laundry amount determining step. In this case, when the drum is rotated in a predetermined direction, the consumed currents are measured, and the drum may be driven according to a single rotation motion, for example, the tumbling motion, in the laundry amount determining step.

1.2 Water Supplying:

In a water supplying step, wash water is supplied together with detergent and a step of dissolving the detergent may be implemented. To improve the efficiency of the washing cycle, detergent dissolution may be completed effectively in an initial stage of the water supplying step. To dissolve the detergent in the wash water quickly, a motion configured to apply a strong mechanical force may be effective. That is, a strong mechanical force is applied to the wash water to dissolve the detergent in the wash water more effectively. As a result, in the detergent dissolution promoting step, the drum is rotated according to the step motion and/or the scrub motion. As mentioned above, the step motion and the scrub motion rotate the drum at relatively high speed, applying a sudden brake to the drum to change directions, and a strong mechanical force may be provided. A combination of the step motion and the scrub motion may be possible in this step.

In the laundry wetting promoting step, it is important to wet the laundry in the wash water mixed with the detergent. In this case, a drum driving motion may be the filtration motion. Alternatively, the filtration motion and the rolling motion may be implemented sequentially. The rolling motion continuously turns over the laundry to enable the wash water held in the lower portion of the drum to contact with the laundry uniformly and is proper in laundry wetting. The filtration motion broadens the laundry during the rotation of the drum to bring the laundry into close contact with the inner circumferential surface of the drum, while spraying the wash water into the drum simultaneously, such that the wash water may be discharged from the tub via the laundry and the through holes of the drum due to the centrifugal force. As a result, the filtration motion broadens the surface area of the laundry and allows the wash water to pass through the laundry. Because of that, an effect of supplying the wash water to the laundry uniformly may be achieved. Also, to use such the effect, different two drum driving motions, that is, the filtration motion and the rolling motion are repeated sequentially in the laundry wetting promoting step. If the laundry amount is a predetermined value or more, the laundry wetting effect may be deteriorated in the rolling motion having the relatively low rotation speed of the drum, and thus the tumbling motion having a relatively high rotation speed of the drum may be implemented instead of the rolling motion.

However, the detergent dissolution promoting step or the laundry wetting step of the water supplying step may be classified according to the driving motion of the drum when the wash water is continuously supplied. As a result, it is difficult for the user to distinguish the above steps in the water supplying step. From the view of the user, it seems that the drum is driven according to one of the rolling and/or tumbling and/or step and/or scrub motions in the water supplying step, or a combination of two or more of the motions.

According to the type of fabric of the laundry, there may be courses configured to prevent laundry fabric damage. Also, according to the course, there may be courses configured to suppress noise generation when the laundry is washed based on the courses. When the drum is driven according to the motion capable of applying a strong mechanical force in the water supplying step, laundry fabric damage or noise generation may be difficult to avoid, in general. As a result, in the water supplying steps, motions capable of reducing the noise generation as much as possible or preventing fabric damage are provided. In these courses, the detergent dissolution effect and laundry wetting effect are achieved so that, in these courses, the drum may be driven in the swing motion or the time of the rolling motion may be increased.

The swing motion may minimize the motion of the laundry inside the drum, compared with the other motions, and it may minimize fabric damage generated by the friction of laundry items and the friction between the laundry and the drum. In addition, the rolling motion induces the rolling-movement of the laundry along the inner surface of the drum, and does not generate shock generated by the sudden dropping of the laundry.

If the detergent dissolution and the laundry wetting are implemented in the water supplying step, a circulating step configured to circulate the wash water may be provided in at least predetermined step. Such a circulating step may be implemented over the water supplying step or in a predetermined stage of the water supplying step.

1.3 Heating:

In a heating step, a drum driving motion configured to transmit heat generated while the heater provided in the tub heats the wash water to the laundry may be provided. In the heating step, the drum is driven according to the tumbling motion configured to rotate the drum in the predetermined direction continuously. If the rotation direction of the drum is changed, a vortex is generated in the wash water and heat transmission efficiency may be deteriorated. f the laundry amount is less than a predetermined laundry amount level, the drum is driven in the rolling motion. If the laundry amount is the predetermined laundry amount level or more, the drum is driven in the tumbling motion. The rolling motion can heat the laundry sufficiently if the laundry amount is less than the predetermined level. If the laundry amount is the predetermined level or more, the tumbling motion configured to rotate the drum at the relatively high speed may be proper.

1.4 Washing:

A washing step may take the longest time of the washing cycle. In the washing step, contaminants of the laundry may be substantially removed and a drum driving motion of the washing step may be a motion capable of moving the laundry in various patterns. For example, the drum driving motion of the washing step may be one of, or a combination of, the step motion and/or the tumbling motion and/or the rolling motion. Such a combination of the motions can apply a strong mechanical force to the laundry. Especially, in the case of a small amount of the laundry, a combination of these motions may be effective.

The drum driving motion of the washing step may be a combination of the filtration motion and the tumbling motion. Such a drum driving motion can supply wash water to the laundry continuously to improve washing efficiency and can apply mechanical force to the laundry uniformly to improve washing efficiency. Such a combination may be effective with a large amount of laundry.

A heating step is provided before the washing step and the wash water may be heated in the washing step to improve washing efficiency. If the wash water is heated, drum driving motions may be combined. For example, if the heater provided in the tub is driven to heat the wash water, the drum may be driven according to a drum driving motion having no sudden-brake.

As mentioned above, in the courses configured to prevent fabric damage and to suppress noise generation, a motion capable of applying a relatively weak mechanical force to the laundry may be provided in the washing step. For example, the washing steps of the above courses, the swing motion may be implemented to reduce noise generation and prevent fabric damage. As a result, the operation time of the swing motion may be longer than the other motions in the course. If the washing step is implemented by only the swing motion, the washing efficiency may be deteriorated and a motion having a strong mechanical force may be additionally provided. The operation time of the motion having the strong mechanical force may be set to be shorter than that of the motion having the weak mechanical force.

2. Rinsing Cycle:

In the rinsing cycle, water supplying, drum driving and draining steps are repeated to rinse contaminants attached to the laundry or detergent remnants. As a result, a drum driving motion of the rinsing cycle may be a motion capable of generating a scrubbing-like effect. Fore example, the drum driving motion of the rinsing cycle may be the scrub motion and/or the swing motion. Both the scrub motion and the swing motion have the effect of scrubbing and swinging the laundry in the wash water continuously, to improve rinsing ability.

When the drum is driven in the rinsing cycle, a circulating step configured to circulate the wash water held in the tub into the drum inside and the filtration motion may be implemented together. That is, the wash water is sprayed into the drum and the laundry is rinsed by the flowing water. The filtration motion generates a strong centrifugal force and may separate the detergent and contaminants of the laundry from the laundry, together with the wash water.

In the rinsing cycle, wash water may be drained together with bubbles by using mechanical force applied to the laundry during the draining and/or intermediate-spinning. As a result, the drum is driven in the step motion or tumbling motion. By dropping the lifted laundry, the washing efficiency may be improved and the bubbles may be removed smoothly. The drum driving motion may be differentiated according to the laundry amount. That is, in the case of a small amount of laundry, the step motion is implemented to generate a maximum dropping distance. In the case of a large amount of laundry, the tumbling motion is implemented.

As mentioned above, in the courses selected to prevent fabric damage or to suppress noise generation, the motion capable of applying a relatively weak mechanical force to the laundry may be provided in the rinsing cycle. For example, the swing motion may be provided in the rinsing cycles of the courses. In the course selected to reduce washing time, it is possible to reduce the time of the rinsing cycle. For example, the filtration motion consumes a relatively large amount of time and thus the filtration motion may be omitted in the drum driving step of the rinsing cycle in the case of a course selected to reduce the overall washing time.

3. Spinning Cycle:

In a spinning cycle, the drum is rotated at a predetermined speed or higher to remove moisture contained in the laundry and the spinning cycle may include a laundry disentangling step and an eccentricity measuring step to accelerate the rotation speed of the drum to a predetermined RPM. A proper drum driving motion may be selected according to the object of each step. For example, it is advantageous in the laundry disentangling step to apply a relatively strong mechanical force to the laundry. If a motion capable of applying a strong mechanical force is provided in the prior rinsing cycle, even a motion having a weak mechanical force is sufficient. Also, to measure the eccentricity accurately, a drum driving motion configured to rotate the drum in a single direction continuously may be appropriate in the eccentricity measuring step.

V. New Courses

In describing the various courses, each course includes a washing cycle, a rinsing cycle and a spinning cycle. However, it is possible to omit a single cycle from each course according to the user's selection. That is, it is possible to omit the washing cycle from Course A (Standard Course) or to omit the rinsing cycle from Course B (Heavy Contaminant Course) or to omit the spinning cycle from Course C (Quick Boiling Course). By extension, one of the cycles provided in each course may be set as an auxiliary course. Fore example, the washing cycle of course F (Functional Clothing Course) may be set as single new course. In this case, it may be referred to as 'functional clothing washing'. Rather than the washing cycle, the rinsing cycle or the spinning cycle provided in each course may be set as new course.

Although the washing cycle, the rinsing cycle and the spinning cycle are described in a particular order to explain each of the courses, such cycles of one course may be combined with cycles of another course to establish new course. For example, the rinsing cycle and the spinning cycle of Course A (Standard Course) may be combined with the washing cycle of Course B (Heavy Contaminant Course) and set as a new course. Alternatively, each cycle may be taken out of the other courses. For example, the rinsing cycle of course A (Standard Course) and the spinning cycle of Course M may be combined with the washing cycle of Course B (Heavy Contaminant Course) and set as a new course. In this case, steps configured to connect the cycles may be adjusted or changed as appropriate.

Further, new course can be made based on efforts and conditions of laundry. FIGS. 22 to 24 illustrates the steps, effects and conditions used to determine the motions for standard course, strong motion course (heavy contaminant course, quick boiling course and cool wash course) and weak motion course (color, delicate or wool course). Based on desired effects and conditions, the motions of the drums can be selected interchangeable between standard course, strong motions course and weak motion course to create new programs. The present disclosure and features can be further applied to motion of the drum of a dryer, which, for example, are disclosed in US Patent Pub. Nos. 2009/0126222, 2010/0005680 and 2010/0162586, whose entire disclosure is incorporated herein by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of operating a laundry machine having a rotatable drum, comprising:

defining a plurality of drum motions based on drum speed, drum rotational direction, amount of drum rotation, change in drum rotational direction, and amount of force greater than zero required to overcome drum momentum and change drum direction;

selecting at least three drum motions of the plurality of drum motions based on at least one of a plurality of washing conditions or a selected washing course; and operating the laundry machine based on the selected at least three drum motions, wherein selecting at least three drum motions comprises selecting at least three of:

a step motion for a maximum falling and striking effect on laundry items received in the drum;

a rolling motion for a friction effect on laundry items received in the drum;

a scrub motion for a friction effect on laundry items received in the drum that is greater than that provided by the rolling motion;

a tumbling motion for a disentangling effect on laundry items received in the drum;

a filtration motion for a squeezing and circulating effect on laundry items received in the drum; or a swing motion for a minimal falling and striking effect on laundry items received in the drum.

2. The method of claim 1, wherein the plurality of washing conditions comprises an amount of laundry, a type of laundry, a washing water temperature, a soil level, or a detergent type.

3. A method of operating a laundry machine having a rotatable drum, comprising:

defining a plurality of drum motions based on drum speed, drum rotational direction, amount of drum rotation, change in drum rotational direction, and amount of force greater than zero required to overcome drum momentum and change drum direction;

selecting at least three drum motions of the plurality of drum motions based on at least one of a plurality of washing conditions or a selected washing course; and operating the laundry machine based on the selected at least three drum motions, wherein selecting at least three drum motions comprises:

selecting a tumbling motion, comprising rotating the drum at a first predetermined rotational speed;

selecting a rolling motion, comprising rotating the drum at a second predetermined rotational speed that is less than the first predetermined rotational speed; and selecting at least one of:

a step motion, comprising rotating the drum at a third predetermined rotational speed that is greater than the first and second predetermined rotational speeds, pausing rotation of the drum at a first predetermined position for a predetermined period, and resuming rotation of the drum at the third predetermined rotational speed;

a swing motion, comprising rotating the drum in a first direction at a fourth predetermined rotational speed until the drum reaches a second predetermined position, thereafter rotating the drum in a second direction opposite the first direction at the fourth predetermined rotational speed until the drum reaches a third predetermined position, and thereafter rotating the drum in the first direction at the fourth predetermined rotational speed;

a scrub motion, comprising rotating the drum in the first direction at a fifth predetermined rotational speed until the drum reaches a fourth predetermined position, thereafter rotating the drum in the second direction at the fifth predetermined rotational speed until the drum reaches a fifth predetermined position, and thereafter rotating the drum in the first direction at the fifth predetermined rotational speed; or a filtration motion, comprising rotating the drum at a sixth predetermined rotational speed.

4. A method of operating a laundry machine having a rotatable drum, comprising:

defining a plurality of drum motions based on drum speed, drum rotational direction, amount of drum rotation, change in drum rotational direction, and amount of force greater than zero required to overcome drum momentum and change drum direction;

selecting at least three drum motions of the plurality of drum motions based on at least one of a plurality of washing conditions or a selected washing course; and operating the laundry machine based on the selected at least three drum motions, wherein selecting at least three drum motions comprises:

selecting a tumbling motion, comprising rotating the drum at a first predetermined rotational speed;

selecting a filtration motion, comprising rotating the drum at a second predetermined rotational speed; and selecting at least one of:

a step motion, comprising rotating the drum at a third predetermined rotational speed that is greater than the first and second predetermined rotational speeds, pausing rotation of the drum at a first predetermined position for a predetermined period, and resuming rotation of the drum at the third predetermined rotational speed;

a swing motion, comprising rotating the drum in a first direction at a fourth predetermined rotational speed until the drum reaches a second predetermined position, thereafter rotating the drum in a second direction opposite the first direction at the fourth predetermined rotational speed until the drum reaches a third predetermined position, and thereafter rotating the drum in the first direction at the fourth predetermined rotational speed; or a scrub motion, comprising rotating the drum in the first direction at a fifth predetermined rotational speed until the drum reaches a fourth predetermined position, thereafter rotating the drum in the second direction at the fifth predetermined rotational speed until the drum reaches a fifth predetermined position, and thereafter rotating the drum in the first direction at the fifth predetermined rotational speed.

5. A method of operating a laundry machine having a rotatable drum, comprising:

defining a plurality of drum motions based on drum speed, drum rotational direction, amount of drum rotation, change in drum rotational direction, and amount of force greater than zero required to overcome drum momentum and change drum direction;

selecting at least three drum motions of the plurality of drum motions based on at least one of a plurality of washing conditions or a selected washing course; and operating the laundry machine based on the selected at least three drum motions, wherein selecting at least three drum motions comprises:

selecting a step motion, comprising rotating the drum at a first predetermined rotational speed, pausing rotation of the drum at a first predetermined position for a predetermined period, and resuming rotation of the drum at the first predetermined rotational speed;

selecting a swing motion, comprising rotating the drum in a first direction at a second predetermined rotational speed until the drum reaches a second predetermined position, thereafter rotating the drum in a second direction opposite the first direction at the second predetermined rotational speed until the drum reaches a third predetermined position, and thereafter rotating the drum in the first direction at the second predetermined rotational speed; and selecting a scrub motion, comprising rotating the drum in the first direction at a third predetermined rotational speed until the drum reaches a fourth predetermined position, thereafter rotating the drum in the second direction at the third predetermined rotational speed until the drum reaches a fifth predetermined position, and thereafter rotating the drum in the first direction at the third predetermined rotational speed.

6. The method of claim 5, wherein the first and third predetermined rotational speeds are substantially equal to each other, and the second predetermined rotational speed is less than the first and third predetermined rotational speeds.

7. The method of claim 6, wherein the fourth and fifth predetermined positions are closer to the first predetermined position than the second and third predetermined positions are.

8. A method of operating a laundry machine implementing a plurality of drum motions, the plurality of drum motions including a rolling motion, a tumbling motion, a step motion, a swing motion, a scrub motion, a filtration motion and a squeeze motion, the method comprising:

performing the filtration motion in combination with at least one of the rolling motion, step motion, swing motion or scrub motion;

performing the rolling motion in combination with at least one of the step motion or scrub motion; or performing the swing motion with at least one of the step motion or the scrub motion.

9. The method of claim 8, wherein (a) filtration motion comprises rotating a drum of the laundry machine at a first predetermined rotational speed;

(b) rolling motion comprises rotating the drum at a second predetermined rotational speed, the first rotational speed being greater than the second rotational speed;

(c) the step motion comprises (i) rotating the drum at a third predetermined rotational speed, (ii) pausing rotation of the drum at a first predetermined position for a predetermined period, and (iii) repeating steps (c) (i) and (c) (ii);

(d) the swing motion comprises (i) rotating the drum in a first direction at a fourth predetermined rotational speed until the drum reaches a second predetermined position, (ii) rotating the drum in a second direction opposite the first direction at the fourth predetermined rotational speed until the drum reaches a third predetermined position, and (iii) repeating steps (d) (i) and (d) (ii); and (e) the scrub motion comprises (i) rotating the drum in the first direction at a fifth predetermined rotational speed until the drum reaches a fourth predetermined position, (ii) rotating the drum in the second direction opposite the first direction at the fifth predetermined rotational speed until the drum reaches a fifth predetermined position, and (iii) repeating steps (e) (i) and (e)(ii), the first, third and fifth predetermined rotational speeds being greater than the second and fourth predetermined rotational speeds.

10. The method of claim 8, wherein (a) rolling motion comprises rotating a drum at a first predetermined rotational speed;

(b) the step motion comprises (i) rotating the drum at a second predetermined rotational speed, (ii) pausing rotation of the drum at a first predetermined position for a predetermined period, and (iii) repeating steps (b) (i) and (b) (ii); and (c) the scrub motion comprises (i) rotating the drum in the first direction at a third predetermined rotational speed until the drum reaches a second predetermined position, (ii) rotating the drum in the second direction opposite the first direction at the third predetermined rotational speed until the drum reaches a third predetermined position, and (iii) repeating steps (c) (i) and (c)(ii), the second and third predetermined rotational speeds being greater than the first predetermined rotational speed.

11. The method of claim 8, wherein (a) the swing motion comprises (i) rotating the drum in a first direction at a first predetermined rotational speed until the drum reaches a first predetermined position, (ii) rotating the drum in a second direction opposite the first direction at the first predetermined rotational speed until the drum reaches a second predetermined position, and (iii) repeating steps (a) (i) and (d) (ii);

(b) the step motion comprises (i) rotating the drum at a second predetermined rotational speed, (ii) pausing rotation of the drum at a third predetermined position for a predetermined period, and (iii) repeating steps (b) (i) and (b) (ii); and (c) the scrub motion comprises (i) rotating the drum in the first direction at a third predetermined rotational speed until the drum reaches a fourth predetermined position, (ii) rotating the drum in the second direction opposite the first direction at the fourth predetermined rotational speed until the drum reaches a fifth predetermined position, and (iii) repeating steps (c) (i) and (c)(ii), the second and third predetermined rotational speeds being greater than the first predetermined rotational speed.

12. The method of claim 8, wherein a drum of the laundry machine has an axis of rotation through a center of the drum, the step motion comprising:

rotating the drum at a first predetermined rotational speed such that a reference point on the drum, initially positioned at an initial position, rotates about the axis of rotation, wherein the reference point is any point on a side of the drum;

changing the rotational speed of the drum when the reference point has traveled a first predetermined distance about the axis of rotation of the drum;

resuming rotation of the drum at a second predetermined rotational speed; and changing the rotational speed of the drum when the reference point has traveled a second predetermined distance about the axis of rotation of the drum, such that the reference point of the drum has returned to a position substantially at the initial position.

13. The method of claim 8, wherein a drum of the laundry machine has an axis of rotation through a center of the drum, the scrub motion, comprising:

(a) rotating the drum in a first direction at a first predetermined rotational speed such that a reference point on the drum, initially positioned at an initial position, rotates about the axis of rotation to a first predetermined position, wherein the reference point is any point on a side of the drum;

(b) when the reference point has reached the first predetermined position, changing the direction of rotation of the drum and rotating the drum in a second direction opposite the first direction at the first predetermined rotational speed such that the reference point of the drum travels back through the initial position toward a second predetermined position;

(c) when the reference point has reached the second predetermined position, changing the direction of rotation of the drum and rotating the drum in the first direction such that the reference point travels back toward the initial position; and (d) applying any one or more of the following during at least one of the step (a), step (b) or step (c):

(i) a rotational speed of the drum in the first and second directions is greater than 45 RPMs; or (ii) the reference point of the drum is greater than an absolute value of 90 degrees from the initial position at the first and second predetermined positions; or (iii) changing direction of rotation of the drum comprises braking a motor that drives the drum or changing a rotation direction of the motor to apply a reverse torque to the drum.

14. A method of operating a laundry machine implementing a plurality of drum motions which are different from one another by at least one of the drum speed, drum rotational direction, amount of drum rotation, change in drum rotational direction, and amount of centrifugal force generated in laundry item received in the drum, comprising:

selecting at least three drum motions of the plurality of drum motions based on at least one of a plurality of washing conditions or a selected washing course; and operating the laundry machine based on the selected at least three drum motions, wherein selecting at least three drum motions comprises selecting at least three of:

a step motion for a maximum falling and striking effect on laundry items received in the drum;

a rolling motion for a friction effect on laundry items received in the drum;

a scrub motion for a friction effect on laundry items received in the drum that is greater than that provided by the rolling motion;

a tumbling motion for a disentangling effect on laundry items received in the drum;

a filtration motion for a squeezing and circulating effect on laundry items received in the drum; or a swing motion for a minimal falling and striking effect on laundry items received in the drum.

* * * * *